US008418297B2

(12) United States Patent
Mikkelsen et al.

(10) Patent No.: US 8,418,297 B2
(45) **Date of Patent: *Apr. 16, 2013**

(54) RETICULATED MATERIAL BODY SUPPORT AND METHOD

(75) Inventors: Tom D. Mikkelsen, Kingsport, TN (US); Kenneth E. Mitchell, Albuquerque, NM (US)

(73) Assignee: Tempur-Pedic Management, LLC, Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/346,640

(22) Filed: Dec. 30, 2008

(65) Prior Publication Data

US 2009/0165213 A1 Jul. 2, 2009

Related U.S. Application Data

(63) Continuation-in-part of application No. 11/166,594, filed on Jun. 24, 2005, now Pat. No. 7,469,437.

(51) Int. Cl.
*A47C 27/15* (2006.01)

(52) U.S. Cl.
USPC ..... 5/740; 5/655.9; 5/724; 428/71

(58) Field of Classification Search ..... 5/724, 730, 5/736, 740, 655.9, 652.1; 428/71, 315.9, 428/316.6, 319.3; 442/370, 372, 221, 223; 297/452.27
See application file for complete search history.

(56) References Cited

U.S. PATENT DOCUMENTS

| | | | |
|---|---|---|---|
| D28,903 | S | 6/1898 | Amory |
| 848,437 | A | 3/1907 | Brown |
| 1,312,886 | A | 11/1919 | Bawden |
| 1,382,831 | A | 11/1921 | Hiker |
| D59,900 | S | 12/1921 | Marsh |
| 1,742,186 | A | 1/1930 | Claus |

(Continued)

FOREIGN PATENT DOCUMENTS

| | | |
|---|---|---|
| CH | 678390 | 9/1991 |
| DE | 7926996 | 12/1979 |

(Continued)

OTHER PUBLICATIONS

PCT/US2009/069028 International Search Report and Written Opinion dated Mar. 11, 2010 (6 pages).

(Continued)

*Primary Examiner* — Michael Trettel

(57) ABSTRACT

A support cushion including a top surface, a bottom surface opposite top surface, a layer of flexible foam having plurality of cells defining a reticulated cellular structure, the reticulated cellular structure cells comprising a skeletal plurality of supports through which substantially open cell walls establish fluid communication between interior of the cell and interiors of adjacent cells, the layer of flexible foam having density no less than about 30 kg/m$^3$ and no greater than about 175 kg/m$^3$, and hardness of no less than about 20 N and no greater than about 150 N at 40% indentation force deflection measured at about 22 degrees Celsius, the layer of flexible foam comprising visco-elastic foam having at least one material property responsive to temperature change in range of 10-30° C., and layer of polyurethane foam located beneath layer of flexible foam, the layer of polyurethane foam having hardness of at least about 50 N.

17 Claims, 29 Drawing Sheets

U.S. PATENT DOCUMENTS

| | | | | |
|---|---|---|---|---|
| D94,702 | S | | 2/1935 | Marks |
| 2,013,481 | A | | 9/1935 | Stonehill |
| 2,056,767 | A | | 10/1936 | Blath |
| 2,149,140 | A | | 2/1939 | Gonzalez-Rincones |
| 2,167,622 | A | | 8/1939 | Bentivoglio |
| 2,192,601 | A | | 3/1940 | Mattison |
| D126,825 | S | | 4/1941 | Kolisch |
| 2,295,906 | A | | 9/1942 | Lacour |
| 2,298,218 | A | | 10/1942 | Madson |
| 2,499,965 | A | | 3/1950 | Miller |
| 2,522,120 | A | | 9/1950 | Kaskey |
| 2,552,476 | A | | 5/1951 | Barton |
| 2,604,642 | A | | 7/1952 | Marco |
| 2,674,752 | A | | 4/1954 | Berman |
| 2,724,133 | A | | 11/1955 | Sorrell |
| 2,759,200 | A | | 8/1956 | Johnston |
| 2,765,480 | A | | 10/1956 | Mueller |
| 2,835,313 | A | | 5/1958 | Dodge |
| 2,835,906 | A | | 5/1958 | Robbins |
| 2,836,228 | A | | 5/1958 | Dahle |
| 2,898,975 | A | | 8/1959 | Wagner |
| 3,043,731 | A | | 7/1962 | Hill |
| 3,047,517 | A | | 7/1962 | Wherley |
| 3,124,812 | A | | 3/1964 | Milton et al. |
| 3,148,389 | A | | 9/1964 | Lustig |
| 3,210,781 | A | | 10/1965 | Pollock |
| 3,222,697 | A | | 12/1965 | Scheemesser |
| 3,278,955 | A | | 10/1966 | Freelander et al. |
| 3,287,748 | A | | 11/1966 | Trogdon et al. |
| 3,327,330 | A | | 6/1967 | McCullough |
| D211,244 | S | | 6/1968 | Hawley |
| 3,400,413 | A | | 9/1968 | La Grossa |
| 3,469,882 | A | | 9/1969 | Larsen |
| 3,563,837 | A | | 2/1971 | Smith et al. |
| 3,574,397 | A | | 4/1971 | Norriss |
| 3,604,023 | A | | 9/1971 | Lynch |
| 3,606,461 | A | | 9/1971 | Moriyama |
| 3,608,106 | A | | 9/1971 | Parramon |
| 3,637,458 | A | | 1/1972 | Parrish |
| 3,742,526 | A | | 7/1973 | Lillard |
| 3,757,365 | A | | 9/1973 | Kretchmer |
| 3,766,577 | A | | 10/1973 | Stewart |
| D230,804 | S | | 3/1974 | Lijewski |
| 3,795,018 | A | | 3/1974 | Broaded |
| 3,829,917 | A | | 8/1974 | De Laittre et al. |
| 3,837,021 | A | | 9/1974 | Sellers et al. |
| 3,855,653 | A | | 12/1974 | Stalter, Sr. |
| 3,870,662 | A | | 3/1975 | Lundberg |
| 3,896,062 | A | | 7/1975 | Morehouse |
| 3,900,648 | A | | 8/1975 | Smith |
| 3,949,137 | A | | 4/1976 | Akrongold et al. |
| 3,974,532 | A | | 8/1976 | Ecchuya |
| 3,987,507 | A | | 10/1976 | Hall |
| 4,007,503 | A | | 2/1977 | Watkin |
| 4,027,888 | A | | 6/1977 | Wilcox |
| 4,042,987 | A | * | 8/1977 | Rogers ..... 5/730 |
| 4,060,863 | A | | 12/1977 | Craig |
| 4,065,150 | A | | 12/1977 | Van Auken |
| D247,312 | S | | 2/1978 | Zeiss |
| 4,118,813 | A | | 10/1978 | Armstrong |
| 4,147,825 | A | | 4/1979 | Talalay |
| 4,173,048 | A | | 11/1979 | Varaney |
| 4,177,806 | A | | 12/1979 | Griffin |
| 4,207,636 | A | | 6/1980 | Ceriani |
| 4,218,792 | A | | 8/1980 | Kogan |
| 4,225,643 | A | | 9/1980 | Lilley |
| D258,557 | S | | 3/1981 | Herr |
| D258,793 | S | | 4/1981 | Rinz |
| 4,260,440 | A | | 4/1981 | Frankenberg |
| D259,381 | S | | 6/1981 | Smith |
| D260,125 | S | | 8/1981 | Rogers |
| 4,326,310 | A | | 4/1982 | Frankenberg |
| 4,374,172 | A | | 2/1983 | Schwarz et al. |
| 4,397,053 | A | | 8/1983 | Fanti |
| 4,440,817 | A | | 4/1984 | Ahlm |
| 4,449,261 | A | | 5/1984 | Magnusson |
| 4,454,309 | A | | 6/1984 | Gould et al. |
| 4,480,346 | A | | 11/1984 | Hawkins et al. |
| 4,496,535 | A | | 1/1985 | Gould et al. |
| D278,779 | S | | 5/1985 | Sink |
| 4,524,473 | A | | 6/1985 | Fanti |
| 4,539,057 | A | | 9/1985 | Ahlm |
| D282,427 | S | | 2/1986 | O'Sullivan |
| 4,571,761 | A | | 2/1986 | Perlin |
| 4,580,301 | A | | 4/1986 | Ludman et al. |
| 4,584,730 | A | | 4/1986 | Rajan |
| D284,724 | S | | 7/1986 | Clark et al. |
| 4,606,088 | A | | 8/1986 | Michaelsen et al. |
| 4,624,021 | A | | 11/1986 | Hofstetter |
| 4,656,196 | A | * | 4/1987 | Kelly et al. ..... 521/52 |
| 4,673,452 | A | | 6/1987 | Awdhan |
| 4,682,378 | A | | 7/1987 | Savenije |
| 4,698,864 | A | | 10/1987 | Graebe |
| 4,736,477 | A | | 4/1988 | Moore |
| 4,748,768 | A | | 6/1988 | Jacobsen |
| 4,754,510 | A | | 7/1988 | King |
| 4,759,089 | A | | 7/1988 | Fox |
| 4,773,107 | A | | 9/1988 | Josefek |
| 4,773,142 | A | | 9/1988 | Davis et al. |
| D298,198 | S | | 10/1988 | O'Sullivan |
| 4,777,855 | A | | 10/1988 | Cohen |
| 4,788,728 | A | | 12/1988 | Lake |
| 4,799,275 | A | | 1/1989 | Sprague, Jr. |
| 4,810,685 | A | | 3/1989 | Twigg et al. |
| 4,821,355 | A | | 4/1989 | Burkhardt |
| 4,824,174 | A | | 4/1989 | Dunn, Sr. |
| 4,826,882 | A | | 5/1989 | Bredbenner et al. |
| 4,828,902 | A | | 5/1989 | Welygan et al. |
| 4,832,007 | A | | 5/1989 | Davis, Jr. et al. |
| 4,842,330 | A | | 6/1989 | Jay |
| 4,843,666 | A | | 7/1989 | Elesh et al. |
| D302,592 | S | | 8/1989 | Holmes |
| 4,856,118 | A | | 8/1989 | Sapiejewski |
| 4,862,539 | A | | 9/1989 | Bokich |
| 4,862,540 | A | | 9/1989 | Savenije |
| 4,863,712 | A | | 9/1989 | Twigg et al. |
| D303,897 | S | | 10/1989 | Phillips |
| D305,084 | S | | 12/1989 | Gyebnar |
| 4,896,389 | A | | 1/1990 | Chamberland |
| D306,245 | S | | 2/1990 | Akhtarekhavari |
| 4,899,323 | A | | 2/1990 | Fukahori et al. |
| 4,908,893 | A | | 3/1990 | Smit |
| 4,910,818 | A | | 3/1990 | Grabill et al. |
| 4,911,916 | A | | 3/1990 | Cleary |
| 4,929,359 | A | | 5/1990 | Tiernan |
| D308,311 | S | | 6/1990 | Forsland |
| D308,787 | S | | 6/1990 | Youngblood |
| 4,945,127 | A | | 7/1990 | Kagawa et al. |
| 4,950,694 | A | | 8/1990 | Hager |
| 4,955,095 | A | | 9/1990 | Gerrick |
| D314,116 | S | | 1/1991 | Reed |
| 4,987,156 | A | | 1/1991 | Tozune et al. |
| 4,999,868 | A | | 3/1991 | Kraft |
| 5,004,531 | A | | 4/1991 | Tiernan |
| 5,006,569 | A | | 4/1991 | Stone |
| 5,010,610 | A | | 4/1991 | Ackley |
| 5,011,642 | A | | 4/1991 | Welygan et al. |
| 5,018,231 | A | | 5/1991 | Wang |
| 5,018,790 | A | | 5/1991 | Jay |
| 5,019,602 | A | | 5/1991 | Lowe |
| D319,751 | S | | 9/1991 | Hoff |
| 5,049,591 | A | | 9/1991 | Hayashi et al. |
| D320,715 | S | | 10/1991 | Magnin et al. |
| 5,054,143 | A | | 10/1991 | Javaher |
| 5,057,252 | A | | 10/1991 | Kagawa et al. |
| 5,061,737 | A | | 10/1991 | Hudson |
| D321,562 | S | | 11/1991 | Ljungvall |
| 5,081,728 | A | | 1/1992 | Skinner |
| 5,084,926 | A | | 2/1992 | Wattie et al. |
| 5,088,141 | A | | 2/1992 | Meyer et al. |
| 5,093,384 | A | | 3/1992 | Hayashi et al. |
| 5,105,490 | A | | 4/1992 | Shek |
| D325,839 | S | | 5/1992 | Main |
| 5,114,989 | A | | 5/1992 | Elwell et al. |
| 5,117,519 | A | | 6/1992 | Thomas |
| 5,117,522 | A | | 6/1992 | Everett |
| 5,121,515 | A | | 6/1992 | Hudson |

5,123,133 A 6/1992 Albert
5,125,123 A 6/1992 Engle
5,138,732 A 8/1992 Wattie et al.
5,143,679 A 9/1992 Weber et al.
5,148,564 A 9/1992 Reder
5,152,019 A 10/1992 Hirata
5,156,793 A 10/1992 Buell et al.
5,167,897 A 12/1992 Weber et al.
5,172,436 A 12/1992 Masuda
D333,938 S 3/1993 Watson et al.
D334,318 S 3/1993 Chee
D336,809 S 6/1993 Emery
5,216,771 A 6/1993 Hoff
5,219,893 A 6/1993 Konig et al.
5,231,717 A 8/1993 Scott et al.
D341,509 S 11/1993 Evans
5,260,345 A 11/1993 DesMarais et al.
5,265,295 A 11/1993 Sturgis
5,268,224 A 12/1993 DesMarais et al.
5,277,915 A 1/1994 Provonchee et al.
5,318,997 A 6/1994 Okada et al.
5,323,500 A 6/1994 Roe et al.
5,328,935 A 7/1994 Van Phan et al.
5,331,015 A 7/1994 DesMarais et al.
5,335,651 A 8/1994 Foster et al.
5,337,845 A 8/1994 Foster et al.
5,338,766 A 8/1994 Phan et al.
5,367,731 A 11/1994 O'Sullivan
5,370,111 A 12/1994 Reeder et al.
D354,356 S 1/1995 Shiflett
D354,876 S 1/1995 Pace
5,382,602 A 1/1995 Duffy et al.
5,387,207 A 2/1995 Dyer et al.
5,392,498 A 2/1995 Goulait et al.
5,398,354 A 3/1995 Balonick et al.
5,418,991 A 5/1995 Shiflett
5,420,170 A 5/1995 Lutter et al.
D358,957 S 6/1995 Propp
5,425,567 A 6/1995 Albecker, III
D359,870 S 7/1995 McLaughlin
5,437,070 A 8/1995 Rempp
5,451,452 A 9/1995 Phan et al.
5,454,126 A 10/1995 Foster et al.
5,457,831 A 10/1995 Foster et al.
5,457,832 A 10/1995 Tatum
5,478,494 A 12/1995 Lee et al.
5,479,666 A 1/1996 Foster et al.
5,482,980 A 1/1996 Pcolinsky
D367,390 S 2/1996 Johnston et al.
5,497,766 A 3/1996 Foster et al.
5,505,871 A 4/1996 Harder et al.
5,506,035 A 4/1996 Van Phan et al.
5,508,316 A 4/1996 Nakamura et al.
D369,663 S 5/1996 Gostine
5,513,402 A 5/1996 Schwartz
5,518,802 A 5/1996 Colvin et al.
5,519,068 A 5/1996 Okada et al.
5,519,907 A 5/1996 Poths
5,523,144 A 6/1996 Dyer et al.
5,528,784 A 6/1996 Painter
5,530,980 A 7/1996 Sommerhalter, Jr.
5,537,703 A 7/1996 Launder et al.
5,544,377 A 8/1996 Gostine
5,553,338 A 9/1996 Amann
5,558,314 A 9/1996 Weinstein
D374,146 S 10/1996 Bonaddio et al.
5,562,091 A 10/1996 Foster et al.
5,567,740 A 10/1996 Free
5,572,757 A 11/1996 O'Sullivan
5,575,871 A 11/1996 Ryoshi et al.
5,577,278 A 11/1996 Barker et al.
5,579,549 A 12/1996 Selman et al.
5,591,780 A 1/1997 Muha et al.
5,592,706 A 1/1997 Pearce
5,596,781 A 1/1997 Graebe
5,629,076 A 5/1997 Fukasawa et al.
5,636,395 A 6/1997 Serda
5,638,564 A 6/1997 Greenawalt et al.
5,644,809 A 7/1997 Olson
5,652,194 A 7/1997 Dyer et al.
D381,855 S 8/1997 Galick
D382,163 S 8/1997 Hartney
D383,026 S 9/1997 Torbik
5,664,271 A 9/1997 Bellavance
5,669,094 A 9/1997 Swanson
5,678,266 A 10/1997 Petringa et al.
5,682,633 A 11/1997 Davis
5,686,500 A 11/1997 Fishback et al.
5,686,502 A 11/1997 Murray et al.
5,687,436 A 11/1997 Denton
D387,235 S 12/1997 Carpenter
5,698,601 A 12/1997 Welte et al.
D388,648 S 1/1998 Bates
D388,649 S 1/1998 Chekuri
D388,650 S 1/1998 Davis
5,708,998 A 1/1998 Torbik
D390,405 S 2/1998 Jung
D391,112 S 2/1998 Houston
5,721,284 A 2/1998 Smits et al.
5,724,685 A 3/1998 Weismiller et al.
D393,564 S 4/1998 Liu
5,738,925 A 4/1998 Chaput
5,746,218 A 5/1998 Edge
5,747,140 A 5/1998 Heerklotz
5,749,111 A 5/1998 Pearce
D394,977 S 6/1998 Frydman
D395,568 S 6/1998 Davis
5,769,489 A 6/1998 Dellanno
5,770,635 A 6/1998 Lee et al.
5,778,470 A 7/1998 Haider
5,781,947 A 7/1998 Sramek
D397,270 S 8/1998 Maalouf
5,787,534 A 8/1998 Hargest et al.
5,797,154 A 8/1998 Contreras
5,798,533 A 8/1998 Fishback et al.
5,802,646 A 9/1998 Stolpmann et al.
5,807,367 A 9/1998 Dilnik et al.
D399,675 S 10/1998 Ferris
5,815,865 A 10/1998 Washburn et al.
5,829,081 A 11/1998 Pearce
5,836,653 A 11/1998 Albecker
D402,150 S 12/1998 Wurmbrand et al.
5,848,448 A 12/1998 Boyd
5,850,648 A 12/1998 Morson
5,851,339 A 12/1998 Rucker
D404,237 S 1/1999 Boyd
5,856,678 A 1/1999 Smits et al.
5,884,351 A 3/1999 Tonino
D409,038 S 5/1999 Rojas, Jr. et al.
D410,810 S 6/1999 Lozier
5,913,774 A 6/1999 Feddema
D412,259 S 7/1999 Wilcox et al.
5,926,880 A 7/1999 Sramek
5,956,787 A 9/1999 James et al.
5,961,182 A 10/1999 Dellanno
D415,920 S 11/1999 Denney
D416,742 S 11/1999 Sramek
5,994,450 A 11/1999 Pearce
D417,579 S 12/1999 Tarquinio
D417,997 S 12/1999 Yannakis
6,003,177 A 12/1999 Ferris
6,003,178 A 12/1999 Montoni
D418,711 S 1/2000 Mettler
6,017,265 A 1/2000 Cook et al.
6,018,831 A 2/2000 Loomos
6,018,832 A 2/2000 Graebe
6,028,122 A 2/2000 Everitt et al.
6,034,149 A 3/2000 Bleys et al.
6,047,419 A 4/2000 Ferguson
6,049,927 A 4/2000 Thomas et al.
6,051,622 A 4/2000 Kinkelaar et al.
6,052,851 A 4/2000 Kohnle
6,055,690 A 5/2000 Koenig
6,061,856 A 5/2000 Hoffmann
6,079,066 A 6/2000 Backlund
6,085,372 A 7/2000 James et al.
6,093,468 A 7/2000 Toms et al.
D428,716 S 8/2000 Larger D429,106 S 8/2000 Bortolotto et al.
6,115,861 A 9/2000 Reeder et al.
6,128,795 A 10/2000 Stanley et al.
6,136,879 A 10/2000 Nishida et al.
D434,936 S 12/2000 May
6,154,905 A 12/2000 Frydman
6,156,842 A 12/2000 Hoenig et al.
6,159,574 A * 12/2000 Landvik et al. ..... 428/71
6,161,238 A 12/2000 Graebe
6,171,532 B1 1/2001 Sterzel
6,182,311 B1 2/2001 Buchanan et al.
6,182,312 B1 2/2001 Walpin
6,182,314 B1 2/2001 Frydman
6,187,837 B1 2/2001 Pearce
6,192,538 B1 2/2001 Fogel
D439,099 S 3/2001 Erickson
6,196,156 B1 3/2001 Denesuk et al.
6,202,232 B1 3/2001 Andrei
6,204,300 B1 3/2001 Kageoka et al.
6,212,720 B1 4/2001 Antinori et al.
6,223,369 B1 5/2001 Maier et al.
6,226,818 B1 5/2001 Rudick
6,237,173 B1 5/2001 Schlichter et al.
6,237,642 B1 5/2001 Lepoutre
6,239,186 B1 5/2001 Mansfield et al.
6,240,654 B1 6/2001 Weber et al.
6,241,320 B1 6/2001 Chew et al.
6,245,824 B1 6/2001 Frey et al.
6,253,400 B1 7/2001 Rudt-Sturzenegger et al.
6,254,189 B1 7/2001 Closson
6,256,821 B1 7/2001 Boyd
D446,305 S 8/2001 Buchanan et al.
6,292,964 B1 9/2001 Rose et al.
6,317,908 B1 11/2001 Walpin
6,317,912 B1 11/2001 Graebe et al.
6,327,725 B1 12/2001 Veilleux et al.
6,345,401 B1 2/2002 Frydman
6,347,421 B1 2/2002 D'Emilio
6,347,423 B1 2/2002 Stumpf
D455,311 S 4/2002 Fux
6,367,106 B1 4/2002 Gronsman
D456,659 S 5/2002 Landvik
D456,660 S 5/2002 Landvik
6,391,933 B1 5/2002 Mattesky
6,391,935 B1 5/2002 Hager et al.
6,401,283 B2 6/2002 Thomas et al.
6,408,467 B2 6/2002 Walpin
6,412,127 B1 7/2002 Cuddy
6,413,458 B1 7/2002 Pearce
6,414,047 B1 7/2002 Abe
6,471,726 B2 10/2002 Wang
6,475,514 B1 11/2002 Blitzer et al.
6,481,033 B2 11/2002 Fogel
D466,750 S 12/2002 Landvik
D466,751 S 12/2002 Coats et al.
6,491,846 B1 12/2002 Reese, II et al.
6,491,933 B2 12/2002 Lorenzi et al.
6,513,179 B1 2/2003 Pan
6,519,798 B2 2/2003 Gladney et al.
6,523,198 B1 2/2003 Temple
6,523,201 B1 2/2003 De Michele
6,523,202 B2 2/2003 Loomos
D471,750 S 3/2003 Jamvold et al.
6,541,094 B1 * 4/2003 Landvik et al. ..... 428/71
D474,364 S 5/2003 Arcieri
6,557,197 B1 5/2003 Graham
RE38,135 E 6/2003 Stolpmann et al.
6,574,809 B1 6/2003 Rathbun
6,578,218 B2 6/2003 Wassilefsky
6,578,220 B1 6/2003 Smith
6,579,457 B1 6/2003 Ehrnsperger et al.
6,583,194 B2 6/2003 Sendijarevic
6,586,485 B1 7/2003 Bruchmann et al.
6,601,253 B1 8/2003 Tarquinio
6,602,579 B2 8/2003 Landvik
6,616,699 B2 9/2003 Zilla et al.
6,617,014 B1 9/2003 Thomson
6,617,369 B2 9/2003 Parfondry et al.
6,625,829 B2 9/2003 Zell
6,634,045 B1 10/2003 DuDonis et al.
6,635,688 B2 10/2003 Simpson
6,638,986 B2 10/2003 Falke et al.
6,641,569 B1 11/2003 Coles et al.
6,653,362 B2 11/2003 Toyota et al.
6,653,363 B1 11/2003 Tursi, Jr. et al.
6,662,393 B2 12/2003 Boyd
6,671,907 B1 1/2004 Zuberi
6,673,057 B1 1/2004 Ehrnsperger et al.
6,684,425 B2 2/2004 Davis
6,687,935 B2 2/2004 Reeder et al.
6,691,353 B2 2/2004 Fuhriman
6,694,556 B2 2/2004 Stolpmann
6,699,917 B2 3/2004 Takashima
6,701,555 B1 3/2004 Ermini
6,701,556 B2 3/2004 Romano et al.
6,701,558 B2 3/2004 VanSteenburg
6,702,848 B1 3/2004 Zilla et al.
6,709,729 B2 3/2004 Baruch
D489,749 S 5/2004 Landvik
6,733,074 B2 5/2004 Groth
6,733,083 B1 5/2004 Landvik et al.
6,734,220 B2 5/2004 Niederoest et al.
6,735,800 B1 5/2004 Salvatini et al.
6,742,207 B1 6/2004 Brown
6,745,419 B1 6/2004 Delfs et al.
6,756,415 B2 6/2004 Kimura et al.
6,779,211 B1 8/2004 Williams
6,810,541 B1 11/2004 Woods
6,813,790 B2 11/2004 Flick et al.
6,817,441 B2 11/2004 Murakami et al.
6,845,534 B1 1/2005 Huang
6,848,128 B2 2/2005 Verbovszky et al.
6,848,138 B1 2/2005 Maier et al.
6,857,151 B2 2/2005 Jusiak et al.
6,866,915 B2 3/2005 Landvik
6,868,569 B2 3/2005 VanSteenburg
6,872,758 B2 3/2005 Simpson et al.
D504,269 S 4/2005 Faircloth
6,877,176 B2 4/2005 Houghteling
6,877,540 B2 4/2005 Barman et al.
6,893,656 B2 5/2005 Blitzer et al.
6,898,814 B2 5/2005 Kawamura et al.
6,912,749 B2 7/2005 Thomas et al.
6,915,539 B2 7/2005 Rathbun
6,915,741 B2 7/2005 Price et al.
6,918,631 B2 7/2005 Verbovszky
6,928,677 B1 8/2005 Pittman
6,928,678 B1 8/2005 Chang
6,933,469 B2 8/2005 Ellis et al.
6,946,497 B2 9/2005 Yu
6,952,850 B2 10/2005 Visser et al.
6,952,852 B2 10/2005 Reeder et al.
6,954,954 B2 10/2005 Stelnicki
6,954,957 B2 10/2005 Metzger et al.
6,988,286 B2 1/2006 Schecter et al.
6,993,799 B2 2/2006 Foster et al.
7,036,172 B2 5/2006 Torbet et al.
7,051,389 B2 5/2006 Wassilefky
7,059,000 B2 6/2006 Verbovszky
7,059,001 B2 6/2006 Woolfson
7,060,213 B2 6/2006 Pearce
7,065,816 B2 6/2006 McGettigan
7,076,818 B2 7/2006 Kummer et al.
7,076,822 B2 7/2006 Pearce
7,078,443 B2 7/2006 Milliren
7,083,102 B2 8/2006 Good et al.
7,094,748 B2 8/2006 Ofosu-Asante et al.
7,094,811 B2 8/2006 Nodelman et al.
7,097,243 B2 8/2006 Verbovszky
7,146,666 B2 12/2006 Christofferson et al.
7,169,824 B2 1/2007 Bleys et al.
7,200,884 B2 4/2007 Wright et al.
7,208,531 B2 4/2007 Neff et al.
7,238,730 B2 7/2007 Apichatachutapan et al.
7,240,384 B2 7/2007 DuDonis
7,240,386 B1 7/2007 McKay et al.
7,255,917 B2 8/2007 Rochlin et al.
7,276,036 B2 10/2007 Sendijarevic et al.

| | | | | |
|---|---|---|---|---|
| 7,284,494 | B2 | 10/2007 | Rensink | |
| 7,293,311 | B2 | 11/2007 | Baker | |
| 7,303,536 | B2 | 12/2007 | Sendijarevic et al. | |
| 7,360,266 | B2 | 4/2008 | Kasatshko | |
| 7,388,037 | B2 | 6/2008 | Sasaki et al. | |
| 7,395,568 | B2 | 7/2008 | Damewood | |
| 7,423,003 | B2 | 9/2008 | Volpenhein et al. | |
| 7,451,506 | B2 | 11/2008 | Kummer et al. | |
| 7,461,424 | B2 | 12/2008 | Lindell | |
| 7,467,435 | B1 | 12/2008 | McKay et al. | |
| 7,469,436 | B2 | 12/2008 | Meyer et al. | |
| 7,469,437 | B2 * | 12/2008 | Mikkelsen et al. | 5/740 |
| 7,472,432 | B2 | 1/2009 | Owen | |
| 7,493,668 | B2 | 2/2009 | Piraino | |
| 7,496,981 | B2 | 3/2009 | Alonso Cucurull | |
| 7,507,468 | B2 | 3/2009 | Landvik et al. | |
| 7,530,127 | B2 | 5/2009 | Leifermann et al. | |
| 7,555,615 | B2 | 6/2009 | Landvik | |
| 7,574,762 | B2 | 8/2009 | Baker | |
| 7,604,761 | B2 | 10/2009 | Abrigo et al. | |
| 7,608,640 | B2 | 10/2009 | Messadek | |
| 7,617,556 | B2 | 11/2009 | Rensink | |
| 7,624,464 | B2 | 12/2009 | Gladney et al. | |
| 7,632,306 | B2 | 12/2009 | Zilla et al. | |
| 7,650,658 | B1 | 1/2010 | McKay et al. | |
| 7,950,084 | B1 | 5/2011 | McKay et al. | |
| 2001/0027577 | A1 | 10/2001 | Frydman | |
| 2001/0032365 | A1 | 10/2001 | Sramek | |
| 2001/0034908 | A1 | 11/2001 | Daly | |
| 2002/0018884 | A1 | 2/2002 | Thomson | |
| 2002/0040502 | A1 | 4/2002 | Woolfson | |
| 2002/0043736 | A1 | 4/2002 | Murakami et al. | |
| 2002/0051338 | A1 | 5/2002 | Jiang et al. | |
| 2002/0078507 | A1 | 6/2002 | Pearce | |
| 2002/0108176 | A1 | 8/2002 | Ragen | |
| 2002/0124320 | A1 | 9/2002 | Washburn et al. | |
| 2002/0128420 | A1 | 9/2002 | Simpson et al. | |
| 2003/0005521 | A1 | 1/2003 | Sramek | |
| 2003/0028969 | A1 | 2/2003 | Rossdeutscher | |
| 2003/0065046 | A1 | 4/2003 | Hamilton | |
| 2003/0130635 | A1 | 7/2003 | Tate et al. | |
| 2003/0135930 | A1 | 7/2003 | Varese et al. | |
| 2003/0150060 | A1 | 8/2003 | Huang | |
| 2003/0150061 | A1 | 8/2003 | Farley | |
| 2003/0168063 | A1 | 9/2003 | Gambone et al. | |
| 2003/0175497 | A1 | 9/2003 | Kobe et al. | |
| 2003/0181538 | A1 | 9/2003 | Martel et al. | |
| 2003/0186044 | A1 | 10/2003 | Sauniere et al. | |
| 2003/0188383 | A1 | 10/2003 | Ense | |
| 2003/0199404 | A1 | 10/2003 | Lorenzi et al. | |
| 2003/0229154 | A1 | 12/2003 | Kemmler et al. | |
| 2004/0031102 | A1 | 2/2004 | Woolfson | |
| 2004/0031103 | A1 | 2/2004 | Wyatt et al. | |
| 2004/0054250 | A1 | 3/2004 | Benincasa et al. | |
| 2004/0074008 | A1 * | 4/2004 | Martens et al. | 5/740 |
| 2004/0097608 | A1 | 5/2004 | Re'em | |
| 2004/0120992 | A1 | 6/2004 | Lorenzi et al. | |
| 2004/0128748 | A1 | 7/2004 | Monica | |
| 2004/0139548 | A1 | 7/2004 | Hwang-Pao | |
| 2004/0139552 | A1 | 7/2004 | Walters, Jr. | |
| 2004/0142619 | A1 | 7/2004 | Ueno et al. | |
| 2004/0163180 | A1 | 8/2004 | Bryant | |
| 2004/0164499 | A1 | 8/2004 | Murakami et al. | |
| 2004/0181003 | A1 | 9/2004 | Murakami et al. | |
| 2004/0226099 | A1 | 11/2004 | Pearce | |
| 2004/0229970 | A1 | 11/2004 | Sasaki et al. | |
| 2004/0237206 | A1 * | 12/2004 | Webster et al. | 5/727 |
| 2004/0261186 | A1 | 12/2004 | Gladney | |
| 2004/0266900 | A1 | 12/2004 | Neff et al. | |
| 2005/0000026 | A1 | 1/2005 | Gladney | |
| 2005/0017396 | A1 | 1/2005 | Pearce et al. | |
| 2005/0043423 | A1 | 2/2005 | Schmidt et al. | |
| 2005/0060807 | A1 | 3/2005 | Kaizuka | |
| 2005/0060809 | A1 | 3/2005 | Rogers | |
| 2005/0140199 | A1 | 6/2005 | Kang et al. | |
| 2005/0166330 | A1 | 8/2005 | Williams | |
| 2005/0210595 | A1 | 9/2005 | Di Stasio et al. | |
| 2005/0214501 | A1 | 9/2005 | Baychar | |
| 2006/0031995 | A1 | 2/2006 | Barkhouse | |
| 2006/0031996 | A1 | 2/2006 | Rawls-Meehan | |
| 2006/0048303 | A1 | 3/2006 | Reyes Cuadros | |
| 2006/0145526 | A1 | 7/2006 | Niekel et al. | |
| 2006/0162087 | A1 | 7/2006 | Chang | |
| 2006/0253988 | A1 | 11/2006 | Pearce | |
| 2006/0260059 | A1 | 11/2006 | Apperson et al. | |
| 2006/0260060 | A1 | 11/2006 | Apperson et al. | |
| 2006/0288490 | A1 | 12/2006 | Mikkelsen et al. | |
| 2006/0288491 | A1 | 12/2006 | Mikkelsen et al. | |
| 2007/0135878 | A1 | 6/2007 | Lachenbruch et al. | |
| 2007/0245493 | A1 | 10/2007 | Leifermann et al. | |
| 2007/0246157 | A1 | 10/2007 | Mason et al. | |
| 2007/0271705 | A1 * | 11/2007 | Woolfson et al. | 5/655.9 |
| 2009/0100602 | A1 | 4/2009 | Rathie | |
| 2009/0217458 | A1 | 9/2009 | Lord | |
| 2010/0005595 | A1 | 1/2010 | Gladney et al. | |
| 2011/0047710 | A1 | 3/2011 | Beard | |
| 2011/0173758 | A1 | 7/2011 | Fontaine | |
| 2011/0314607 | A1 * | 12/2011 | Woolfson et al. | 5/636 |

FOREIGN PATENT DOCUMENTS

| | | | |
|---|---|---|---|
| DE | 3321720 | | 12/1984 |
| DE | 4040156 | | 6/1992 |
| DE | 19961753 | | 6/2001 |
| DE | 20207664 | | 8/2002 |
| DE | 10237089 | | 2/2004 |
| DE | 202004003248 | | 5/2004 |
| DK | MR 1985 00079 | | 1/1985 |
| DK | MR 1985 00375 | | 5/1985 |
| EP | 0486016 | | 5/1992 |
| EP | 0608626 | | 8/1994 |
| EP | 0713900 | | 5/1996 |
| EP | 0718144 | | 6/1996 |
| EP | 0777988 | | 6/1997 |
| EP | 0782830 | | 7/1997 |
| EP | 0838310 | | 4/1998 |
| EP | 1060859 | | 12/2000 |
| EP | 1167019 | | 1/2002 |
| EP | 1240852 | | 9/2002 |
| EP | 1430814 | | 6/2004 |
| FR | 837297 | | 2/1939 |
| FR | 2396648 | | 2/1979 |
| FR | 2795187 | | 12/2000 |
| FR | 2795371 | | 12/2000 |
| FR | 2818187 | | 6/2002 |
| GB | 122806 | | 2/1919 |
| GB | 1273259 | | 5/1972 |
| GB | 2290256 | A * | 12/1995 |
| GB | 2297057 | | 7/1996 |
| GB | 2314506 | | 1/1998 |
| JP | 11123127 | A | 5/1999 |
| JP | 2000005015 | | 1/2000 |
| JP | 2002102021 | A | 4/2002 |
| JP | 2004002591 | | 1/2004 |
| NL | 8403393 | | 6/1986 |
| SE | 457327 | | 12/1988 |
| WO | 85/04150 | | 9/1985 |
| WO | 86/07528 | | 12/1986 |
| WO | 92/08759 | | 5/1992 |
| WO | 98/03333 | | 1/1998 |
| WO | 98/41126 | | 9/1998 |
| WO | 98/45359 | | 10/1998 |
| WO | 99/02077 | | 1/1999 |
| WO | 99/08571 | | 2/1999 |
| WO | 99/15126 | | 4/1999 |
| WO | 99/52405 | | 10/1999 |
| WO | 00/62850 | | 10/2000 |
| WO | 01/16217 | | 3/2001 |
| WO | 01/25305 | | 4/2001 |
| WO | 01/28388 | | 4/2001 |
| WO | 01/47340 | | 7/2001 |
| WO | 02/00157 | | 1/2002 |
| WO | 02/38099 | | 5/2002 |
| WO | 02/051900 | | 7/2002 |
| WO | 02/051902 | | 7/2002 |
| WO | 02/062891 | | 8/2002 |
| WO | 02/077056 | | 10/2002 |
| WO | 03/046041 | | 6/2003 |
| WO | 03/070061 | | 8/2003 |

| | | |
|---|---|---|
| WO | 03/099079 | 12/2003 |
| WO | 2004/020496 | 3/2004 |
| WO | 2004/036794 | 4/2004 |
| WO | 2004/039858 | 5/2004 |
| WO | 2004/055624 | 7/2004 |
| WO | 2004/063088 | 7/2004 |
| WO | 2004/082436 | 9/2004 |
| WO | 2004/089682 | 10/2004 |
| WO | 2004/100829 | 11/2004 |
| WO | 2005/031111 | 4/2005 |
| WO | 2005/089297 | 9/2005 |

OTHER PUBLICATIONS

Extended European Search Report from the European Patent Office for Application No. 06773770.0 dated Feb. 24, 2012 (8 pages).

"In Touch Information on flexible polyurethane foam," Polyurethane Foam Association, May 1991, Retrieved from Internet on Feb. 13, 2012 <URL: http://www.web.archive.org/web/20040611094033/http://www.pfa.org/intouch/new_pdf/hr_IntouchV1.2.pdf>.

* cited by examiner

RETICULATED MATERIAL BODY SUPPORT AND METHOD

CROSS-REFERENCE TO RELATED APPLICATIONS

This is a continuation-in-part of U.S. patent application Ser. No. 11/166,594 filed on Jun. 24, 2005, now U.S. Pat. No. 7,469,437, the entire contents of which are incorporated herein by reference.

FIELD OF THE INVENTION

Conventional body supports can be found in a wide variety of shapes and sizes, and are often adapted for supporting one or more body parts of a user. As used herein, the term "body support" includes without limitation any deformable element adapted to support one or more parts or all of a human or animal in any position. Examples of body supports include mattresses, pillows, and cushions of any type, including those for use in beds, seats, and in other applications.

Many body supports are constructed entirely or partially out of foam material. For example, polyurethane foam is commonly used in many mattresses, pillows, and cushions, and can be used alone or in combination with other types of cushion materials. In many body supports, visco-elastic material is used, providing the body support with an increased ability to conform to a user and to thereby distribute the weight or other load of the user. Some visco-elastic body support materials are also temperature sensitive, thereby also enabling the body support to change shape based in part upon the temperature of the supported body part.

Although the number and types of body supports constructed with one or more visco-elastic materials continue to increase, the capabilities of such materials are often underutilized. In many cases, this underutilization is due to poor body support design and/or the choice of material(s) used in the body support.

Based at least in part upon the limitations of existing body supports and the high consumer demand for improved body supports in a wide variety of applications, new body supports are welcome additions to the art.

SUMMARY OF THE INVENTION

Some embodiments of the present invention provide a support cushion. The support cushion includes a top surface, a bottom surface opposite the top surface and separated from the top surface by a distance defining a thickness of the support cushion, a layer of flexible foam having a plurality of cells defining a reticulated cellular structure, the cells of the reticulated cellular structure comprising a skeletal plurality of supports through which substantially open cell walls establish fluid communication between an interior of the cell and interiors of adjacent cells, the layer of flexible foam having a density no less than about 30 kg/m$^3$ and no greater than about 175 kg/m$^3$, and a hardness of no less than about 20 N and no greater than about 150 N at 40% indentation force deflection measured at about 22 degrees Celsius, the layer of flexible foam comprising visco-elastic foam having at least one material property responsive to a temperature change in a range of 10-30° C., and a layer of polyurethane foam located beneath the layer of flexible foam, the layer of polyurethane foam having a hardness of at least about 50 N. At least one of the layer of flexible foam and the layer of polyurethane foam has a profiled surface at least partially defining a plurality of air flow paths between the layer of flexible foam and the layer of polyurethane foam.

Further aspects of the present invention, together with the organization and operation thereof, will become apparent from the following detailed description of the invention when taken in conjunction with the accompanying drawings, wherein like elements have like numerals throughout the drawings.

Figure 1:
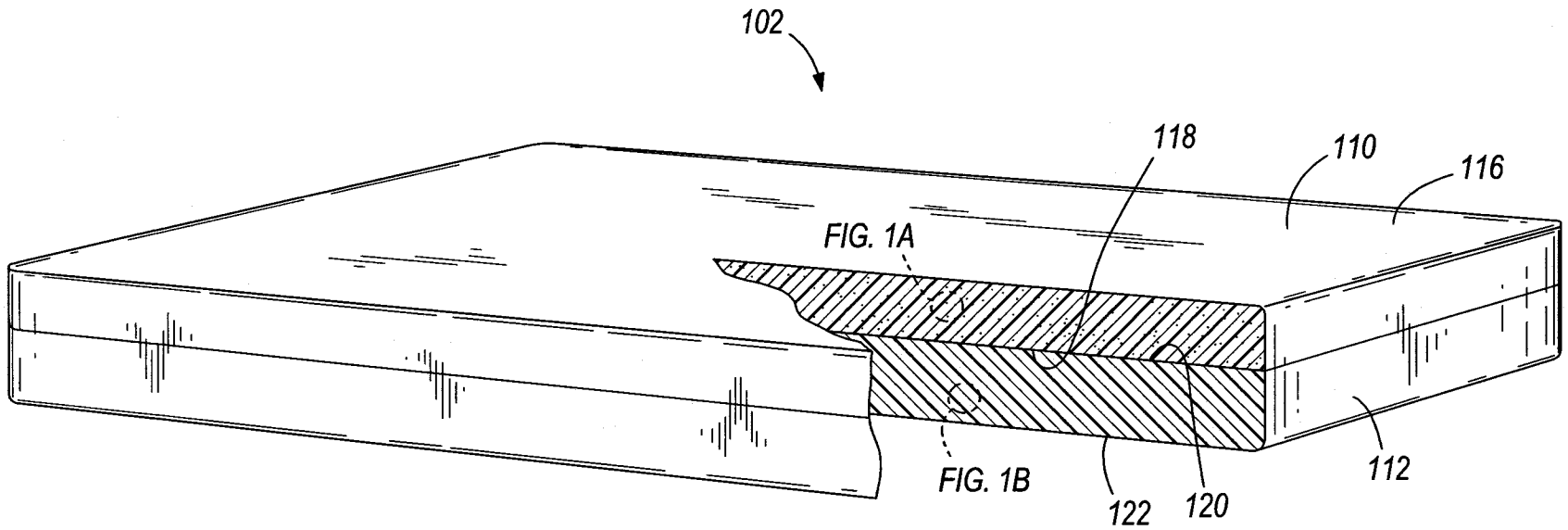
FIG. 1 is a sectioned perspective view of a body support according to a first embodiment of the present invention.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance. The use of "including," "comprising," or "having" and variations thereof herein is meant to encompass the items listed thereafter and equivalents thereof as well as additional items. Unless limited otherwise, the terms "connected," "coupled," and variations thereof herein are used broadly and encompass direct and indirect connections and couplings. In addition, the terms "connected" and "coupled" and variations thereof are not restricted to physical or mechanical connections or couplings.

DETAILED DESCRIPTION

Figure 1A:
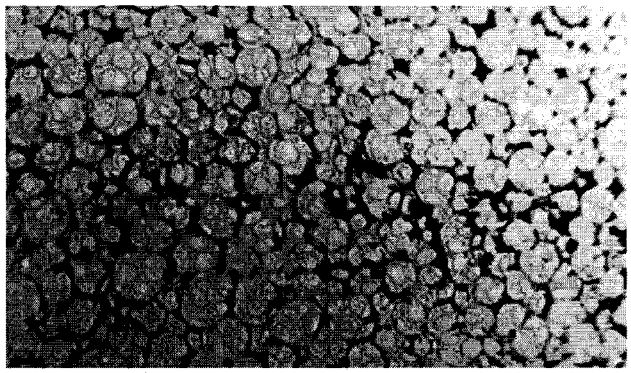
FIG. 1A is a detail view of the material in a layer of the body support illustrated in FIG. 1.
Figure 1B:
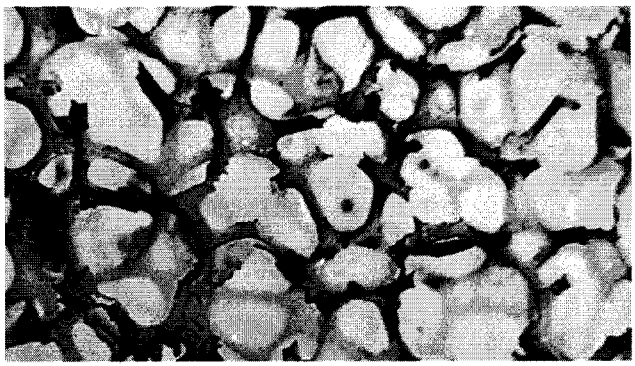
FIG. 1B is a detail view of the material in another layer of the body support illustrated in FIG. 1.

A body support 102 according to an embodiment of the present invention is illustrated in FIGS. 1, 1A, and 1B, and comprises two layers of material: a top layer 110 comprising open-celled non-reticulated visco-elastic foam (sometimes referred to as "memory foam" or "low resilience foam") and a bottom layer 112 comprising reticulated non-visco-elastic foam. In some embodiments, the top layer 110 can rest upon the bottom layer 112 without being secured thereto. However, in other embodiments, the top and bottom layers 110, 112 are secured to one another by adhesive or cohesive bonding material, by being bonded together during formation of the top and bottom layers 110, 112, by tape, hook and loop fastener material, conventional fasteners, stitches extending at least partially through the top and bottom layers 110, 112, or in any other suitable manner.

Each of the top and bottom layers 110, 112 can be substantially flat bodies having substantially planar top and bottom surfaces 116, 118, 120, 122 as shown in FIG. 1. However, in other embodiments, one or more of the top and bottom surfaces 116, 118, 120, 122 of either or both top and bottom layers 110, 112 can be non-planar, including without limitation surfaces having ribs, bumps, and other protrusions of any shape and size, surfaces having grooves, dimples, and other apertures that extend partially or fully through the respective layer 110, 112, and the like. Such alternative surface shapes are described in greater detail below in connection with other embodiments of the present invention. Also, depending at least in part upon the application of the body support 102 (i.e., the product defined by the body support 102 or in which the body support 102 is employed), either or both of the top and bottom layers 110, 112 can have shapes that are not flat. By way of example only, either or both layers 110, 112 can be generally wedge-shaped, can have a concave or convex cross-sectional shape, can have a combination of convex and concave shapes, can have a stepped, faceted, or other shape, can have a complex or irregular shape, and/or can have any other shape desired. Examples of such alternative shapes are presented in greater detail below in connection with other embodiments of the present invention.

In some embodiments, the top layer 110 provides a relatively soft and comfortable surface for a user's body or body portion (hereinafter referred to as "body"). Coupled with the slow recovery characteristic of the visco-elastic foam, the top layer 110 can also conform to a user's body, thereby distributing the force applied by the user's body upon the top layer 110. In some embodiments, the top layer 110 has a hardness of at least about 30 N and no greater than about 175 N for desirable softness and body-conforming qualities. In other embodiments, a top layer 110 having a hardness of at least about 40 N and no greater than about 110 N is utilized for this purpose. In still other embodiments, a top layer 110 having a hardness of at least about 40 N and no greater than about 75 N is utilized. Unless otherwise specified, the hardness of a material referred to herein is measured by exerting pressure from a plate against a sample of the material having length and width dimensions of 40 cm each (defining a surface area of the sample of material), and a thickness of 5 cm to a compression of 40% of an original thickness of the material at approximately room temperature (e.g., 21-23 Degrees Celsius), wherein the 40% compression is held for a set period of time, following the International Organization of Standardization (ISO) 2439 hardness measuring standard.

The top layer 110 can also have a density providing a relatively high degree of material durability. The density of the foam in the top layer 110 can also impact other characteristics of the foam, such as the manner in which the top layer 110 responds to pressure, and the feel of the foam. In some embodiments, the top layer 110 has a density of no less than about 30 kg/m$^3$ and no greater than about 150 kg/m$^3$. In other embodiments, a top layer 110 having a density of at least about 40 kg/m$^3$ and no greater than about 125 kg/m$^3$ is utilized. In still other embodiments, a top layer 110 having a density of at least about 60 kg/m$^3$ and no greater than about 115 kg/m$^3$ is utilized.

The visco-elastic foam of the top layer 110 can be selected for responsiveness to any range of temperatures. However, in some embodiments, a temperature responsiveness in a range of a user's body temperatures (or in a range of temperatures to which the body support 102 is exposed by contact or proximity to a user's body resting thereon) can provide significant advantages. For example, a visco-elastic foam selected for the top layer 110 can be responsive to temperature changes above at least about 0° C. In some embodiments, the visco-elastic foam selected for the top layer 110 can be responsive to temperature changes within a range of at least about 10° C. In other embodiments, the visco-elastic foam selected for the top layer 110 can be responsive to temperature changes within a range of at least about 15° C.

As used herein and in the appended claims, a material is considered "responsive" to temperature changes if the material exhibits a change in hardness of at least 10% measured by ISO Standard 3386 through the range of temperatures between 10 and 30 degrees Celsius.

With reference now to the illustrated embodiment of FIGS. 1, 1A, and 1B, the top layer 110 of the illustrated body support 102 comprises a cellular structure of flexible visco-elastic polyurethane foam in which the walls of the individual cells are substantially intact. In some embodiments, the bottom layer 112 comprising reticulated foam can reduce heat in the top layer 110, due at least in part to the cellular structure of the foam of the bottom layer 112. With reference to FIG. 1B, for example, the cells of the foam of the bottom layer 112 are essentially skeletal structures in which many (if not substantially all) of the cell walls separating one cell from another do not exist. In other words, the cells are defined by a plurality of supports or "windows" and by no cell walls, substantially no cell walls, or by a substantially reduced number of cell walls. Such a cellular foam structure is sometimes referred to as "reticulated" foam. In some embodiments, a foam is considered "reticulated" if at least 50% of the walls defining the cells of the foam do not exist (i.e., have been removed or were never allowed to form during the manufacturing process of the foam).

Also, in some embodiments it is desirable that the bottom layer 112 of reticulated non-visco-elastic foam be capable of providing some degree of support that is substantially independent of temperatures experienced by the top layer 110 when supporting a user's body (i.e., independent of a user's body heat). Therefore, the bottom layer 112 can comprise reticulated non-visco-elastic foam that is substantially insensitive to temperature changes within a range of between about 10° C. and about 35° C. As used herein, a material is "substantially insensitive" to temperature changes if the material exhibits a change in hardness of less than 10% measured by ISO Standard 3386 through the range of temperatures between 10 and 30 degrees Celsius. In some embodiments, the bottom layer 112 can comprise reticulated non-visco-elastic foam that is substantially insensitive to temperature changes within a range of between about 15° C. and about 30° C. In still other embodiments, a bottom layer 112 comprising reticulated non-visco-elastic foam that is substantially insensitive to temperature changes within a range of between about 15° C. and about 25° C. can be used.

By virtue of the skeletal cellular structure of the bottom layer 112 illustrated in FIGS. 1 and 1B, heat in the top layer 110 can be transferred away from the top layer 110, thereby helping to keep a relatively low temperature in the top layer 110. Also, the reticulated non-visco-elastic foam of the bottom layer 112 can enable significantly higher airflow into, out of, and through the bottom layer 112—a characteristic of the bottom layer 112 that can also help to keep a relatively low temperature in the top layer 110.

Like the top layer 110, the bottom layer 112 can have a density providing a relatively high degree of material durability. Also, the density of the foam in the bottom layer 112 can also impact other characteristics of the foam, such as the manner in which the bottom layer 112 responds to pressure, and the feel of the foam. In some embodiments, the bottom layer 112 has a density of no less than about 20 kg/m$^3$ and no greater than about 80 kg/m$^3$. In other embodiments, a bottom layer 112 having a density of at least about 25 kg/m$^3$ and no greater than about 60 kg/m$^3$ is utilized. In still other embodiments, a bottom layer 112 having a density of at least about 30 kg/m$^3$ and no greater than about 40 kg/m$^3$ is utilized.

Also, in some embodiments, the bottom layer 112 has a hardness of at least about 50 N and no greater than about 300 N. In other embodiments, a bottom layer 112 having a hardness of at least about 80 N and no greater than about 250 N is utilized. In still other embodiments, a bottom layer 112 having a hardness of at least about 90 N and no greater than about 180 N is utilized.

The body support 102 illustrated in FIGS. 1-1B can have a bottom layer 112 that is at least as thick as the top layer 110, thereby providing a significant ventilation and/or heat dissipation layer that, in some embodiments, is relatively temperature insensitive. In some embodiments, the bottom layer 112 is at least half the thickness as the top layer 110. In other embodiments, the bottom layer 112 is at least about the same thickness as the top layer 110. In still other embodiments, the bottom layer 112 is at least about 2 times as thick as the top layer 110.

The body support 102 illustrated in FIGS. 1, 1A, and 1B is a mattress, mattress topper, overlay, or futon, and is illustrated in such form by way of example only. It will be appreciated that the features of the body support 102 described above are applicable to any other type of body support having any size and shape. By way of example only, these features are equally applicable to head pillows, seat cushions, seat backs, neck pillows, leg spacer pillows, eye masks, and any other element used to support or cushion any part or all of a human or animal body. Accordingly, as used herein and in the appended claims, the term "body support" is intended to refer to any and all of such elements (in addition to mattresses, mattress toppers, overlays, or futons). It should also be noted that each of the body supports described and illustrated herein is presented in a particular form, such as a mattress, mattress topper, overlay, futon, or pillow. However, absent description herein to the contrary, any or all of the features of each such body support can be applied to any other type of body support having any other shape and size, including the various types of body supports mentioned above.

Figure 2A:
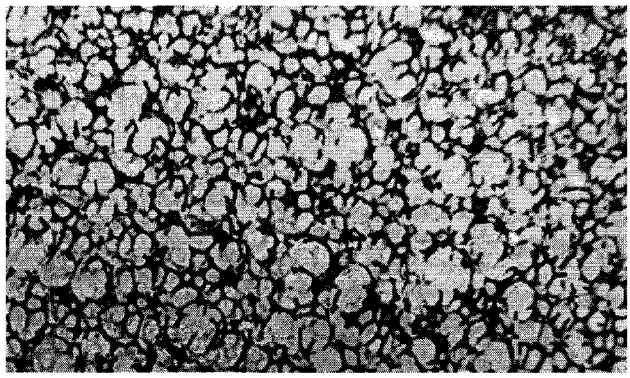
FIG. 2A is a detail view of the material in a layer of the body support illustrated in FIG. 2.
Figure 2:
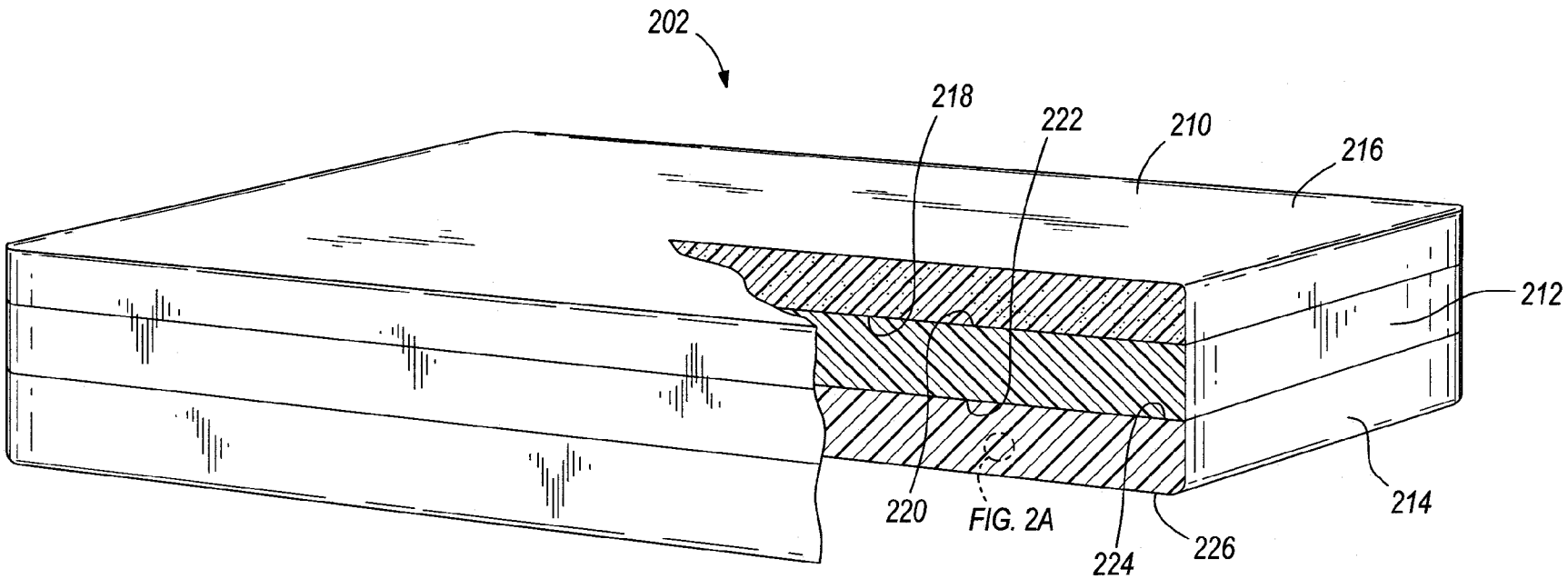
FIG. 2 is a sectioned perspective view of a body support according to another embodiment of the present invention

FIGS. 2 and 2A illustrate another embodiment of a body support according to the present invention. This embodiment employs much of the same structure and has many of the same properties as the embodiments of the body support described above in connection with FIGS. 1-1B. Accordingly, the following description focuses primarily upon the structure and features that are different than the embodiments described above in connection with FIGS. 1-1B. Reference should be made to the description above in connection with FIGS. 1-1B for additional information regarding the structure and features, and possible alternatives to the structure and features of the body support illustrated in FIGS. 2 and 2A and described below. Structure and features of the embodiment shown in FIGS. 2 and 2A that correspond to structure and features of the embodiment of FIGS. 1-1B are designated hereinafter in the 200 series of reference numbers.

Like the embodiment illustrated in FIGS. 1-1B, the body support 202 illustrated in FIGS. 2 and 2A has a top layer 210 comprising open or closed celled non-reticulated visco-elastic foam and an underlying layer 212 comprising reticulated non-visco-elastic foam. In some embodiments, the body support 202 can therefore provide the desirable softness, body-conforming, ventilation, and heat transfer properties described above. The body support 202 illustrated in FIGS. 2 and 2A further comprises a bottom layer 214 beneath the layer of reticulated non-visco-elastic foam 212. Therefore, the layer 212 of reticulated non-visco-elastic foam is a middle layer 212 located between the top and bottom layers 210, 214 of the body support 202.

The bottom layer 214 of the body support 202 illustrated in FIGS. 2 and 2A comprises a cellular structure of flexible polyurethane foam, as best shown in FIG. 2A. In some embodiments, the middle layer 212 can rest upon the bottom layer 214 without being secured thereto. However, in other embodiments, the middle and bottom layers 212, 214 are secured to one another in any of the manners described above with reference to the possible types of connection between the top and bottom layers 110, 112 in the illustrated embodiment of FIGS. 1-1B. In this regard, it should be noted that absent description herein to the contrary, any adjacent layers of material in any of the body support embodiments disclosed herein can be permanently or releasably secured to one another in any of the manners described above (with reference to the possible types of connection between the top and bottom layers 110, 112 in the illustrated embodiment of FIGS. 1-1B), or can be unconnected.

Each of the top, middle, and bottom layers 210, 212, 214 can be substantially flat bodies having substantially planar top and bottom surfaces 216, 218, 220, 222, 224, 226 as shown in FIG. 2. However, any or all of the top and bottom surfaces can have any of the non-planar shapes described above in connection with the surfaces 116, 118, 120, 122 in the illustrated embodiment of FIGS. 1-1B. Also, depending at least in part upon the application of the body support 202 (i.e., the product defined by the body support 202 or in which the body support 202 is employed), either or both of the top, middle, and bottom layers 210, 212, 214 can have a shape that is not flat, including any of the shapes described above in connection with the illustrated embodiment of FIGS. 1-1B.

Absent description herein to the contrary, any or all of the layers of material in any of the body support embodiments disclosed herein can be substantially flat, or can have any shape that is not flat, including any of the shapes described above in connection with the illustrated embodiment of FIGS. 1-1B. Also absent description herein to the contrary, the surfaces of either or both opposite faces of any or all of the layers of material in any of the body support embodiments disclosed herein can be substantially planar, or can instead have any of the non-planar shapes described above in connection with the surfaces 116, 118, 120, 122 in the illustrated embodiment of FIGS. 1-1B.

In some embodiments, the bottom layer 214 is a supportive layer providing a relatively stiff substrate upon which the top and middle layers 210, 212 lie, while still having a degree of deformability to provide user comfort (to the extent that the user's weight affects the shape of the bottom layer 214). Therefore, the bottom layer 214 can comprise a foam having a relatively high resilience capable of providing significant support to the top and middle layers 210, 212. The bottom layer 214 can have a resilience greater than that of the other layers 210, 212 in the body support 202. In some embodiments, the bottom layer 214 has a hardness of at least about 50 N and no greater than about 300 N for a desirable degree of support and comfort. In other embodiments, a bottom layer 214 having a hardness of at least about 80 N and no greater than about 250 N is utilized for this purpose. In still other embodiments, a bottom layer 214 having a hardness of at least about 90 N and no greater than about 180 N is utilized.

Depending at least in part upon the thickness and material properties of the top and middle layers 210, 212, in some embodiments the bottom layer 214 can be exposed to substantial body heat from a user resting upon the body support 202. In such embodiments, the foam of the bottom layer 214 can be selected to be substantially insensitive to temperature changes (as defined above) within a range of between about 10° C. and about 35° C., thereby retaining the supportive properties desired for the bottom layer 214 throughout a range of body temperatures to which the bottom layer 214 may be exposed. In some embodiments, the bottom layer 214 can comprise foam that is substantially insensitive to temperature changes within a range of between about 15° C. and about 30° C. In still other embodiments, a bottom layer 214 of foam that is substantially insensitive to temperature changes within a range of between about 15° C. and about 25° C. can be used.

Like the top and middle layers 210, 212, the bottom layer 214 can have a density providing a relatively high degree of material durability. Also, the density of the foam in the bottom layer 214 can also impact other characteristics of the foam, such as the manner in which the bottom layer 214 responds to pressure, and the feel of the foam. In some embodiments, the bottom layer 214 has a density of no less than about 20 kg/m$^3$ and no greater than about 80 kg/m$^3$. In other embodiments, a bottom layer 214 having a density of at least about 25 kg/m$^3$ and no greater than about 60 kg/m$^3$ is utilized. In still other embodiments, a bottom layer 214 having a density of at least about 30 kg/m$^3$ and no greater than about 40 kg/m$^3$ is utilized.

The body support 202 illustrated in FIG. 2 can have a bottom layer 214 that is at least as thick as the combination of the top and middle layers 210, 212, thereby providing substantial support for the top and middle layers 210, 212. In some embodiments, the bottom layer 214 is at least about ⅔ of the combined thickness of the top and middle layers 210, 212. Also, in some embodiments, the bottom layer 214 is at least about half the combined thickness of the top and middle layers 210, 212.

Figure 3:
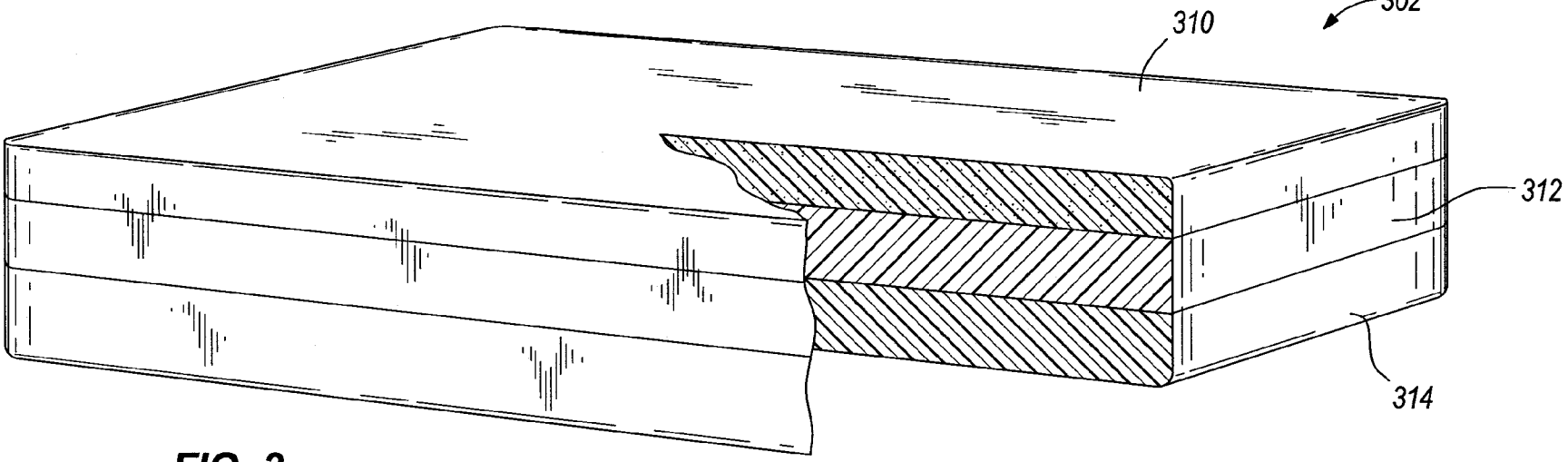
FIGS. 3-6 are sectioned perspective views of body supports according to additional embodiments of the present invention.

FIG. 3 illustrates another embodiment of a body support according to the present invention. This embodiment employs much of the same structure and has many of the same properties as the embodiments of the body support described above in connection with FIGS. 2 and 2A. Accordingly, the following description focuses primarily upon the structure and features that are different than the embodiments described above in connection with FIGS. 2 and 2A. Reference should be made to the description above in connection with FIGS. 2 and 2A for additional information regarding the structure and features, and possible alternatives to the structure and features of the body support illustrated in FIG. 3 and described below. Structure and features of the embodiment shown in FIG. 3 that correspond to structure and features of the embodiment of FIGS. 2 and 2A are designated hereinafter in the 300 series of reference numbers.

Like the body support 202 illustrated in FIGS. 2 and 2A, the body support 302 illustrated in FIG. 3 comprises a top layer 310 of open or closed celled non-reticulated visco-elastic foam, beneath which lie middle and bottom layers 312, 314 of the body support 302. However, the materials of the middle and bottom layers 312, 314 are switched compared to the body support 202 illustrated in FIGS. 2 and 2A. Accordingly, the middle layer 312 of the body support 302 illustrated in FIG. 3 comprises a relatively resilient flexible polyurethane foam, and the bottom layer 314 of the body support 302 comprises reticulated non-visco-elastic foam. The relatively highly resilient foam of the middle layer 312 is described in greater detail above in connection with the embodiment illustrated in FIGS. 2 and 2A, while the reticulated non-visco-elastic foam of the bottom layer 314 is described in greater detail above in connection with the embodiment illustrated in FIGS. 1-1B.

In the embodiment illustrated in FIG. 3, the non-reticulated visco-elastic foam can be provided with a desired degree of support by the adjacent underlying layer of relatively highly resilient foam, rather than by a layer of such material underlying another intermediate layer as shown in FIG. 2. In the structure illustrated in FIG. 3, the middle layer 312 can provide enhanced user support, depending at least in part upon the thicknesses of the top and middle layers 310, 312. In some embodiments, the bottom layer 314 of reticulated non-visco-elastic foam can reduce heat in the middle layer 312 (and in some embodiments, the top layer 310 as well), due at least in part to the reticulated cellular structure of the foam of the bottom layer 314.

The body support 302 illustrated in FIG. 3 can have a middle layer 312 that is at least about as thick as the top layer 310 to provide a desirable degree of support for the top layer 310. In some embodiments, the middle layer 312 can be at least about twice as thick as the top layer 310 for this purpose. In other embodiments, a middle layer 312 that is at least about three times as thick as the top layer 310 is used for this purpose.

With further reference to FIG. 3, the body support 302 can have a bottom layer 314 that is at least about 0.07 times as thick as the combined thickness of the top and middle layers 310, 312 to carry heat away from the middle layer 312 (and in some embodiments, the top layer 310 as well). In some embodiments, the bottom layer 314 can be at least about 0.15 times as thick as the combined thickness of the top and middle layers 310, 312 for this purpose. In other embodiments, a bottom layer 314 that is at least about 0.25 times as thick as the combined thickness of the top and middle layers 310, 312 is used for this purpose.

Figure 4:
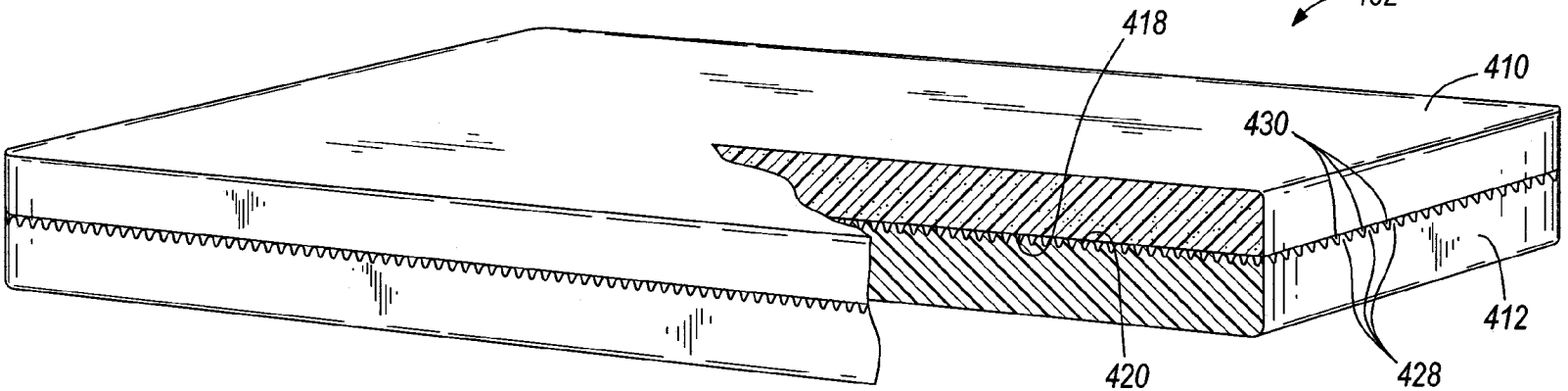

FIG. 4 illustrates another embodiment of a body support according to the present invention. This embodiment employs much of the same structure and has many of the same properties as the embodiments of the body support described above in connection with FIGS. 1-1B. Accordingly, the following description focuses primarily upon the structure and features that are different than the embodiments described above in connection with FIGS. 1-1B. Reference should be made to the description above in connection with FIGS. 1-1B for additional information regarding the structure and features, and possible alternatives to the structure and features of the body support illustrated in FIG. 4 and described below. Structure and features of the embodiment shown in FIG. 4 that correspond to structure and features of the embodiment of FIGS. 1-1B are designated hereinafter in the 400 series of reference numbers.

Like the body support 102 illustrated in FIGS. 1-1B, the body support 402 illustrated in FIG. 4 comprises a top layer 410 comprising open or closed celled non-reticulated visco-elastic foam, beneath which lies a bottom layer 412 comprising reticulated non-visco-elastic foam. However, the top surface 420 of the bottom layer 412 has a non-planar shape beneath the substantially planar bottom surface 418 of the top layer 410. In the embodiment of FIG. 4, the top surface 420 of the bottom layer 412 has a plurality of protrusions 428 extending toward the top layer 410. The protrusions 428 can be generally conical in shape, can be frusto-conical, or can have rounded tips as shown in FIG. 4.

The protrusions 428 of the bottom layer 412 and the bottom surface 418 of the top layer 410 define a plurality of passages 430 between the top and bottom layers 410, 412. The passages 430 permit movement of air between the top and bottom layers 410, 412, thereby improving heat transfer within the body support 402. Also or alternatively, heat in one or more locations of the body support 402 can be dissipated into and through the passages 430 between the top and bottom layers 410, 412. The improved heat transfer enabled by the passages 430 can be used to cool both layers 410, 412, and can be particularly useful in reducing heat in the top layer 410 closest to the user.

In some embodiments, the passages 430 between the top and bottom layers 410, 412 have an average height of no less than about 0.5 cm and no greater than about 10 cm. In other embodiments, the passages 430 have an average height of no less than about 1 cm and no greater than about 5 cm. In still other embodiments, passages 430 having an average height of no less than about 1 cm and no greater than about 3 cm are utilized. It will be appreciated that the average height of the passages 430 can depend at least in part upon the height of the protrusions 428 in the illustrated embodiment of FIG. 4. In other embodiments, the same average passage heights described above can still be employed using other types of protrusions alone or in combination with apertures as described in greater detail below.

As an alternative or in addition to the generally cone-shaped protrusions 428 illustrated in FIG. 4, the top surface 420 of the bottom layer 412 can have any other type of protrusion or combinations of types of protrusions desired, including without limitation pads, bumps, pillars, and other localized protrusions, ribs, waves (e.g., having a smooth, sawtooth, or other profile), and other elongated protrusions, and the like. Also or alternatively, the top surface 420 of the bottom layer 412 can have any number and type of apertures, including without limitation recesses, dimples, blind holes, through holes, grooves, and the like, any or all of which can be defined in whole or in part by any of the types of protrusions just described.

The passages 430 between the top and bottom layers 410, 412 of the body support 402 can be defined by protrusions 428, apertures, or any combination of protrusions 428 and apertures. Although the protrusions 428 and/or apertures need not necessarily be in any arrangement (e.g., a repeating or non-repeating pattern) on the bottom layer 412, in some embodiments the protrusions 428 are located on the bottom layer 412 in such a manner. For example, the generally cone-shaped protrusions 428 of the bottom layer 412 in the embodiment illustrated in FIG. 4 are regularly spaced across the top surface 420 of the bottom layer 412. In some embodiments, the areas of the top surface 420 located between the generally cone-shaped protrusions 428 can be recessed, and in some embodiments can cooperate with the protrusions 428 to resemble an egg-crate-shaped surface or any other surface shape desired.

Also, the protrusions 428 and/or apertures in the bottom layer 412 can define passages 430 that have a constant or substantially constant height. However, in other embodiments, the protrusions 428 and/or apertures in the bottom layer 412 can define passages 430 having a height that varies at different locations between the top and bottom layers 410, 412. Therefore, the passage height between the top and bottom layers 410, 412 can be expressed as an average height as described above.

In the illustrated embodiment of FIG. 4, the protrusions 428 are located on substantially the entire top surface 420 of the bottom layer 412. However, in other embodiments, the protrusions 428 can be located on less than all of the entire top surface 420, such as in one or more regions of the body support 402. Similarly, apertures at least partially defining the passages 430 can be defined in one or more regions or in substantially the entire top surface 420 of the bottom layer 412.

As described above, passages 430 between the top and bottom layers 410, 412 of the embodiment illustrated in FIG. 4 can be defined between a substantially planar bottom surface 418 of the top layer 410 and a plurality of protrusions 428 and/or apertures on the top surface 420 of the bottom layer 412. In this regard, passages 430 capable of performing ventilation and/or heat dissipating functions can be defined between the substantially planar bottom surface 418 of the top layer 410 and any non-planar top surface 420 of the bottom layer 412. In other embodiments, passages 430 can be defined between a non-planar bottom surface 418 of the top layer 410 and a substantially planar top surface 420 of the bottom layer 412. The non-planar bottom surface 418 of the top layer 410 can have any of the protrusion and/or recess features described above in connection with the top surface 420 of the bottom layer 412 illustrated in FIG. 4. Therefore, the description above regarding the non-planar top surface 420 of the bottom layer 412 applies equally to the bottom surface 418 of the top layer 410. In still other embodiments, passages 430 can be defined between a non-planar bottom surface 418 of the top layer 410 and a non-planar top surface 420 of the bottom layer 412. The non-planar surfaces 418, 420 can have any of the protrusion and/or recess features described above in connection with the top surface 420 of the bottom layer 412 illustrated in FIG. 4.

Figure 5:
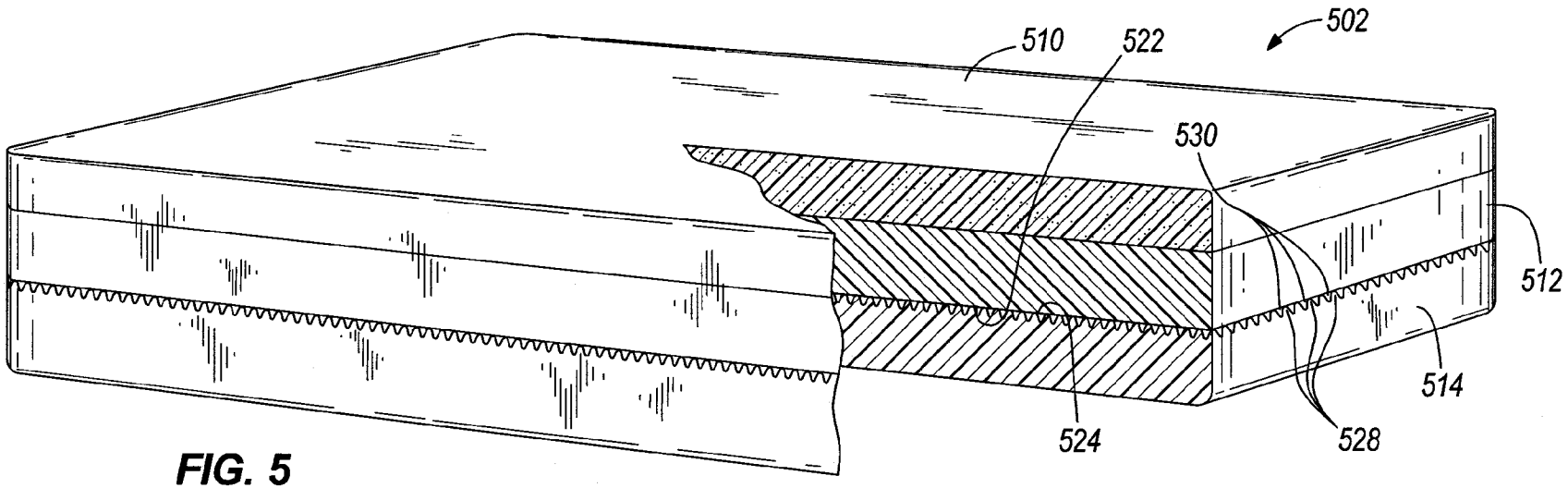

FIG. 5 illustrates another embodiment of a body support according to the present invention. This embodiment employs much of the same structure and has many of the same properties as the embodiments of the body support described above in connection with FIGS. 2 and 2A. Accordingly, the following description focuses primarily upon the structure and features that are different than the embodiments described above in connection with FIGS. 2 and 2A. Reference should be made to the description above in connection with FIGS. 2 and 2A for additional information regarding the structure and features, and possible alternatives to the structure and features of the body support illustrated in FIG. 5 and described below. Structure and features of the embodiment shown in FIG. 5 that correspond to structure and features of the embodiment of FIGS. 2 and 2A are designated hereinafter in the 500 series of reference numbers.

As described in greater detail above with regard to the body support 202 illustrated in FIGS. 2 and 2A, the body support 502 illustrated in FIG. 5 comprises a top layer 510 comprising open or closed celled non-reticulated visco-elastic foam, a middle layer 512 comprising reticulated non-visco-elastic foam, and a bottom layer 514 comprising flexible cellular polyurethane foam having a relatively high resilience. However, the top surface 524 of the bottom layer 514 has a non-planar shape beneath the substantially planar bottom surface 522 of the middle layer 512. The non-planar shape of the top surface 524 can take any of the forms described above in connection with the non-planar top surface 420 of the bottom layer 412 illustrated in FIG. 4, and can be defined by a plurality of protrusions 528 (as shown in FIG. 5) and/or a plurality of apertures as also described above. Passages 530 can be defined between the substantially planar bottom surface 522 of the middle layer 512 and the non-planar top surface 524 of the bottom layer 514. In other embodiments, such passages 530 can be defined between a non-planar bottom surface 522 of the middle layer 512 and a substantially planar top surface 524 of the bottom layer 514, or between a non-planar bottom surface 522 of the middle layer 512 and a non-planar top surface 524 of the bottom layer 514, wherein the non-planar surface(s) can be defined in any of the manners described above in connection with the illustrated embodiment of FIG. 4.

Passages 530 running between the middle and bottom layers 512, 514 illustrated in FIG. 5 can provide the body support 502 with a capacity for ventilation and/or with an increased ability to dissipate heat from the middle layer 512 of reticulated non-visco-elastic foam, which can receive a user's body heat from the top layer 510 of non-reticulated visco-elastic foam. The skeletal structure of the cells in the middle layer 512 can enable heat to be transferred from the top layer 512 to and through the passages 530. Although heat transfer in lateral directions (i.e., toward the edges of the body support 502) can still occur in the middle layer 512 of reticulated non-visco-elastic foam based at least in part upon the cell structure of such foam, the passages 530 can enhance this heat transfer.

Figure 6:
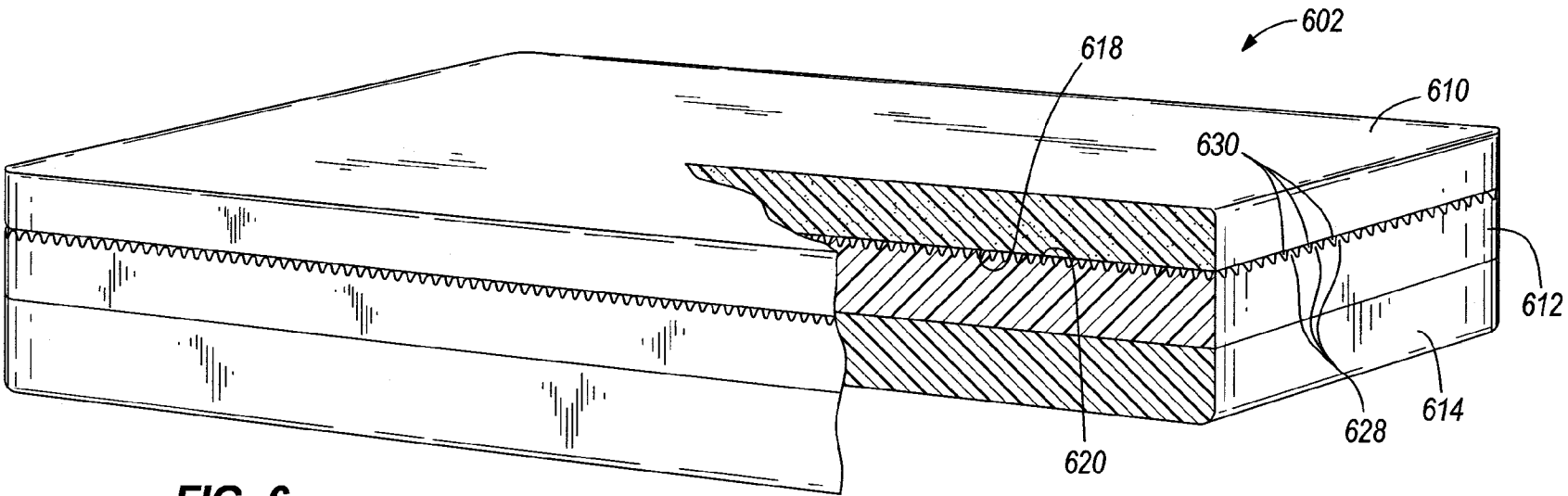

FIG. 6 illustrates another embodiment of a body support according to the present invention. This embodiment employs much of the same structure and has many of the same properties as the embodiments of the body support described above in connection with FIG. 3. Accordingly, the following description focuses primarily upon the structure and features that are different than the embodiments described above in connection with FIG. 3. Reference should be made to the description above in connection with FIG. 3 for additional information regarding the structure and features, and possible alternatives to the structure and features of the body support illustrated in FIG. 6 and described below. Structure and features of the embodiment shown in FIG. 6 that correspond to structure and features of the embodiment of FIG. 3 are designated hereinafter in the 600 series of reference numbers.

As described in greater detail above with regard to the body support 302 illustrated in FIG. 3, the body support 602 illustrated in FIG. 6 comprises a top layer 610 comprising open or closed celled non-reticulated visco-elastic foam, a middle layer 612 comprising flexible cellular polyurethane foam having a relatively high resilience, and a bottom layer 614 comprising reticulated non-visco-elastic foam. However, the top surface 620 of the middle layer 612 has a non-planar shape beneath the substantially planar bottom surface 618 of the top layer 610. The non-planar shape of the top surface 620 can take any of the forms described above in connection with the non-planar top surface 420 of the bottom layer 412 illustrated in FIG. 4, and can be defined by a plurality of protrusions 628 (as shown in FIG. 6) and/or a plurality of apertures as also described above. Passages 630 can be defined between the substantially planar bottom surface 618 of the top layer 610 and the non-planar top surface 620 of the middle layer 612. In other embodiments, the passages 630 can be defined between a non-planar bottom surface 618 of the top layer 610 and a substantially planar top surface 620 of the middle layer 612, or between a non-planar bottom surface 618 of the top layer 610 and a non-planar top surface 620 of the middle layer 612, wherein the non-planar surface(s) can be defined in any of the manners described above in connection with the illustrated embodiment of FIG. 4.

Passages 630 running between the top and middle layers 610, 612 illustrated in FIG. 6 can provide the body support 602 with a capacity for ventilation and/or with an increased ability to dissipate heat from the top layer 612 of non-reticulated visco-elastic foam (which can be immediately adjacent a user's body upon the body support 602). Also, the passages 630 can be particularly useful in providing ventilation and/or heat dissipation for the bottom layer 614 of the body support 602.

Figure 7:
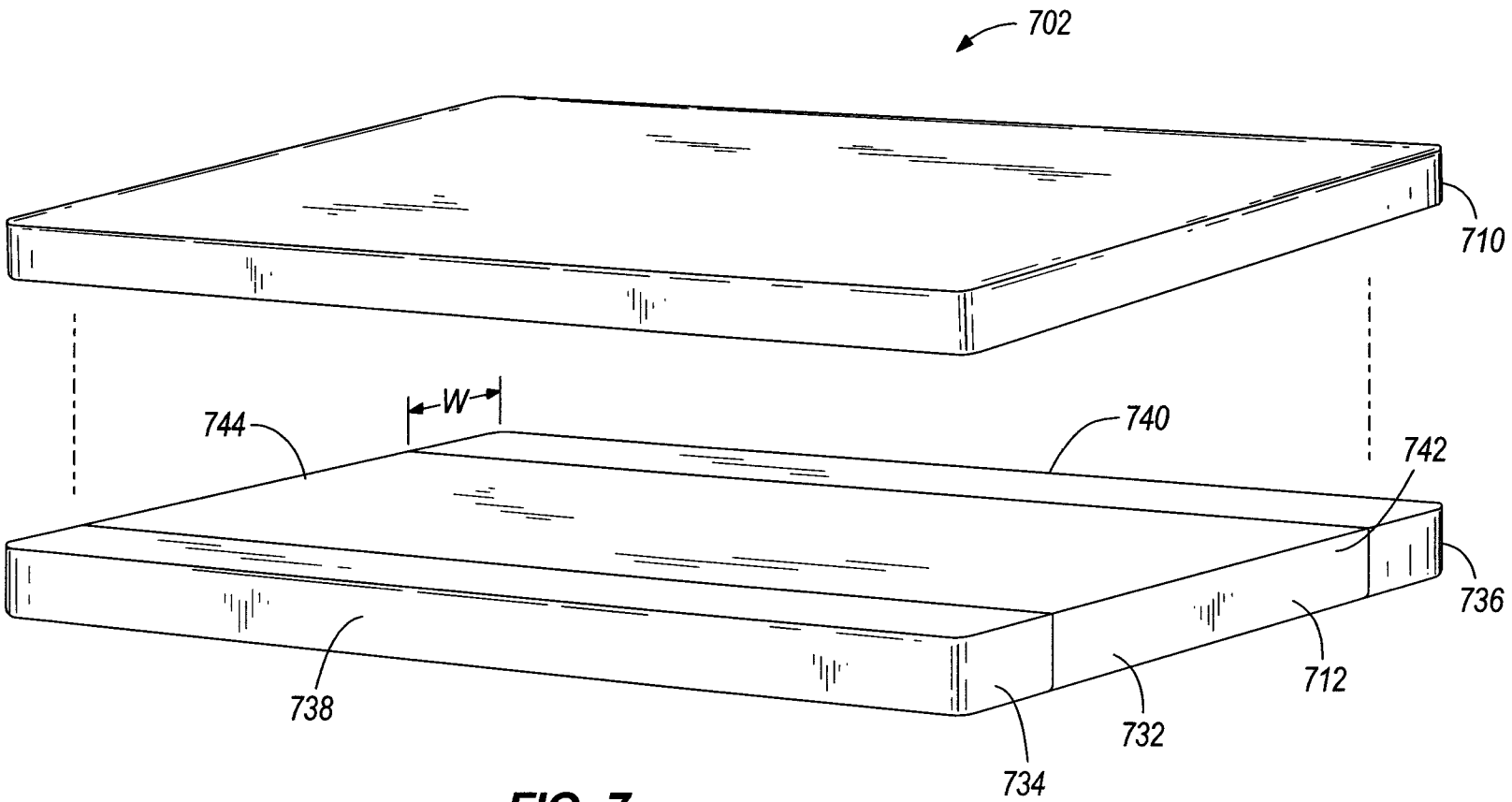
FIG. 7-9 are exploded perspective views of body supports according to additional embodiments of the present invention.

FIG. 7 illustrates another embodiment of a body support according to the present invention. This embodiment employs much of the same structure and has many of the same properties as the embodiments of the body support described above in connection with FIGS. 1-1B. Accordingly, the following description focuses primarily upon the structure and features that are different than the embodiments described above in connection with FIGS. 1-1B. Reference should be made to the description above in connection with FIGS. 1-1B for additional information regarding the structure and features, and possible alternatives to the structure and features of the body support illustrated in FIG. 7 and described below. Structure and features of the embodiment shown in FIG. 7 that correspond to structure and features of the embodiment of FIGS. 1-1B are designated hereinafter in the 700 series of reference numbers.

Like the body support 102 illustrated in FIGS. 1-1B, the body support 702 illustrated in FIG. 7 comprises a top layer 710 comprising open or closed celled non-reticulated visco-elastic foam, beneath which lies a bottom layer 712 comprising reticulated non-visco-elastic foam. However, the bottom layer 712 further comprises portions of flexible cellular polyurethane foam having a relatively high resilience. In particular, the bottom layer 712 has a first portion 732 comprising reticulated non-visco-elastic foam having the same properties as described above with reference to the bottom layer 112 of the body support 102 illustrated in FIG. 1, and second and third portions 734, 736 comprising flexible cellular polyurethane foam having the same properties as described above with reference to the bottom layer 214 of the body support 202 illustrated in FIG. 2. Therefore, the second and third portions 734, 736 of the bottom layer 712 illustrated in FIG. 7 define side borders of foam that is relatively stiff and supportive compared to the conventional reticulated non-visco-elastic foam of the first portion 732. Either or both of the second and third portions 734, 736 can have a width W that is at least about 1 cm and is no greater than about 20 cm. In other embodiments, either or both of the second and third portions 734, 736 can have a width W that is at least about 3 cm and is no greater than about 15 cm. In still other embodiments, either or both of the second and third portions 734, 736 can have a width W that is at least about 5 cm and is no greater than about 10 cm.

The second and third portions 734, 736 of the bottom layer 712 can have any width desired, and therefore can be wider or narrower than those illustrated in FIG. 7. Also, the second and third portions 734, 736 can have substantially constant widths as illustrated in FIG. 7, or can have widths that vary along the sides 738, 740 of the bottom layer 712. In addition, the second and third portions 734, 736 need not necessarily run along the entire length of the sides 738, 740 of the bottom layer 712 as shown in FIG. 7, and can instead run along any portion of the sides 738, 740 of the bottom layer 712 (e.g., only at the corners of the bottom layer 712, in two or more areas along either or both sides 738, 740 of the bottom layer 712, and the like). In this regard, the second and third portions 734, 736 need not necessarily be identical in width, length, or shape. Also, in other embodiments, the bottom layer 712 has only one of the second and third portions 734, 736.

As described above, the bottom layer 712 illustrated in FIG. 7 has second and third portions 734, 736 of flexible cellular foam having a relatively high resilience defining borders flanking a first portion 732 of reticulated non-visco-elastic foam. In other embodiments, the second and third portions 734, 736 of foam can instead be located at the ends 742, 744 of the bottom layer 712 (e.g., at the head and foot of the body support 702 at least partially defining a mattress, mattress topper, overlay, or futon), respectively, and in such locations can take any of the forms and shapes described above. In some embodiments, side and end borders of the relatively high resilience flexible cellular foam can be employed, thereby surrounding or at least partially surrounding the first portion 732 of reticulated non-visco-elastic foam. Any combination of borders and border locations of the relatively highly resilient flexible cellular foam can be utilized as desired.

By employing an underlying layer of reticulated non-visco-elastic foam having the properties described above, the first portion 732 of the bottom layer 712 can enhance ventilation of the body support 702 and/or heat dissipation from the top layer 710. In some embodiments, some types of reticulated foam do not provide a relatively high degree of support and resilience. Although such a foam can be acceptable in many applications, in some products, more supportive and resilient sides 738, 740 and/or ends 742, 744 of the bottom layer 712 are desirable. For example, a mattress having such sides 738, 740 and/or ends 742, 744 can better support a user entering or exiting a resting location on the mattress, and can better support a user sitting or leaning on an edge of the mattress.

Also, the location of a border of relatively highly resilient flexible cellular foam as described above can be selected based upon the desired heat dissipating qualities of the body support 702. For example, the borderless ends 742, 744 of the body support 702 illustrated in FIG. 7 can enable increased ventilation and/or heat dissipation from the first portion 732 of reticulated non-visco-elastic foam in the bottom layer 712. Similarly, body supports 702 having bordered ends 742, 744 of the relatively highly resilient flexible cellular foam and borderless sides 738, 740 can provide similar results. In those embodiments in which ventilation and heat dissipation through the ends and/or sides of the first portion 732 of reticulated non-visco-elastic foam is less important than additional resilience and support in such locations, a border of the relatively highly resilient flexible cellular foam can be provided in such locations.

In still other embodiments of the present invention, the bottom layer 712 of the body support 702 comprises two or more regions of reticulated non-visco-elastic foam, each at least partially surrounded by one or more borders of relatively highly resilient and flexible cellular polyurethane foam. The reticulated non-visco-elastic foam can have the properties described above with reference to the bottom layer 112 of the body support 102 illustrated in FIG. 1, while the relatively highly resilient flexible cellular foam of the border(s) can have the same properties as described above with reference to the bottom layer 214 of the body support 202 illustrated in FIG. 2. In some embodiments, the bottom layer 712 can have two or more regions defining "islands" of reticulated non-visco-elastic foam surrounded by one or more borders of relatively highly resilient flexible cellular foam. In these and other embodiments, one or more of the regions of reticulated non-visco-elastic foam can be open to one or more sides or ends 738, 740, 742, 744 of the bottom layer 712 and/or can be connected to another of the regions of reticulated non-visco-elastic foam.

In those embodiments in which the body support 702 has a bottom layer 712 comprising one or more regions of reticulated non-visco-elastic foam, the regions can be in any location or locations across the bottom layer 712. For example, the regions of reticulated non-visco-elastic foam can be located in areas of greatest contact and/or pressure from a user lying upon the body support 702, such as near the shoulders, back, and buttocks of a user. Also, such regions of reticulated non-visco-elastic foam can have any shape (such as rectangular, trapezoidal, triangular, or other polygonal shapes, round, oval, or other rotund shapes, irregular shapes, and the like), and can have any size desired.

Figure 8:
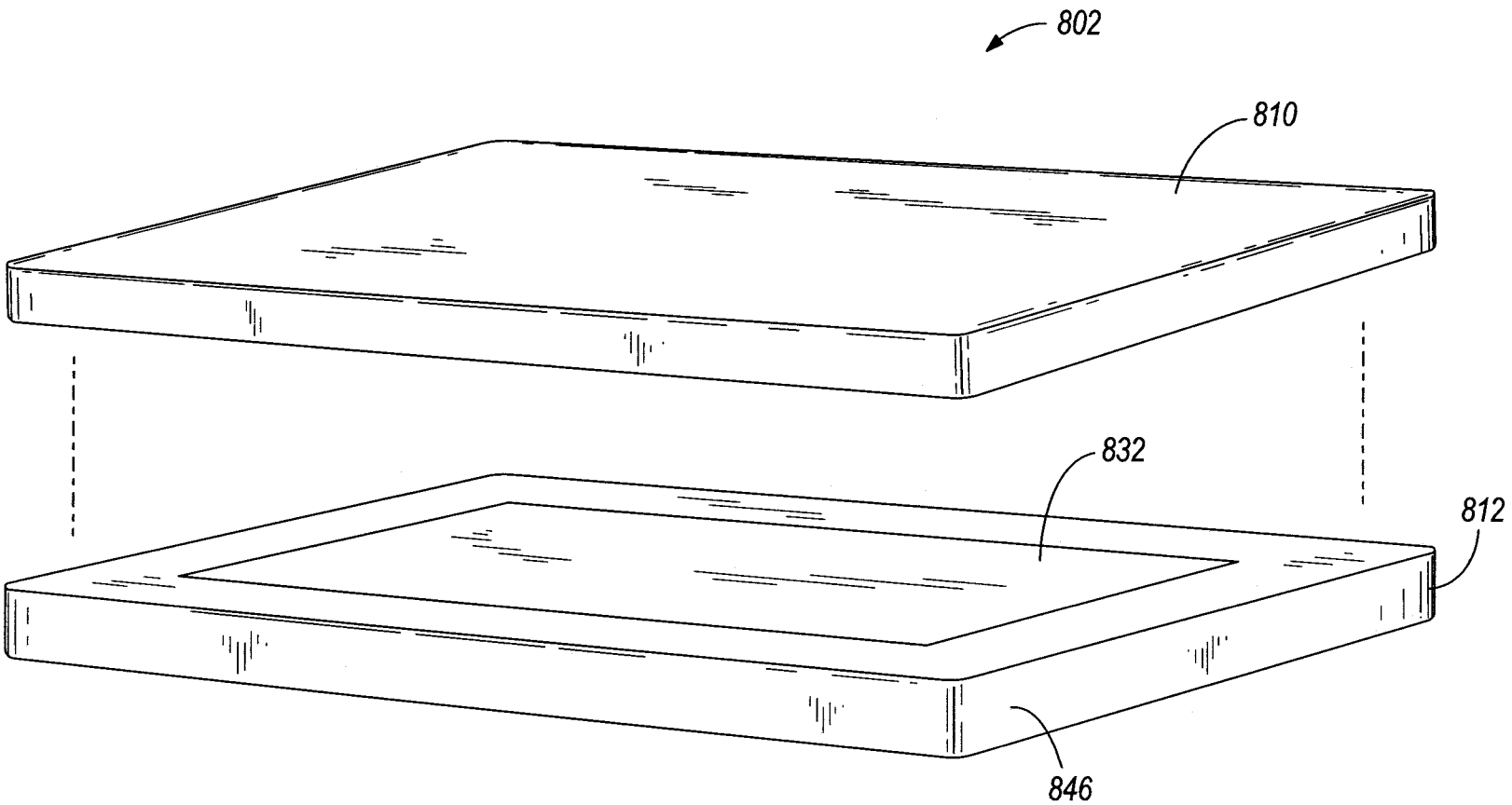

FIG. 8 illustrates another embodiment of a body support according to the present invention. This embodiment employs much of the same structure and has many of the same properties as the embodiments of the body support described above in connection with FIG. 7. Accordingly, the following description focuses primarily upon the structure and features that are different than the embodiments described above in connection with FIG. 7. Reference should be made to the description above in connection with FIG. 7 for additional information regarding the structure and features, and possible alternatives to the structure and features of the body support illustrated in FIG. 8 and described below. Structure and features of the embodiment shown in FIG. 8 that correspond to structure and features of the embodiment of FIG. 7 are designated hereinafter in the 800 series of reference numbers.

Like the embodiment of the present invention illustrated in FIG. 7, the body support 802 illustrated in FIG. 8 comprises a top layer 810 comprising open or closed celled non-reticulated visco-elastic foam, beneath which lies a bottom layer 812 comprising reticulated non-visco-elastic foam and relatively highly resilient and flexible cellular polyurethane foam. However, the first portion 832 of the bottom layer 812 comprises flexible cellular polyurethane foam having the same properties described above with reference to the bottom layer 214 of the body support 202 illustrated in FIG. 2, and the border 846 of the bottom layer 812 comprises reticulated non-visco-elastic foam having the same properties described above with reference to the bottom layer 112 of the body support 102 illustrated in FIG. 1. The border 846 can extend fully around the first portion 832 of relatively highly resilient flexible cellular foam as shown in FIG. 8, or can extend partially around the first portion 832 of relatively highly resilient flexible cellular foam (e.g., having portions flanking the first portion 832 as described above with reference to the embodiment of FIG. 7, or having one or more portions shaped and located in any of the manners described above in connection with the illustrated embodiment of FIG. 7).

In short, the first portion 832 and border 846 illustrated in FIG. 8 can have any of the shapes, positions, and arrangements described above in connection with the embodiment of FIG. 7. Also, the materials of the bottom layer region(s) and border(s) described above in connection with FIG. 7 (i.e., two or more regions or islands of material at least partially surrounded by one or more borders) can be reversed, in which case the two or more regions or islands of the relatively highly-resilient flexible cellular foam can be at least partially surrounded by one or more borders of reticulated non-visco-elastic foam.

By utilizing a border 846 of reticulated non-visco-elastic foam partially or fully surrounding the first portion 832 comprising relatively highly-resilient flexible cellular foam in the bottom layer 812, the body support 802 can have an enhanced ability to provide ventilation of the body support 802 and/or to dissipate heat from the first portion 832 and/or from the top layer 810. The peripheral location of the border 846 illustrated in FIG. 8 is desirable for performing this function, enabling heat to be drawn from a central area of the top and bottom layers 810, 812 toward the edges of the body support 802, where heat can be more readily dissipated from the body support 802.

Figure 9:
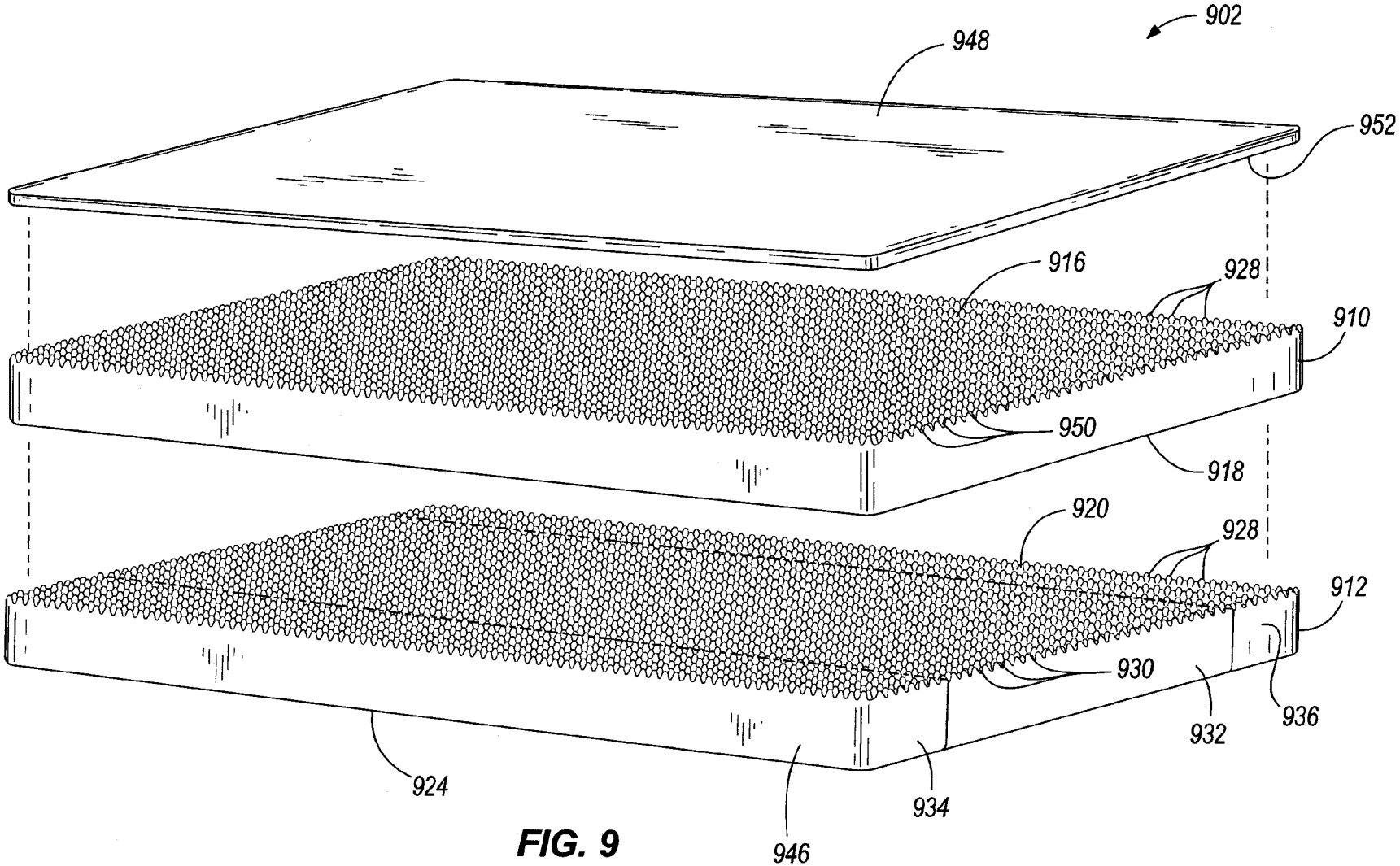

FIG. 9 illustrates another embodiment of a body support according to the present invention. This embodiment employs much of the same structure and has many of the same properties as the embodiments of the body support described above in connection with FIG. 7. Accordingly, the following description focuses primarily upon the structure and features that are different than the embodiments described above in connection with FIG. 7. Reference should be made to the description above in connection with FIG. 7 for additional information regarding the structure and features, and possible alternatives to the structure and features of the body support illustrated in FIG. 9 and described below. Structure and features of the embodiment shown in FIG. 9 that correspond to structure and features of the embodiment of FIG. 7 are designated hereinafter in the 900 series of reference numbers.

Like the body support 702 illustrated in FIG. 7, the body support 902 illustrated in FIG. 9 comprises a top layer 910 comprising open or closed celled non-reticulated visco-elastic foam, beneath which lies a bottom layer 912 comprising a first portion 932 comprising reticulated non-visco-elastic foam flanked by second and third portions 934, 936 comprising relatively highly resilient flexible cellular foam. The first portion 932 can comprise reticulated non-visco-elastic foam having the same properties described above with reference to the bottom layer 112 of the body support 102 illustrated in FIG. 1. The second and third portions 934, 936 can comprise relatively highly resilient flexible cellular foam having the same properties described above with reference to the bottom layer 214 of the body support 202 illustrated in FIG. 2. Also, the portions 932, 934, 936 can have any of the shapes and arrangements described above with reference to FIG. 7, such as a border 946 of the relatively highly resilient flexible cellular foam partially or entirely surrounding the reticulated non-visco-elastic foam portion 932, borders of the relatively highly resilient flexible cellular foam on any of the sides and ends of the bottom layer 912, islands or other regions of the reticulated non-visco-elastic foam at least partially surrounded by the relatively highly resilient flexible cellular foam, and the like.

If desired, the bottom surface 918 of the top layer 910 and/or the top surface 920 of the bottom layer 912 can have a non-planar shape defining a plurality of passages 930 between the top and bottom layers 910, 912. In the illustrated embodiment of FIG. 9, for example, passages 930 are defined between a substantially planar bottom surface 918 of the top layer 910 and a non-planar top surface 920 of the bottom layer 912. The non-planar shape of the top surface 920 of the bottom layer 912 can take any of the forms described above in connection with the non-planar top surface 420 of the bottom layer 412 illustrated in FIG. 4, and can be defined by a plurality of protrusions 928 and/or a plurality of apertures as also described above.

The passages 930 between the bottom surface 918 of the top layer 910 and the top surface 920 of the bottom layer 912 can provide enhanced ventilation and/or heat dissipation of the body support 902. The passages 930 can be particularly useful in reducing heat in regions of the body support 902. The passages 930 can supplement the ability of the reticulated non-visco-elastic foam of the first portion 932 to dissipate heat between the second and third portions 934, 936 of relatively highly resilient flexible cellular foam and the top layer 910 of non-reticulated visco-elastic foam.

Although the first portion 932 of the bottom layer 912 illustrated in FIG. 9 comprises reticulated non-visco-elastic foam, and the second and third portions 934, 936 of the bottom layer 912 comprise a relatively highly resilient flexible cellular foam, the material of the first portion 932 and the material of the second and third portions 934, 936 can be reversed in other embodiments, thereby providing a structure similar to those described above in connection with the embodiment illustrated in FIG. 8. Accordingly, the description above regarding the body support 802 illustrated in FIG. 8 applies equally to such alternative embodiments of FIG. 9.

With continued reference to the illustrated embodiment of FIG. 9, the first and second layers 910, 912 of the body support 902 can have a cover 948 comprising reticulated non-visco-elastic foam. The reticulated non-visco-elastic foam of the cover 948 can have the same properties as described above with reference to the bottom layer 112 of the body support 102 illustrated in FIG. 1. Also, the reticulated non-visco-elastic foam of the cover 948 can cover any portion of the first and second layers 910, 912. For example, the cover 948 illustrated in FIG. 9 covers substantially the entire top surface 916 of the top layer 910. In other embodiments, the cover 948 can also or instead cover any portion or all of the sides and ends of the first and second layers 910, 912, and/or can underlie any portion or all of the bottom surface 924 of the bottom layer 912. In some embodiments, the cover 948 substantially entirely surrounds the first and second layers 910, 912.

The reticulated non-visco-elastic foam cover 948 can be selected to provide a heightened degree of fire resistance to the body support 902, and in some countries and/or localities can be utilized to meet fire codes calling for such fire resistance. Although other materials capable of meeting such fire code requirements can be employed, the use of reticulated non-visco-elastic foam can provide improved ventilation for the surface(s) of the first and/or second layers 910, 912 covered by the reticulated non-visco-elastic foam cover 948. As described above, reticulated non-visco-elastic foam can reduce the amount of heat in adjacent areas of a body support, based at least in part upon the skeletal cellular structure of the reticulated foam. Therefore, in some embodiments, the reticulated non-visco-elastic foam cover 948 can provide a degree of fire resistance while also dissipating heat from the adjacent first and/or second layers 910, 912 covered by the reticulated foam cover 948 in use of the body support 902.

With continued reference to the embodiment of FIG. 9, the visco-elastic nature of the top layer 910 can provide a relatively comfortable substrate for a user's body, can at least partially conform to the user's body to distribute force applied thereby, and can be selected for responsiveness to a range of temperatures generated by the body heat of a user. In some embodiments, the reticulated foam cover 948 (if employed) has a maximum thickness through which these properties can still be exhibited. Although the desirable tactile feel of the visco-elastic first layer 910 can be blocked in some embodiments by the reticulated non-visco-elastic foam cover 948, the other desirable properties of the visco-elastic material of the first layer 910 are still experienced through a sufficiently thin reticulated non-visco-elastic foam cover 948. In some embodiments, the reticulated non-visco-elastic foam cover 948 has a maximum thickness of about 1 cm. In other embodiments, the reticulated non-visco-elastic foam cover 948 has a maximum thickness of about 2 cm. In still other embodiments, the reticulated non-visco-elastic foam cover 948 has a maximum thickness of about 5 cm.

As also shown in FIG. 9, the top surface 916 of the top layer 910 can have a non-planar shape defining a plurality of passages 930 between the reticulated non-visco-elastic foam cover 948 and the top layer 910. In other embodiments, the passages 930 can be defined between a non-planar bottom surface 952 of the reticulated non-visco-elastic foam cover 948 and a substantially planar top surface 916 of the top layer 910 and/or between a non-planar bottom surface 952 of the reticulated non-visco-elastic foam cover 948 and a non-planar top surface 916 of the top layer 910. Enhanced user comfort, ventilation, and/or heat dissipation can be achieved in some embodiments by such passages 930.

The non-planar shape of the top surface 916 illustrated in FIG. 9 (and/or of the bottom surface 952 of the reticulated non-visco-elastic foam cover 948) can take any of the forms described above in connection with the non-planar top surface 420 of the bottom layer 412 illustrated in FIG. 4, and can be defined by a plurality of protrusions 928 and/or a plurality of apertures as also described above.

The passages 930 between the bottom surface 952 of the reticulated non-visco-elastic foam cover 948 and the top surface 916 of the top layer 910 can provide a degree of ventilation and/or enhanced heat dissipation for the body support 902. These passages 930 can be particularly useful in reducing heat in regions of the body support 902. These passages 930 can also supplement the ability of the reticulated non-visco-elastic foam of the cover 948 to dissipate heat between the cover 948 and the top layer 910.

The reticulated non-visco-elastic foam cover 948 illustrated in FIG. 9 is utilized in conjunction with a top layer 910 comprising non-reticulated visco-elastic foam, and a bottom layer 912 comprising a first portion 932 of reticulated non-visco-elastic foam flanked by second and third portions 934, 936 of relatively highly resilient flexible cellular foam as described above. However, it should be noted that the reticulated non-visco-elastic foam cover 948 (and the alternative embodiments of the reticulated non-visco-elastic foam cover 948 described above) can be utilized to cover any or all surfaces of any of the body supports described and/or illustrated herein.

Figure 10:
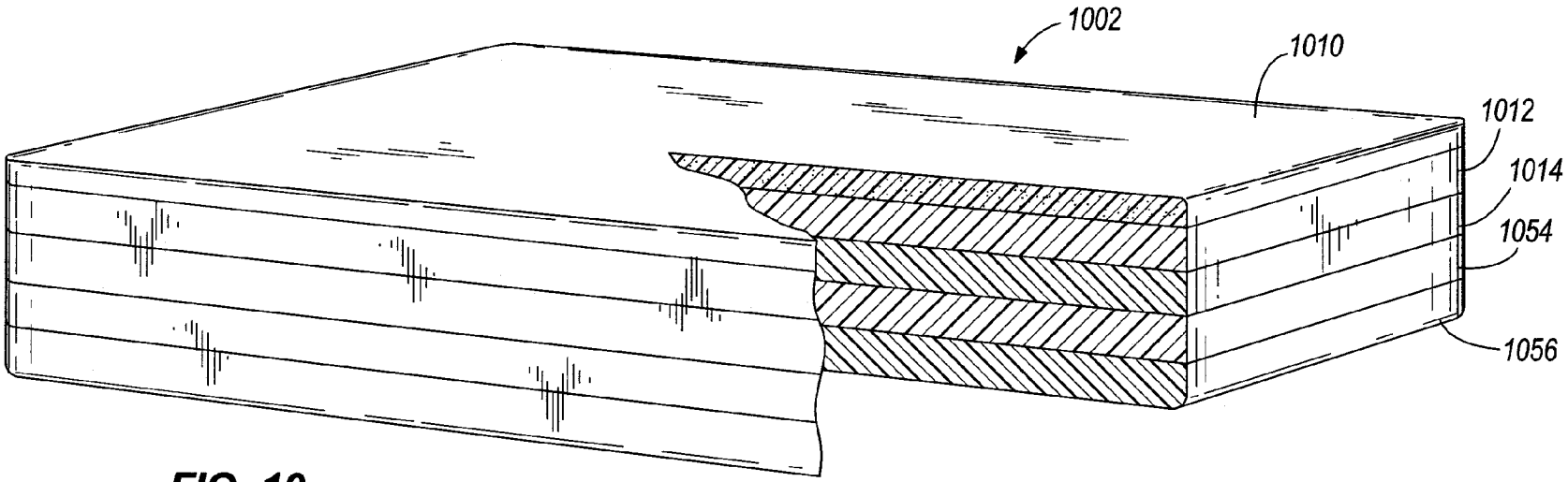
FIGS. 10-12 are sectioned perspective views of body supports according to additional embodiments of the present invention.

FIG. 10 illustrates another embodiment of a body support according to the present invention. This embodiment employs much of the same structure and has many of the same properties as the embodiments of the body support described above in connection with FIG. 3. Accordingly, the following description focuses primarily upon the structure and features that are different than the embodiments described above in connection with FIG. 3. Reference should be made to the description above in connection with FIG. 3 for additional information regarding the structure and features, and possible alternatives to the structure and features of the body support illustrated in FIG. 10 and described below. Structure and features of the embodiment shown in FIG. 10 that correspond to structure and features of the embodiment of FIG. 3 are designated hereinafter in the 1000 series of reference numbers.

Like the body support 302 illustrated in FIG. 3, the body support 1002 illustrated in FIG. 10 comprises a first layer 1010 comprising open or closed celled non-reticulated visco-elastic foam, a second layer 1012 comprising a relatively highly resilient flexible cellular foam beneath the first layer 1010, and a third layer 1014 comprising reticulated non-visco-elastic foam beneath the second layer 1012 of relatively highly resilient flexible cellular foam. The properties of the non-reticulated visco-elastic foam in the first layer 1010 and the reticulated non-visco-elastic foam in the third layer 1014 are described above in connection with the top and bottom layers 110, 112, respectively, in the illustrated embodiment of FIGS. 1-1B. The properties of the relatively highly resilient flexible cellular foam in the second layer 1012 are described above in connection with the bottom layer 214 in the illustrated embodiment of FIGS. 2 and 2A.

In the embodiment illustrated in FIG. 10, the non-reticulated visco-elastic foam of the first layer 1010 can be provided with a desired degree of support by the adjacent underlying layer 1012 of relatively highly resilient flexible cellular foam. As described above, the skeletal cellular structure of the reticulated non-visco-elastic foam of the third layer 1014 can function to reduce heat in the second layer 1012 (and in some embodiments, the first layer 1010 as well).

In some embodiments, the reticulated non-visco-elastic foam of the third layer 1014 is less resilient and/or less supportive than the foams that can be employed for the second layer 1012 (e.g., the relatively highly resilient flexible cellular foam described above in connection with the illustrated embodiment of FIGS. 2 and 2A). Although the second layer 1012 can be increased in thickness to accommodate for the less resilient and/or less supportive reticulated non-visco-elastic foam layer 1014, the ability to dissipate heat (via the resulting relatively thinner reticulated foam material) can be reduced. In some embodiments, a fourth layer 1054 of relatively highly resilient flexible cellular foam is located beneath the third layer 1014 of reticulated non-visco-elastic foam, thereby providing additional support to the first, second, and third layers 1010, 1012, 1014, and supplementing the resilience and support provided by the second layer 1012. In the illustrated embodiment of FIG. 10, the fourth layer 1054 comprises substantially the same relatively highly resilient flexible cellular foam as the second layer 1012. However, in other embodiments, the relatively highly resilient flexible cellular foam of the fourth layer 1054 is different than that of the second layer 1012.

If desired, a fifth layer 1056 of reticulated non-visco-elastic foam can lie beneath the fourth layer 1054, thereby providing an increased capability to dissipate heat from the body support 1002. In the illustrated embodiment of FIG. 10, the fifth layer 1056 comprises substantially the same reticulated non-visco-elastic foam as the third layer 1014. However, in other embodiments, the reticulated non-visco-elastic foam of the fifth layer 1056 is different than that of the third layer 1014. In this regard, any number of alternating layers of relatively highly resilient flexible cellular foam and reticulated non-visco-elastic foam can lie beneath the first layer 1010 of non-reticulated visco-elastic foam. Such body supports 1002 can therefore have a desirable degree of resilience and support (from two or more layers of relatively highly resilient flexible cellular foam) while still retaining the desirable heat dissipative capabilities described above (from two or more layers of reticulated non-visco-elastic foam). In some embodiments, heat in one or more areas of the body support 1002 can be transmitted through one or more layers of the relatively highly resilient flexible cellular foam for dissipation through the alternating layers of reticulated non-visco-elastic foam.

Figure 11:
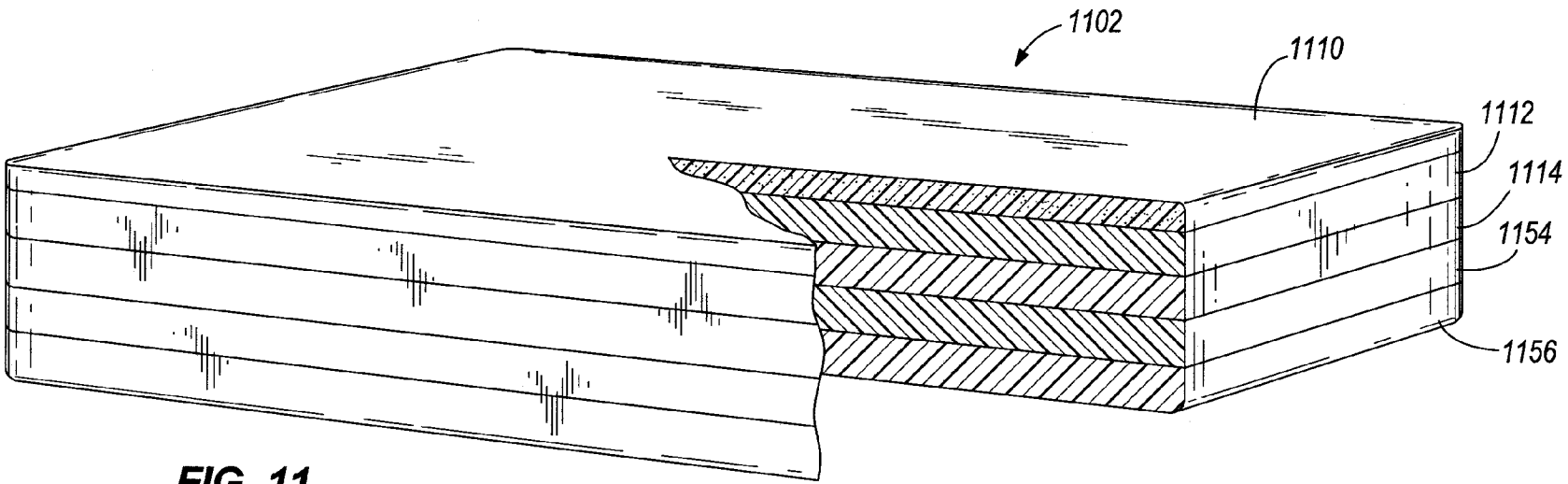

FIG. 11 illustrates another embodiment of a body support according to the present invention. This embodiment employs much of the same structure and has many of the same properties as the embodiments of the body support described above in connection with FIGS. 2 and 2A. Accordingly, the following description focuses primarily upon the structure and features that are different than the embodiments described above in connection with FIGS. 2 and 2A. Reference should be made to the description above in connection with FIGS. 2 and 2A for additional information regarding the structure and features, and possible alternatives to the structure and features of the body support illustrated in FIG. 11 and described below. Structure and features of the embodiment shown in FIG. 11 that correspond to structure and features of the embodiment of FIGS. 2 and 2A are designated hereinafter in the 1100 series of reference numbers.

Like the body support 202 illustrated in FIGS. 2 and 2A, the body support 1102 illustrated in FIG. 11 comprises a first layer 1110 comprising open or closed celled non-reticulated visco-elastic foam, a second layer 1112 comprising reticulated non-visco-elastic foam beneath the first layer 1110, and a third layer 1114 comprising relatively highly resilient flexible cellular foam beneath the second layer 1112. The properties of the non-reticulated visco-elastic foam in the first layer 1010 and the reticulated non-visco-elastic foam in the second layer 1012 are described above in connection with the top and bottom layers 110, 112, respectively, in the illustrated embodiment of FIGS. 1-1B. The properties of the relatively highly resilient flexible cellular foam in the third layer 1014 are described above in connection with the bottom layer 214 in the illustrated embodiment of FIGS. 2 and 2A.

In the embodiment illustrated in FIG. 11, the skeletal cellular structure of the reticulated foam of the second layer 1112 can function to dissipate heat in the first layer 1110 of non-reticulated visco-elastic foam, while the first and second layers 1110, 1112 can be provided with a desirable degree of support by the underlying layer 1114 of relatively highly resilient flexible cellular foam. Compared to the second layer 1012 of body support 1002 illustrated in FIG. 10, the second layer 1112 of reticulated foam in the body support 1102 of FIG. 11 can provide an increased amount of heat dissipation and/or ventilation, but with a less resilient upper portion of the body support 1102 (in some embodiments, and depending at least in part upon the thickness of the first and second layers 1110, 1112). Therefore, the first three layers 1010, 1012, 1014, 1110, 1112, 1114 of the body supports 1002, 1102 illustrated in FIGS. 10 and 11 can have different qualities adapted for the comfort and taste of different users.

With continued reference to the illustrated embodiment of FIG. 11, in some embodiments, the reticulated non-visco-elastic foam of the second layer 1112 is less resilient and/or less supportive than the foams that can be employed for the third layer 1114 (e.g., the relatively highly resilient flexible cellular foam described above in connection with the illustrated embodiment of FIGS. 2 and 2A). Although the third layer 1114 can be increased in thickness to accommodate for the less resilient and/or less supportive reticulated non-visco-elastic foam layer 1112, the advantages relating to heat dissipation from the relatively thinner reticulated foam material can be reduced. In some embodiments, a fourth layer 1154 of reticulated non-visco-elastic foam is located beneath the third layer 1114 of relatively highly resilient flexible cellular foam, thereby providing an increased capability to dissipate heat from the body support 1102. In the illustrated embodiment of FIG. 11, the fourth layer 1154 comprises substantially the same reticulated non-visco-elastic foam as the second layer 1112. However, in other embodiments, the reticulated non-visco-elastic foam of the fourth layer 1154 is different than that of the second layer 1112.

In some embodiments, a fifth layer 1156 of relatively highly resilient flexible cellular foam is located beneath the fourth layer 1154 of reticulated non-visco-elastic foam, thereby providing additional support to the first, second, third, and fourth layers 1110, 1112, 1114, and 1154, and supplementing the resilience and support provided by the third layer 1014. In the illustrated embodiment of FIG. 11, the fifth layer 1154 comprises substantially the same relatively highly resilient flexible cellular foam as the third layer 1114. However, in other embodiments, the relatively highly resilient flexible cellular foam of the fifth layer 1154 is different than that of the third layer 1112. As described above, any number of alternating layers of relatively highly resilient flexible cellular foam and reticulated non-visco-elastic foam can lie beneath the first layer 1010 of non-reticulated visco-elastic foam to provide a desired degree of resilience and support while still retaining the ventilation and/or heat dissipative capabilities also described above. In some embodiments, heat in one or more areas of the body support 1102 can be transmitted through one or more layers of the relatively highly resilient flexible cellular foam for dissipation through the alternating layers of reticulated non-visco-elastic foam.

Figure 12:
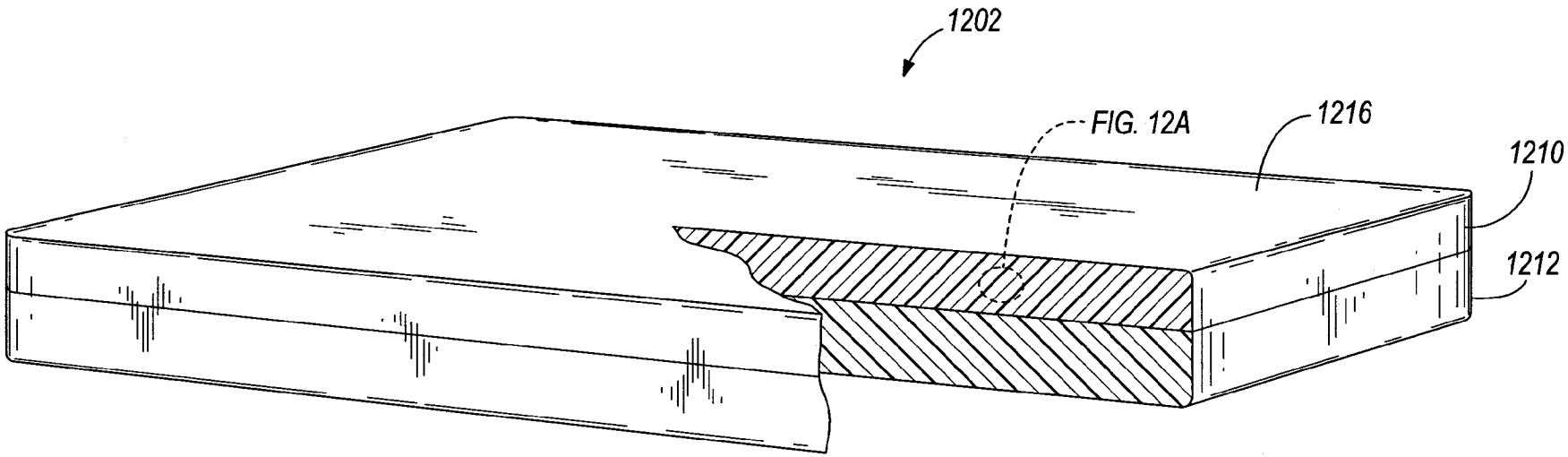
Figure 12A:
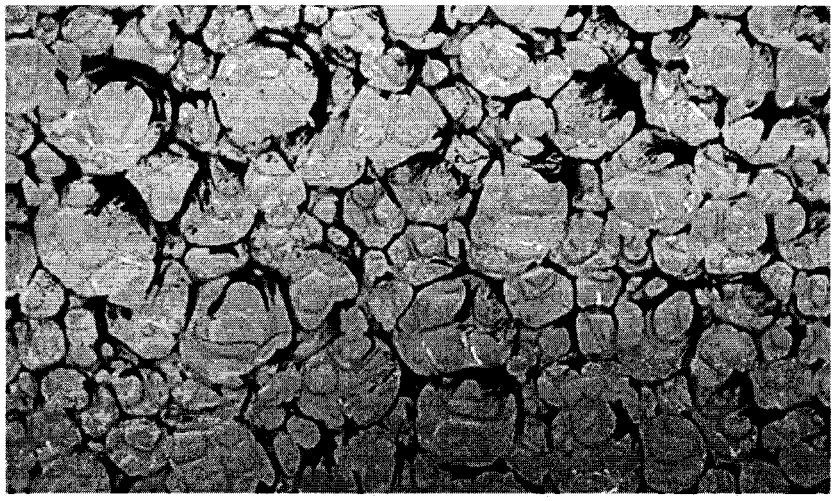
FIG. 12A is a detail view of the material in a layer of the body support illustrated in FIG. 12.

FIGS. 12 and 12A illustrate another embodiment of a body support according to the present invention. The body support 1202 illustrated in FIGS. 12 and 12A comprises two layers of material: a top layer 1210 comprising reticulated visco-elastic foam and a bottom layer 1212 comprising a cellular structure of polyurethane foam.

Like the foam of the top layer 110 described above with reference to the embodiment of the body support 102 illustrated in FIGS. 1, 1A, and 1B (and utilized in the other embodiments illustrated and/or described above in connection with FIGS. 1-11), the reticulated foam of the top layer 1210 is a visco-elastic foam, and therefore falls generally within the category of foams otherwise known as "memory foams" or "low resilience foams". However, the reticulated visco-elastic foam of the top layer 1210 has a structure that is significantly different than that of non-reticulated visco-elastic foams (such as those described above in connection with the embodiments of FIGS. 1-11), and can therefore provide body supports with significantly different properties as will now be described.

As shown in FIG. 12A, the reticulated visco-elastic foam of the top layer 1210 is a cellular foam structure in which the cells of the visco-elastic foam are essentially skeletal. Many (if not substantially all) of the cell walls separating one cell from another do not exist. In other words, the cells of the reticulated visco-elastic foam are defined only by a plurality of supports or "windows" and by no cell walls, substantially no cell walls, or by a substantially reduced number of cell walls. In some embodiments, the visco-elastic foam is considered "reticulated" if at least 50% of the walls defining the cells of the visco-elastic foam do not exist (i.e., have been removed or were never allowed to form during the manufacturing process of the visco-elastic foam).

By virtue of the skeletal cellular structure of the reticulated visco-elastic foam of the top layer 1210 illustrated in FIGS. 12 and 12A, heat in the top layer 1210 can be transferred away from the source of heat (e.g., a user's body), thereby helping to prevent one or more areas of the top layer 1210 from reaching an undesirably high temperature. Also, the reticulated structure of the foam in the top layer 1210 enables significantly higher airflow into, out of, and through the top layer 1210—a characteristic of the top layer 1210 that can reduce heat in the top layer 1210. At the same time, the visco-elastic nature of the foam in the top layer 1210 provides desirable tactile contact and pressure responsiveness for user comfort. In this regard, the reticulated visco-elastic foam of some embodiments has a reduced hardness level, thereby providing a relatively soft and comfortable surface for a user's body. In conjunction with the slow recovery characteristic of the reticulated visco-elastic material, the top layer 1210 can also at least partially conform to the user's body, thereby distributing the force applied by the user's body upon the top layer 1210.

In some embodiments, the top layer 1210 of reticulated visco-elastic foam has a hardness of at least about 20 N and no greater than about 150 N for desirable softness and pressure-responsive qualities. In other embodiments, a top layer 1210 having a hardness of at least about 30 N and no greater than about 100 N is utilized for this purpose. In still other embodiments, a top layer 1210 having a hardness of at least about 40 N and no greater than about 85 N is utilized.

The top layer 1210 can also have a density providing a relatively high degree of material durability. The density of the foam in the top layer 1210 can also impact other characteristics of the foam, such as the manner in which the top layer 1210 responds to pressure, and the feel of the foam. In some embodiments, the top layer 1210 has a density of no less than about 30 kg/m$^3$ and no greater than about 175 kg/m$^3$. In other embodiments, a top layer 1210 having a density of at least about 50 kg/m$^3$ and no greater than about 130 kg/m$^3$ is utilized. In still other embodiments, a top layer 1210 having a density of at least about 60 kg/m$^3$ and no greater than about 110 kg/m$^3$ is utilized.

The reticulated visco-elastic foam of the top layer 1210 can be selected for responsiveness to any range of temperatures. However, in some embodiments, a temperature responsiveness in a range of a user's body temperatures (or in a range of temperatures to which the body support 1202 is exposed by contact or proximity to a user's body resting thereon) can provide significant advantages. For example, a reticulated visco-elastic foam selected for the top layer 1210 can be responsive to temperatures changes (as defined above) above at least 0° C. In some embodiments, the reticulated visco-elastic foam selected for the top layer 1210 can be responsive to temperature changes within a range of at least about 10° C. In other embodiments, the reticulated visco-elastic foam selected for the top layer 1210 can be responsive to temperature changes within a range of at least about 15° C.

As described above, the bottom layer 1212 of the body support 1202 illustrated in FIGS. 12 and 12A comprises a cellular structure of polyurethane foam. This layer of foam is a supportive layer providing a relatively stiff but flexible and resilient substrate upon which the top layer 1210 lies. The resiliently deformable nature of the bottom layer 1212 can therefore provide a degree of user comfort to the extent that the user's weight affects the shape of the bottom layer 1212. The foam of the bottom layer 1212 can be relatively highly resilient, and in some embodiments has a hardness of at least about 50 N and no greater than about 300 N for a desirable degree of support and comfort. In other embodiments, a bottom layer 1212 having a hardness of at least about 80 N and no greater than about 250 N is utilized for this purpose. In still other embodiments, a bottom layer 1212 having a hardness of at least about 90 N and no greater than about 180 N is utilized.

Depending at least in part upon the thickness and material properties of the top layer 1210, in some embodiments the bottom layer 1212 can be exposed to substantial body heat from a user resting upon the body support 1202. In such embodiments, the foam of the bottom layer 1212 can be selected to be substantially insensitive to temperature changes (as defined above) within a range of between about 10° C. to about 35° C., thereby retaining the supportive properties desired for the bottom layer 1212 throughout a range of body temperatures to which the bottom layer 1212 may be exposed. In some embodiments, the bottom layer 1212 can comprise foam that is substantially insensitive to temperature changes within a range of between about 15° C. to about 30° C. In still other embodiments, a bottom layer 1212 of foam that is substantially insensitive to temperature changes within a range of between about 15° C. to about 25° C. can be used.

The reticulated visco-elastic foam layer 1210 atop the bottom layer 1212 can provide an additional degree of ventilation and/or heat dissipation on the top surface 1216 of the top layer 1210, can help dissipate heat within the body support 1202, and can therefore help to reduce heat in one or more locations of the body support 1202.

Like the top layer 1210 of the body support 1202, the bottom layer 1212 can have a density providing a relatively high degree of material durability. Also, the density of the foam in the bottom layer 1212 can also impact other characteristics of the foam, such as the manner in which the bottom layer 1212 responds to pressure, and the feel of the foam. In some embodiments, the bottom layer 1212 has a density of no less than about 20 kg/m$^3$ and no greater than about 80 kg/m$^3$. In other embodiments, a bottom layer 1212 having a density of at least about 25 kg/m$^3$ and no greater than about 60 kg/m$^3$ is utilized. In still other embodiments, a bottom layer 1212 having a density of at least about 30 kg/m$^3$ and no greater than about 40 kg/m$^3$ is utilized.

The body support 1202 illustrated in FIGS. 12 and 12A can have a bottom layer 1212 that is at least as thick as the top layer 1210, thereby providing a significant degree of support for the top layer 1210. In some embodiments, the bottom layer 1212 is at least 2 times as thick as the top layer 1210. In other embodiments, the bottom layer 1212 is at least 3 times as thick as the top layer 1210.

The body support 1202 illustrated in FIGS. 12 and 12A is a mattress, mattress topper, overlay, or futon, and is illustrated in such form by way of example only. It will be appreciated that the features of the body support 1202 described above are applicable to any other type of body support having any size and shape.

Figure 13:
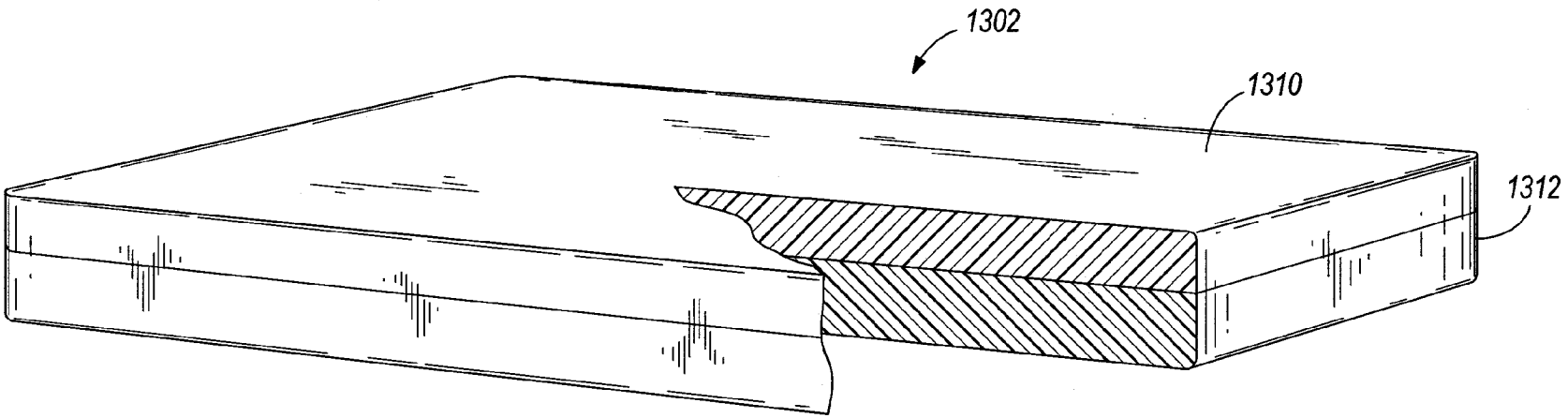
FIGS. 13-30 are sectioned perspective views of body supports according to additional embodiments of the present invention.

FIG. 13 illustrates another embodiment of a body support according to the present invention. This embodiment employs much of the same structure and has many of the same properties as the embodiments of the body support described above in connection with FIGS. 12 and 12A. Accordingly, the following description focuses primarily upon the structure and features that are different than the embodiments described above in connection with FIGS. 12 and 12A. Reference should be made to the description above in connection with FIGS. 12 and 12A for additional information regarding the structure and features, and possible alternatives to the structure and features of the body support illustrated in FIG. 13 and described below. Structure and features of the embodiment shown in FIG. 13 that correspond to structure and features of the embodiment of FIGS. 12 and 12A are designated hereinafter in the 1300 series of reference numbers.

The body support 1302 illustrated in FIG. 13 has a top layer 1310 comprising reticulated visco-elastic foam and a bottom layer 1312 comprising reticulated non-visco-elastic foam. The reticulated visco-elastic foam (including the material properties thereof) of the top layer 1310 is described in greater detail above in connection with the embodiments of FIGS. 12 and 12A. The reticulated non-visco-elastic foam of the bottom layer 1312 comprises an essentially skeletal structure of cells in which many (if not substantially all) of the cell walls separating one cell from another do not exist. In other words, the cells are defined by a plurality of supports or "windows" and by no cell walls, substantially no cell walls, or by a substantially reduced number of cell walls. In some embodiments, the foam is considered "reticulated" if at least 50% of the walls defining the cells of the foam do not exist (i.e., have been removed or were never allowed to form during the manufacturing process of the foam). Due at least in part to the skeletal cellular structure of the reticulated non-visco-elastic foam in the bottom layer 1312, the bottom layer 1312 can reduce heat in one or more areas of the top layer 1310.

In some embodiments, it is desirable that the bottom layer 1312 of reticulated non-visco-elastic foam be capable of providing some degree of support that is substantially independent of temperatures experienced by the top layer 1310 when supporting a user's body (i.e., independent of a user's body heat). Therefore, the bottom layer 1312 can comprise reticulated non-visco-elastic foam that is substantially insensitive to temperature changes (as defined above) within a range of between about 15° C. and about 30° C. In some embodiments, the bottom layer 1312 can comprise foam that is substantially insensitive to temperature changes within a range of between about 15° C. and about 25° C.

By virtue of the skeletal cellular structure of the bottom layer 1312 illustrated in FIG. 13, heat in the top layer 1310 of reticulated visco-elastic foam can be transferred away from the top layer 1310 toward the bottom layer 1314 (in addition to lateral transfer of heat within the top layer 1310 and transfer of heat from exterior surfaces of the top layer 1310 by virtue of the reticulated visco-elastic foam of the top layer 1310). Such heat transfer can help to prevent the top layer 1310 from reaching an undesirably high temperature. Also, the reticulated nature of the foam in the bottom layer 1312 can enable significantly higher airflow into, out of, and through the bottom layer 1312—a characteristic of the bottom layer 1312 that can supplement the ventilation provided by the reticulated visco-elastic foam of the top layer 1310.

Like the top layer 1310, the bottom layer 1312 can have a density providing a relatively high degree of material durability. Also, the density of the foam in the bottom layer 1312 can also impact other characteristics of the foam, such as the manner in which the bottom layer 1312 responds to pressure, and the feel of the foam. In some embodiments, the bottom layer 1312 has a density of no less than about 20 kg/m$^3$ and no greater than about 80 kg/m$^3$. In other embodiments, a bottom layer 1312 having a density of at least about 25 kg/m$^3$ and no greater than about 60 kg/m$^3$ is utilized. In still other embodiments, a bottom layer 1312 having a density of at least about 30 kg/m$^3$ and no greater than about 40 kg/m$^3$ is utilized.

Also, in some embodiments, the bottom layer 1312 has a hardness of at least about 50 N and no greater than about 300 N. In other embodiments, a bottom layer 1312 having a hardness of at least about 80 N and no greater than about 250 N is utilized. In still other embodiments, a bottom layer 1312 having a hardness of at least about 90 N and no greater than about 180 N is utilized.

The body support 1302 illustrated in FIGS. 1-1B can have a bottom layer 1312 that is at least as thick as the top layer 1310, thereby providing a significant ventilation and/or heat dissipation layer that, in some embodiments, is relatively temperature insensitive. In some embodiments, the bottom layer 1312 is at least half as thick as the top layer 1310. In other embodiments, the bottom layer 1312 is at least as thick as the top layer 1310. In still other embodiments, the bottom layer 1312 is at least twice as thick as the top layer 1310.

As described above with reference to the body support 1202 illustrated in FIGS. 12 and 12A, the reticulated visco-elastic foam of the top layer 1310 can provide an increased amount of ventilation for the top layer 1310, can help to dissipate heat within the top layer 1310, and can provide desirable body-conforming, softness, and pressure responsiveness for user comfort. As also described above, in some embodiments, the reticulated non-visco-elastic foam of the bottom layer 1312 can provide additional ventilation and heat dissipation for the top layer 1310. These features can be particularly beneficial for those areas of the top layer 1310 that have been compressed or otherwise modified in shape by a user's body. With respect to some embodiments of the present invention, the temperature insensitivity of the reticulated non-visco-elastic foam of the bottom layer 1312 can enable the bottom layer 1312 to resist form and shape change resulting from body heat from the top layer 1310, while the reticulated cellular structure of the bottom layer 1312 provides desirable heat dissipation and ventilation properties for the top layer 1310.

Figure 14:
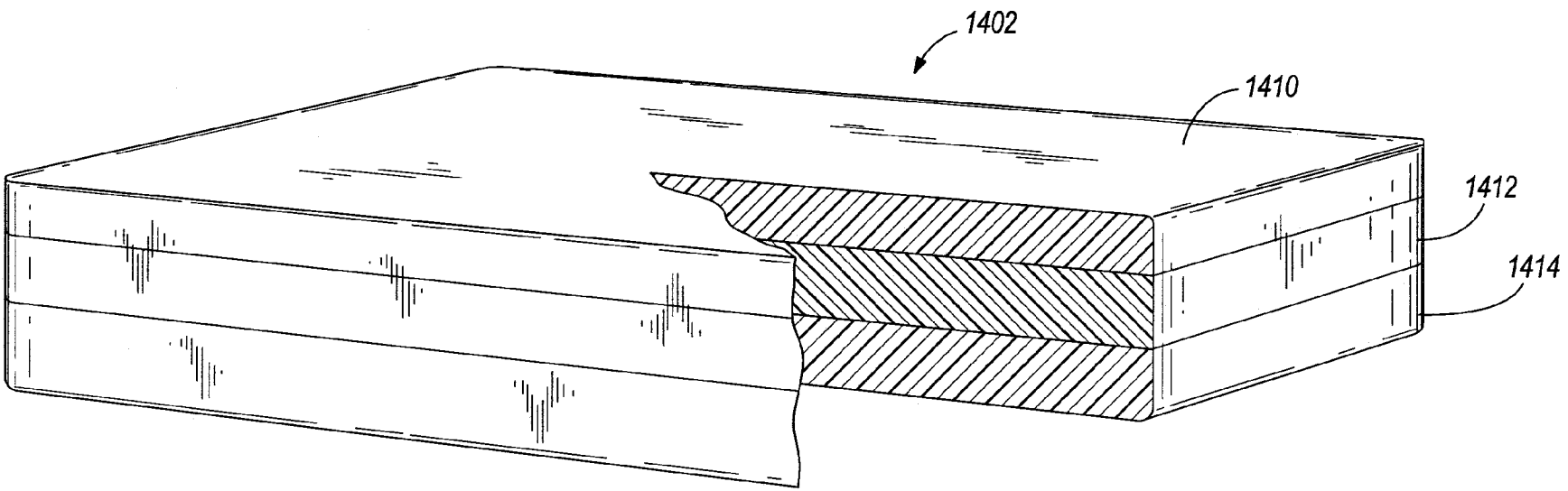

FIG. 14 illustrates another embodiment of a body support according to the present invention. This embodiment employs much of the same structure and has many of the same properties as the embodiments of the body support described above in connection with FIG. 13. Accordingly, the following description focuses primarily upon the structure and features that are different than the embodiments described above in connection with FIG. 13. Reference should be made to the description above in connection with FIG. 13 for additional information regarding the structure and features, and possible alternatives to the structure and features of the body support illustrated in FIG. 14 and described below. Structure and features of the embodiment shown in FIG. 14 that correspond to structure and features of the embodiment of FIG. 13 are designated hereinafter in the 1400 series of reference numbers.

Like the embodiment illustrated in FIG. 13, the body support 1402 illustrated in FIG. 14 has a top layer 1410 comprising reticulated visco-elastic foam and an underlying layer 1412 comprising reticulated non-visco-elastic foam. In some embodiments, the body support 1402 can therefore provide the desirable softness, body-conforming, ventilation, and heat dissipative properties described above. The body support 1402 illustrated in FIG. 14 further comprises a bottom layer 1414 beneath the layer of reticulated non-visco-elastic foam 1412. Therefore, the layer 1412 of reticulated non-visco-elastic foam is a middle layer 1412 located between the top and bottom layers 1410, 1414 of the body support 1402.

The bottom layer 1414 of the body support 1402 illustrated in FIG. 14 comprises a cellular structure of flexible polyurethane foam that is relatively highly resilient and supportive. This relatively highly resilient flexible cellular foam is described in greater detail above in connection with the embodiment of FIGS. 12 and 12A. In some embodiments, the bottom layer 1414 comprising the relatively highly resilient flexible cellular foam is a supportive layer providing a relatively stiff substrate upon which the top and middle layers 1410, 1412 lie, and has a degree of deformability to provide user comfort (to the extent that the user's weight affects the shape of the bottom layer 1414). Therefore, the bottom layer 1414 can comprise a foam having a relatively high resilience capable of providing significant support to the top and middle layers 1410, 1412. The bottom layer 1414 can have a resilience greater than that of the top and middle layers 1410, 1412.

The body support 1402 illustrated in FIG. 14 can have a bottom layer 1414 that is at least as thick as the combination of the top and middle layers 1410, 1412, thereby providing substantial support for the top and middle layers 1410, 1412. In some embodiments, the bottom layer 1414 is at least 0.22 times as thick as the combination of the top and middle layers 1410, 1412. In other embodiments, the bottom layer 1414 is at least 0.40 times as thick as the combination of the top and middle layers 1410, 1412.

Figure 15:
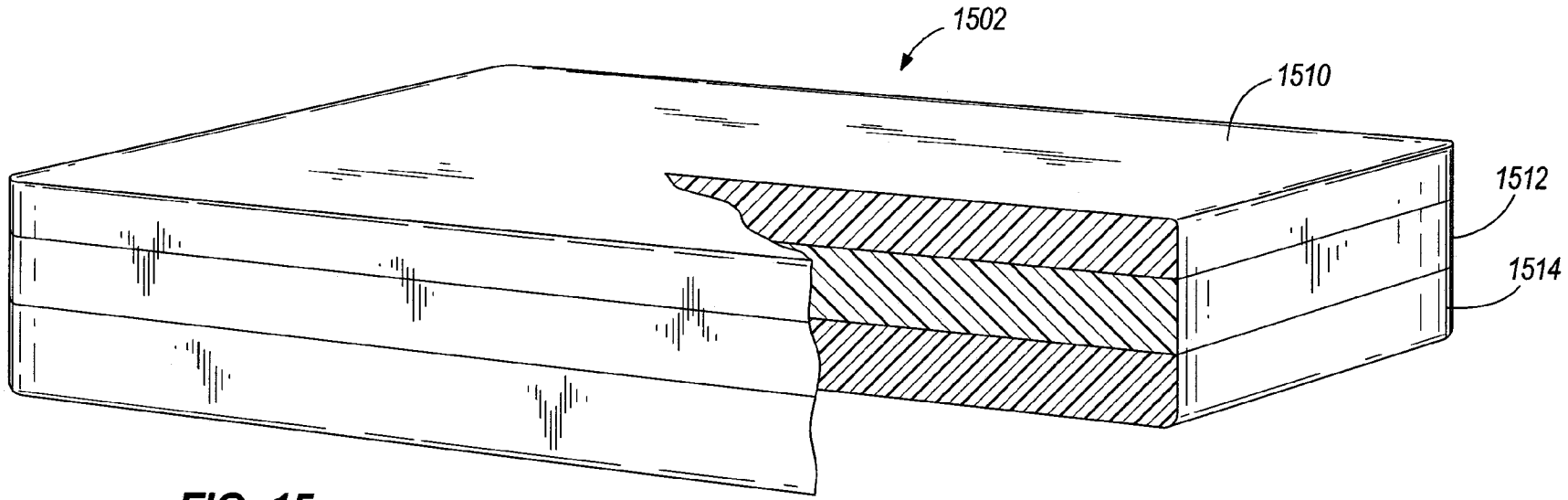

FIG. 15 illustrates another embodiment of a body support according to the present invention. This embodiment employs much of the same structure and has many of the same properties as the embodiments of the body support described above in connection with FIG. 14. Accordingly, the following description focuses primarily upon the structure and features that are different than the embodiments described above in connection with FIG. 14. Reference should be made to the description above in connection with FIG. 14 for additional information regarding the structure and features, and possible alternatives to the structure and features of the body support illustrated in FIG. 15 and described below. Structure and features of the embodiment shown in FIG. 15 that correspond to structure and features of the embodiment of FIG. 14 are designated hereinafter in the 1500 series of reference numbers.

Like the body support 1402 illustrated in FIG. 14, the body support 1502 illustrated in FIG. 15 has a top layer 1510 comprising reticulated visco-elastic foam, beneath which lies middle and bottom layers 1512, 1514 of the body support 1502. However, the materials of the middle and bottom layers 1512, 1514 are switched compared to the body support 1402 illustrated in FIG. 14. Accordingly, the middle layer 1512 of the body support 1502 illustrated in FIG. 15 comprises a relatively highly resilient flexible cellular foam, and the bottom layer 1514 of the body support 1502 comprises reticulated non-visco-elastic foam. The relatively highly resilient flexible cellular foam and the reticulated non-visco-elastic foam of the middle and bottom layers 1512, 1514, respectively, are described in greater detail above in connection with the embodiment illustrated in FIG. 14 (incorporating information in connection with the embodiments illustrated in FIGS. 12-13).

In the embodiment illustrated in FIG. 15, the reticulated visco-elastic foam of the first layer 1510 can be provided with a desired degree of support by the adjacent underlying layer of relatively highly resilient flexible cellular foam, rather than by a layer of such material underlying another intermediate layer as shown in FIG. 14. Also with reference to FIG. 15, the middle layer 1512 can provide enhanced user support, depending at least in part upon the thicknesses of the top and middle layers 1510, 1512. The top layer 1510 of reticulated visco-elastic foam and the bottom layer 1514 of reticulated non-visco-elastic foam can reduce heat in the middle layer 1512, drawing heat from both sides of the middle layer 1512 and/or providing enhanced ventilation of the body support 1502 on both sides of the middle layer 1512 (due at least in part to the reticulated cellular structure of the foam in the top and bottom layers 1510, 1512).

The body support 1502 illustrated in FIG. 15 can have a middle layer 1512 that is at least 0.33 times at least as thick as the top layer 1510 to provide a desirable degree of support for the top layer 1510. In some embodiments, the middle layer 1512 can be at least half as thick as the top layer 1510 for this purpose. In other embodiments, a middle layer 1512 that is at least as thick as the top layer 1510 is used for this purpose.

With further reference to FIG. 15, the body support 1502 can have a bottom layer 1514 that is at least 0.15 times as thick as the combined thickness of the top and middle layers 1510, 1512 to carry heat away from the middle layer 1512. In some embodiments, the bottom layer 1514 can be at least 0.25 times as thick as the combined thickness of the top and middle layers 1510, 1512 for this purpose. In other embodiments, a bottom layer 1514 that is at least 0.36 times as thick as the combined thickness of the top and middle layers 1510, 1512 is used for this purpose.

Figure 16:
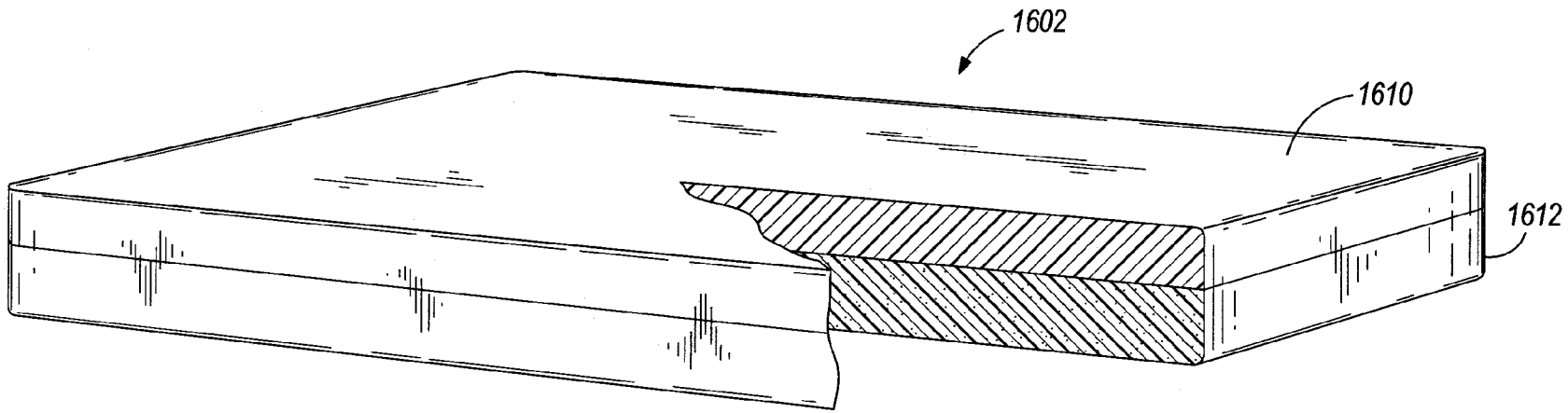

A body support 1602 according to another embodiment of the present invention is illustrated in FIG. 16, and comprises two layers of material: a top layer 1610 comprising reticulated visco-elastic foam, and a bottom layer 1612 comprising open or closed celled non-reticulated visco-elastic foam.

The reticulated visco-elastic foam in the top layer 1610 (including the material properties of the reticulated visco-elastic foam) is described in greater detail above in connection with the embodiments of FIGS. 12 and 12A. The open or closed celled non-reticulated visco-elastic foam in the bottom layer 1612 falls generally within the category of foams otherwise known as "memory foams" or "low resilience foams".

In some embodiments, the bottom layer 1612 has a relatively low hardness, providing a deformable and comfortable substrate beneath the top layer 1610 of reticulated visco-elastic foam. Depending at least in part upon the thickness of the top layer 1610, the bottom layer 1612 can conform to a user's body based upon pressure exerted by the user's body, thereby supplementing the ability of the top layer 1610 to distribute force applied by the user's body upon the body support 1602. In some embodiments, the bottom layer 1612 has a hardness of at least about 30 N and no greater than about 175 N. In other embodiments, a bottom layer 1612 having a hardness of at least about 40 N and no greater than about 110 N is utilized. In still other embodiments, a bottom layer 1612 having a hardness of at least about 40 N and no greater than about 75 N is utilized.

The bottom layer 1612 can also have a density providing a relatively high degree of material durability. Also, the density of the foam in the bottom layer 1612 can impact other characteristics of the foam, such as the manner in which the bottom layer 1612 responds to pressure, and the feel of the foam. In some embodiments, the bottom layer 1612 has a density of no less than about 30 $kg/m^3$ and no greater than about 150 $kg/m^3$. In other embodiments, a bottom layer 1612 having a density of at least about 40 $kg/m^3$ and no greater than about 125 $kg/m^3$ is utilized. In still other embodiments, a bottom layer 1612 having a density of at least about 60 $kg/m^3$ and no greater than about 115 $kg/m^3$ is utilized.

The non-reticulated visco-elastic material of the bottom layer 1612 can be selected for responsiveness to any range of temperatures. However, in some embodiments, a temperature responsiveness in a range of a user's body temperatures (or in a range of temperatures to which the bottom layer 1612 is exposed by a user's body upon the body support 1602) can provide significant advantages. In some embodiments, a non-reticulated visco-elastic material selected for the bottom layer 1612 can be responsive to temperature changes above at least 0° C. In other embodiments, the non-reticulated visco-elastic material selected for the bottom layer 1612 can be responsive to temperature changes within a range of at least about 10° C. In still other embodiments, the non-reticulated visco-elastic material selected for the bottom layer 1612 can be responsive to temperature changes within a range of at least about 15° C.

In some embodiments, the top layer 1610 of reticulated visco-elastic foam can reduce the amount of heat in the bottom layer 1612 (due at least in part to the reticulated cellular structure of the foam in the top layer 1612) while still providing a relatively soft and comfortable surface of the body support 1602, and the capability to conform to a user's body and/or distribute pressure responsive to force from the user (by virtue of the visco-elastic nature of the top layer 1610).

The body support 1602 illustrated in FIG. 16 can have a top layer 1610 that is between 0.33 and 2 times the thickness of the bottom layer 1612, thereby providing a significant degree of ventilation and/or heat dissipation via the top layer 1610 and the desirable body-conforming, pressure distribution, and comfort characteristics of the bottom layer 1612. In some embodiments, the body support 1602 has a top layer 1610 that is between 0.5 and 1.5 times the thickness of the bottom layer 1612 for these purposes. In still other embodiments, the body support 1602 has a top layer 1610 that is about the same thickness of the bottom layer 1612 for these purposes.

Figure 17:
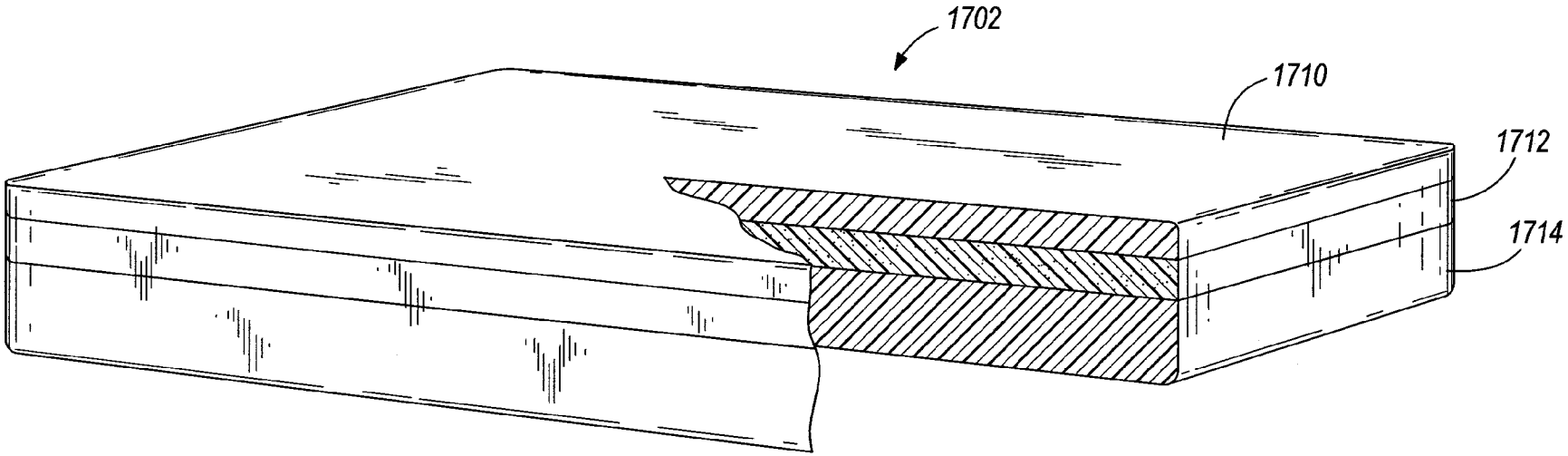

FIG. 17 illustrates another embodiment of a body support according to the present invention. This embodiment employs much of the same structure and has many of the same properties as the embodiments of the body support described above in connection with FIG. 16. Accordingly, the following description focuses primarily upon the structure and features that are different than the embodiments described above in connection with FIG. 16. Reference should be made to the description above in connection with FIG. 16 for additional information regarding the structure and features, and possible alternatives to the structure and features of the body support illustrated in FIG. 17 and described below. Structure and features of the embodiment shown in FIG. 17 that correspond to structure and features of the embodiment of FIG. 16 are designated hereinafter in the 1700 series of reference numbers.

Like the body support 1602 illustrated in FIG. 16, the body support 1702 illustrated in FIG. 17 has a top layer 1710 comprising reticulated visco-elastic foam and an underlying layer 1712 comprising open or closed celled non-reticulated visco-elastic foam. In some embodiments, the body support 1702 can therefore provide the desirable softness, body-conforming, ventilation, and heat transfer properties described above in connection with the embodiment of FIG. 16. The body support 1702 illustrated in FIG. 17 further comprises a bottom layer 1714 beneath the layer of non-reticulated visco-elastic foam 1712. Therefore, the layer 1712 of non-reticulated visco-elastic foam is a middle layer 1712 located between the top and bottom layers 1710, 1714 of the body support 1702.

The bottom layer 1714 of the body support 1702 illustrated in FIG. 17 comprises reticulated non-visco-elastic foam. The reticulated non-visco-elastic foam (and various possible properties thereof) of the bottom layer 1714 is described in greater detail above in connection with the embodiment of FIG. 13.

In some embodiments, the top layer 1710 of reticulated visco-elastic foam and the bottom layer 1714 of reticulated non-visco-elastic foam can reduce the amount of heat in the middle layer 1712, drawing heat from both sides of the middle layer 1712 and/or providing enhanced ventilation of the body support 1702 on both sides of the middle layer 1712 due at least in part to the reticulated cellular structure of the foam in the top and bottom layers 1710, 1714. In addition, the visco-elastic nature of the top layer 1710 can still provide a relatively soft and comfortable surface of the body support 1702, the ability to conform to a user's body responsive to pressure from the user's body, and a degree of pressure distribution for the user's body.

The body support 1702 illustrated in FIG. 17 can have a bottom layer 1714 that is at least 0.17 times at least as thick as the combined thickness of the top and middle layers 1710, 1712 to provide a desirable degree of heat dissipation and ventilation from the bottom of the middle layer 1712. In some embodiments, the bottom layer 1714 can be at least 0.25 times as thick as the combined thickness of the top and middle layers 1710, 1712 for these purposes. In still other embodiments, a bottom layer 1714 that is at least 0.375 times as thick as the combined thickness of the top and middle layers 1710, 1712 is used for these purposes.

Figure 18:
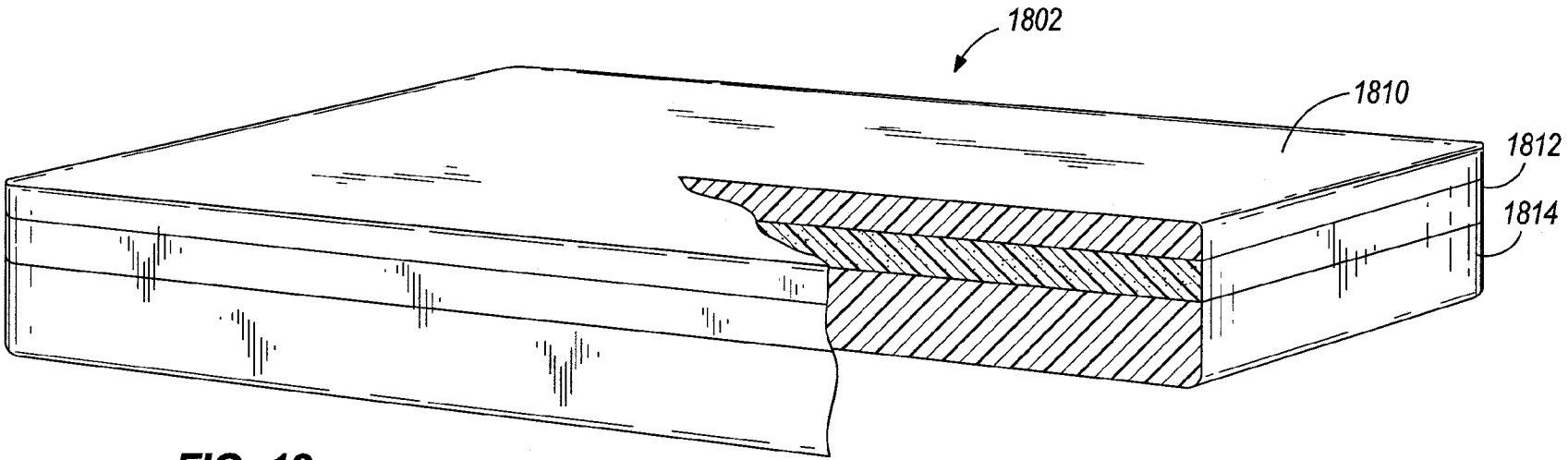

FIG. 18 illustrates another embodiment of a body support according to the present invention. This embodiment employs much of the same structure and has many of the same properties as the embodiments of the body support described above in connection with FIG. 16. Accordingly, the following description focuses primarily upon the structure and features that are different than the embodiments described above in connection with FIG. 16. Reference should be made to the description above in connection with FIG. 16 for additional information regarding the structure and features, and possible alternatives to the structure and features of the body support illustrated in FIG. 18 and described below. Structure and features of the embodiment shown in FIG. 18 that correspond to structure and features of the embodiment of FIG. 16 are designated hereinafter in the 1800 series of reference numbers.

Like the body support 1602 illustrated in FIG. 16, the body support 1802 illustrated in FIG. 18 has a top layer 1810 comprising reticulated visco-elastic foam and an underlying layer 1812 comprising open or closed celled non-reticulated visco-elastic foam. In some embodiments, the body support 1802 can therefore provide the desirable softness, body-conforming, ventilation, and heat transfer properties described above in connection with the embodiment of FIG. 16. The body support 1802 illustrated in FIG. 18 further comprises a bottom layer 1814 beneath the layer of non-reticulated visco-elastic foam 1812. Therefore, the layer 1812 of non-reticulated visco-elastic foam is a middle layer 1812 located between the top and bottom layers 1810, 1814 of the body support 1802.

The bottom layer 1814 of the body support 1802 illustrated in FIG. 18 comprises a cellular structure of flexible polyurethane foam that is relatively highly resilient and supportive. This relatively highly resilient flexible cellular foam (and various possible properties thereof) is described in greater detail above in connection with the embodiment of FIGS. 12 and 12A.

In some embodiments, the bottom layer 1814 is a supportive layer providing a relatively stiff substrate upon which the top and middle layers 1810, 1812 lie, while still providing a degree of deformability for user comfort (to the extent that the user's weight affects the shape of the bottom layer 1814). Therefore, the bottom layer 1814 can comprise a foam having a relatively high resilience capable of providing significant support to the top and middle layers 1810, 1812. Both of the top and middle layers 1810, 1812 can provide the desirable body-conforming and pressure distribution features described above, while the top layer 1810 can provide significant heat dissipation and ventilation for the body support 1802 as also described above. In some embodiments, the bottom layer 1814 has a resilience greater than that of the top and middle layers 1810, 1812.

The body support 1802 illustrated in FIG. 18 can have a bottom layer 1814 that is at least 0.17 times as thick as the combined thickness of the top and middle layers 1810, 1812, thereby providing substantial support for the top and middle layers 1810, 1812. In some embodiments, the bottom layer 1814 is at least 0.33 times as thick as the combined thickness of the top and middle layers 1810, 1812. In other embodiments, the bottom layer 1814 is at least half as thick as the combined thickness of the top and middle layers 1810, 1812.

Figure 19:
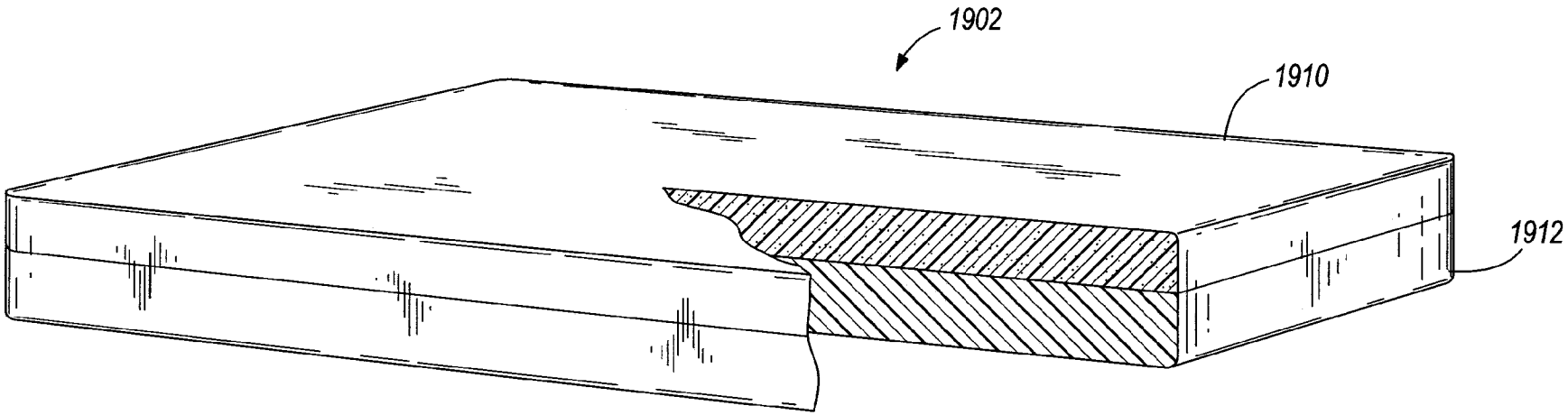

A body support 1902 according to another embodiment of the present invention is illustrated in FIG. 19, and comprises two layers of material: a top layer 1910 comprising open or closed celled non-reticulated visco-elastic foam, and a bottom layer 1912 comprising reticulated visco-elastic foam. The non-reticulated visco-elastic foam (and various possible properties thereof) is described above in connection with the embodiment of FIG. 16. The reticulated visco-elastic foam (and various possible properties thereof) is described above in connection with the embodiment of FIGS. 12 and 12A.

In some embodiments, heat received by the top layer 1910 (e.g., from a user resting upon the body support 1902) can be dissipated by the reticulated visco-elastic foam of the bottom layer 1912 due at least in part to the reticulated cellular structure of the foam in the bottom layer 1912. In this body support construction, the softness, body-conforming, and pressure-distributing properties of the non-reticulated visco-elastic foam are retained in the top layer 1910 (proximate the body of a user) while the ventilating and heat-dissipative properties of the bottom layer 1912 can help reduce heat in the top layer 1910. The bottom layer 1912 can also provide softness, can at least partially conform to a user's body responsive to pressure from the user's body, and can distribute pressure of the user's body by virtue of the visco-elastic nature of the bottom layer 1912.

The body support 1902 illustrated in FIG. 19 can have a bottom layer 1912 that is at least 0.33 times the thickness of the top layer 1910, thereby providing a significant degree of ventilation and/or heat dissipation via the bottom layer 1912 and the desirable body-conforming, pressure distribution, and comfort properties of the top layer 1910. In some embodiments, the body support 1902 has a bottom layer 1912 that is at least as thick as the top layer 1910 for these purposes. In still other embodiments, the body support 1902 has a bottom layer 1912 that is at least twice as thick as the top layer 1910 for these purposes.

Figure 20:
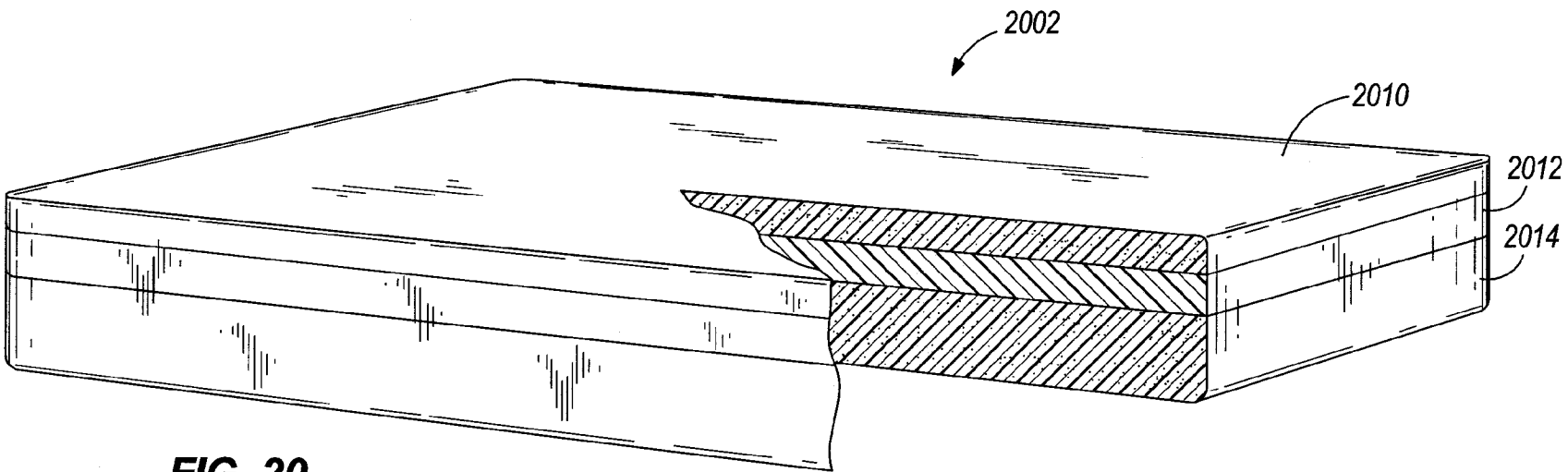

FIG. 20 illustrates another embodiment of a body support according to the present invention. This embodiment employs much of the same structure and has many of the same properties as the embodiments of the body support described above in connection with FIG. 19. Accordingly, the following description focuses primarily upon the structure and features that are different than the embodiments described above in connection with FIG. 19. Reference should be made to the description above in connection with FIG. 19 for additional information regarding the structure and features, and possible alternatives to the structure and features of the body support illustrated in FIG. 20 and described below. Structure and features of the embodiment shown in FIG. 20 that correspond to structure and features of the embodiment of FIG. 19 are designated hereinafter in the 2000 series of reference numbers.

Like the embodiment illustrated in FIG. 19, the body support 2002 illustrated in FIG. 20 has a top layer 2010 comprising open or closed celled non-reticulated visco-elastic foam, and an underlying layer 2012 comprising reticulated visco-elastic foam. In some embodiments, the body support 2002 can therefore provide the softness, body-conforming, and pressure-distributing characteristics of the non-reticulated visco-elastic foam in the top layer 2010 (proximate the body of a user) as described above, and the ventilating and heat-dissipative properties of the underlying layer 2012 for dissipating heat from the top layer 2010 as also described above. The underlying layer 2012 can also provide softness of the body support 2002, can help to conform the body support 2002 to the user's body, and can thereby distribute pressure of the user's body by virtue of the visco-elastic property of the underlying layer 2012.

The body support 2002 illustrated in FIG. 20 further comprises a bottom layer 2014 beneath the layer of reticulated visco-elastic foam 2012. Therefore, the layer 2012 of reticulated visco-elastic foam is a middle layer 2012 located between the top and bottom layers 2010, 2014 of the body support 2002.

The bottom layer 2014 of the body support 2002 illustrated in FIG. 20 comprises open or closed celled non-reticulated visco-elastic foam. The non-reticulated visco-elastic foam (and various possible properties thereof) of the bottom layer 2014 is described above with reference to the top layer 2010 of the body support 2002. Also, the non-reticulated visco-elastic foam of the bottom layer 2014 can have substantially the same or different properties than the non-reticulated visco-elastic foam of the top layer 2010, while still falling within the material property ranges of the non-reticulated visco-elastic foam described above. In some embodiments, top and bottom layers 2010, 2014 of non-reticulated visco-elastic foam can be utilized in products that can be oriented with either layer 2010, 2014 facing generally toward a user's body (e.g., a mattress that can be flipped on either side). Also or alternatively, the non-reticulated visco-elastic foam of the bottom layer 2014 can supplement the body-conforming and pressure-distributing capabilities of the top and middle layers 2010, 2012 described above.

The body support 2002 illustrated in FIG. 20 is also an example of the manner in which a layer of non-reticulated visco-elastic foam can be replaced by two layers of non-reticulated visco-elastic foam flanking a layer of reticulated visco-elastic foam for ventilation and heat dissipation.

Figure 21:
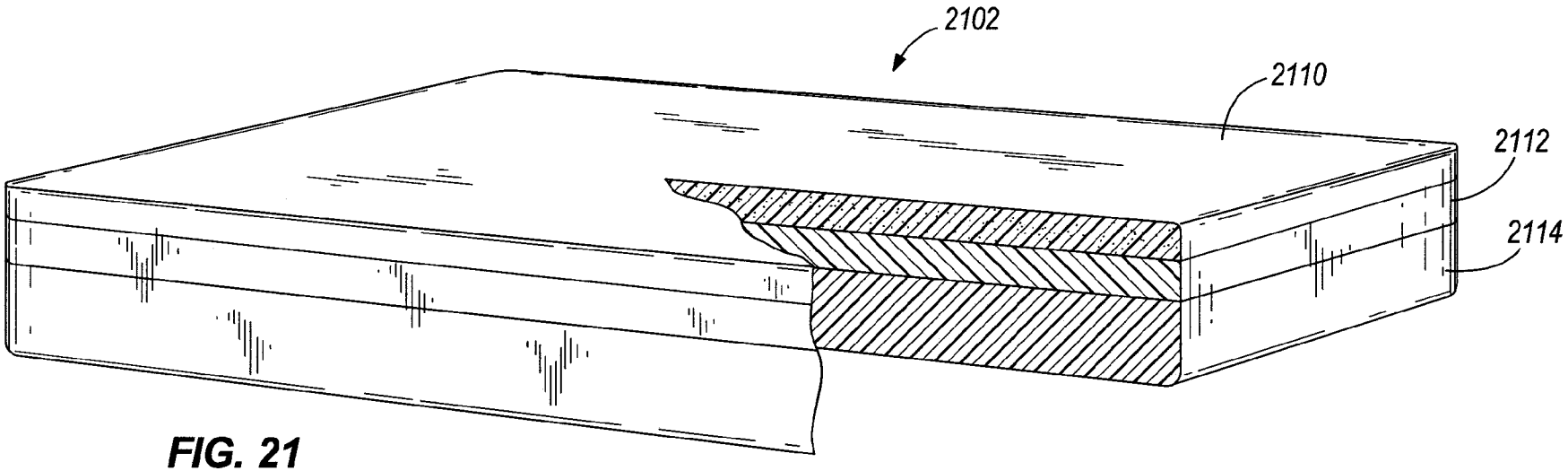

FIG. 21 illustrates another embodiment of a body support according to the present invention. This embodiment employs much of the same structure and has many of the same properties as the embodiments of the body support described above in connection with FIG. 19. Accordingly, the following description focuses primarily upon the structure and features that are different than the embodiments described above in connection with FIG. 19. Reference should be made to the description above in connection with FIG. 19 for additional information regarding the structure and features, and possible alternatives to the structure and features of the body support illustrated in FIG. 21 and described below. Structure and features of the embodiment shown in FIG. 21 that correspond to structure and features of the embodiment of FIG. 19 are designated hereinafter in the 2100 series of reference numbers.

Like the embodiment illustrated in FIG. 19, the body support 2102 illustrated in FIG. 21 has a top layer 2110 comprising open or closed celled non-reticulated visco-elastic foam, and an underlying layer 2112 comprising reticulated visco-elastic foam. In some embodiments, the body support 2102 can therefore provide the softness, body-conforming, and pressure-distributing characteristics of the non-reticulated visco-elastic foam in the top layer 2110 (proximate the body of a user) as described above, and the ventilating and heat-dissipative properties of the underlying layer 2112 for reducing heat in the top layer 2110 as also described above. The underlying layer 2112 can also provide softness for the body support 2002, can help to conform the body support 2102 to the user's body, and can thereby distribute pressure of the user's body by virtue of the visco-elastic property of the underlying layer 2112.

The body support 2102 illustrated in FIG. 21 further comprises a bottom layer 2114 beneath the layer of reticulated visco-elastic foam 2112. Therefore, the layer 2112 of reticulated visco-elastic foam is a middle layer 2112 located between the top and bottom layers 2110, 2114 of the body support 2102.

The bottom layer 2114 of the body support 2102 illustrated in FIG. 21 comprises reticulated non-visco-elastic foam. The reticulated non-visco-elastic foam (and various possible properties thereof) of the bottom layer 2114 is described in greater detail above in connection with the embodiment of FIG. 13.

In some embodiments, the middle layer 2112 of reticulated visco-elastic foam can reduce heat in the top layer 2110 as described above. However, some types of reticulated visco-elastic foam that can be utilized in the middle layer 2112 do not provide a high degree of support for the body support 2102. While this may be acceptable and/or desirable in some applications (e.g., in pillows, futons, and the like), in some embodiments additional support is desired. The reticulated non-visco-elastic foam of the bottom layer 2114 can provide such additional support, while still providing the ventilation and/or heat dissipation properties described earlier in connection with the embodiment of FIG. 13. A bottom layer 2114 of reticulated non-visco-elastic foam can be utilized for other reasons as well, including without limitation to provide a layer of material that is less responsive or substantially non-responsive to a user's body temperature (described in greater detail above in connection with the embodiment of FIG. 13), while still providing the ventilation and/or heat dissipation properties also described above.

The body support 2102 illustrated in FIG. 21 can have a bottom layer 2114 that is at least as thick as the combined thicknesses of the top and middle layers 2110, 2112, thereby providing substantial support, ventilation, and heat dissipation for the top and middle layers 2110, 2112. In some embodiments, the bottom layer 2114 is at least 0.17 times as thick as the combined thickness of the top and middle layers 2110, 2112. In other embodiments, the bottom layer 2114 is at least 0.375 times as thick as the combined thickness of the top and middle layers 2110, 2112.

Figure 22:
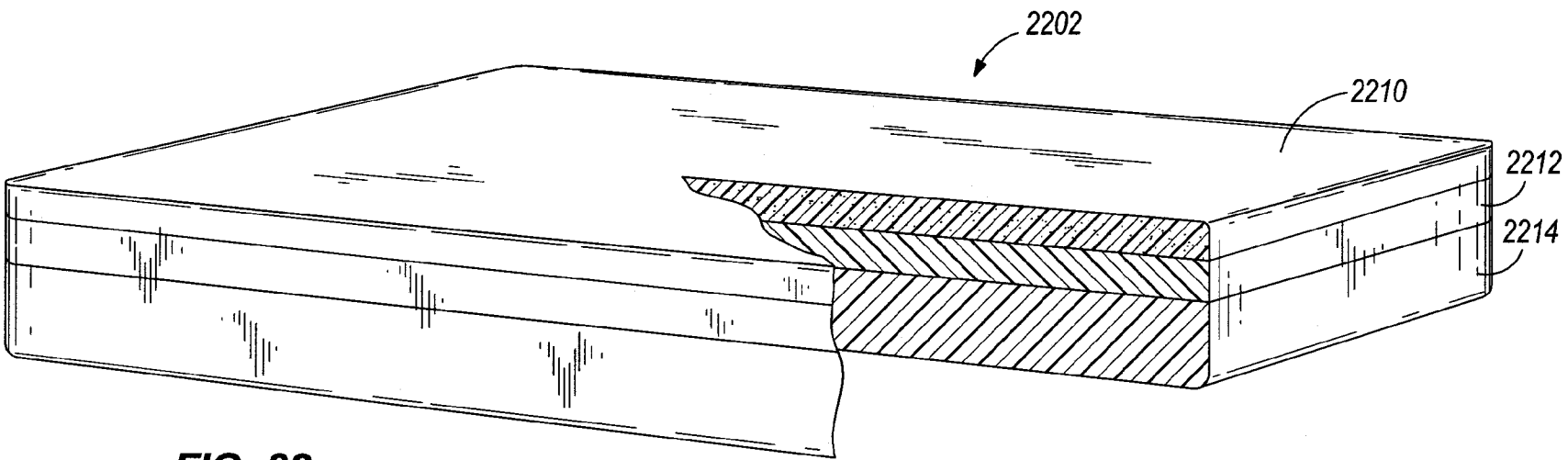

FIG. 22 illustrates another embodiment of a body support according to the present invention. This embodiment employs much of the same structure and has many of the same properties as the embodiments of the body support described above in connection with FIG. 19. Accordingly, the following description focuses primarily upon the structure and features that are different than the embodiments described above in connection with FIG. 19. Reference should be made to the description above in connection with FIG. 19 for additional information regarding the structure and features, and possible alternatives to the structure and features of the body support illustrated in FIG. 22 and described below. Structure and features of the embodiment shown in FIG. 22 that correspond to structure and features of the embodiment of FIG. 19 are designated hereinafter in the 2200 series of reference numbers.

Like the embodiment illustrated in FIG. 19, the body support 2202 illustrated in FIG. 22 has a top layer 2210 comprising open or closed celled non-reticulated visco-elastic foam, and an underlying layer 2212 comprising reticulated visco-elastic foam. In some embodiments, the body support 2202 can therefore provide the softness, body-conforming, and pressure-distributing characteristics of the non-reticulated visco-elastic foam in the top layer 2210 (proximate the body of a user) as described above, and the ventilating and heat-dissipative properties of the underlying layer 2212 for reducing heat in the top layer 2210 as also described above. The underlying layer 2212 can also provide softness to the body support 2202, can help to conform the body support 2202 to the user's body, and can thereby distribute pressure of the user's body by virtue of the visco-elastic property of the underlying layer 2212.

The body support 2202 illustrated in FIG. 22 further comprises a bottom layer 2214 beneath the layer of reticulated visco-elastic foam 2212. Therefore, the layer 2212 of reticulated visco-elastic foam is a middle layer 2212 located between the top and bottom layers 2210, 2214 of the body support 2202.

The bottom layer 2214 of the body support 2202 illustrated in FIG. 22 comprises a cellular structure of flexible polyurethane foam that is relatively highly resilient and supportive. The bottom layer 2214 can therefore provide a relatively stiff substrate upon which the top and middle layers 2210, 2212 lie, thereby providing support for the top and middle layers 2210, 2212. Also, the flexibility of the bottom layer 2214 can provide a degree of deformability for user comfort (to the extent that the user's weight affects the shape of the bottom layer 2214), while the top and middle layers 2210, 2212 provide the desirable body-conforming and pressure distribution features described above, and while the middle layer 2212 provides significant heat dissipation and ventilation for the body support 2202. In some embodiments, the bottom layer 2214 has a resilience greater than that of the top and middle layers 2210, 2212.

The body support 2202 illustrated in FIG. 22 can have a bottom layer 2214 that is at least as thick as the combined thicknesses of the top and middle layers 2210, 2212, thereby providing substantial support for the top and middle layers 2210, 2212. In some embodiments, the bottom layer 2214 is at least 0.17 times as thick as the combined thicknesses of the top and middle layers 2210, 2212. Also, in some embodiments, the bottom layer 2214 is at least half as thick as the combined thicknesses of the top and middle layers 2210, 2212.

Figure 23:
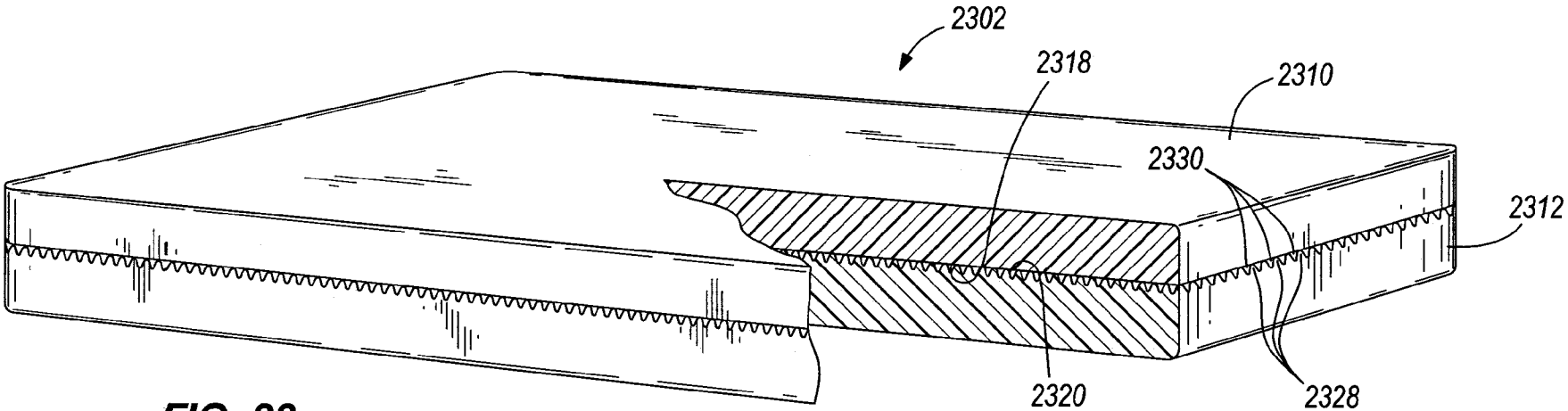

FIG. 23 illustrates another embodiment of a body support according to the present invention. This embodiment employs much of the same structure and has many of the same properties as the embodiments of the body support described above in connection with FIGS. 12 and 12A. Accordingly, the following description focuses primarily upon the structure and features that are different than the embodiments described above in connection with FIGS. 12 and 12A. Reference should be made to the description above in connection with FIGS. 12 and 12A for additional information regarding the structure and features, and possible alternatives to the structure and features of the body support illustrated in FIG. 23 and described below. Structure and features of the embodiment shown in FIG. 23 that correspond to structure and features of the embodiment of FIGS. 12 and 12A are designated hereinafter in the 2300 series of reference numbers.

Like the body support 1202 illustrated in FIGS. 12 and 12A, the body support 2302 illustrated in FIG. 23 has a top layer 2310 comprising reticulated visco-elastic foam, beneath which lies a bottom layer 2312 comprising a cellular structure of relatively resilient flexible polyurethane material.

The reticulated visco-elastic foam and the relatively highly resilient flexible cellular foam of the top and bottom layers 2310, 2312, respectively, are described in greater detail above in connection with the embodiment illustrated in FIGS. 12 and 12A.

The top surface 2320 of the bottom layer 2312 of the body support 2302 has a non-planar shape beneath the substantially planar bottom surface 2318 of the top layer 2310. The non-planar shape of the top surface 2320 can take any of the forms described above in connection with the non-planar top surface 420 of the bottom layer 412 in the body support 402 illustrated in FIG. 4, and can be defined by a plurality of protrusions 2328 and/or a plurality of apertures (not shown) as also described above. Passages 2330 between the substantially planar bottom surface 2318 of the top layer 2310 and the non-planar top surface 2320 of the bottom layer 2312 can provide a degree of ventilation and enhanced heat dissipation of the body support 2302. In other embodiments, such passages 2330 can be defined between a non-planar bottom surface 2318 of the top layer 2310 and a substantially planar top surface 2320 of the bottom layer 2312, or between a non-planar bottom surface 2318 of the top layer 2310 and a non-planar top surface 2320 of the bottom layer 2312, wherein the non-planar surface(s) can be defined in any of the manners described above in connection with the illustrated embodiment of FIG. 4.

Passages 2330 running between the top and bottom layers 2310, 2312 illustrated in FIG. 23 can supplement the ventilation and/or heat dissipative capabilities of the top layer 2310 of reticulated visco-elastic foam, and can reduce heat in the bottom layer 2312 of relatively highly resilient flexible cellular foam. In this regard, the skeletal structure of the cells in the top layer 2310 of reticulated visco-elastic foam can enable heat to be transferred from the top layer 2310 to and through the passages 2330.

Figure 24:
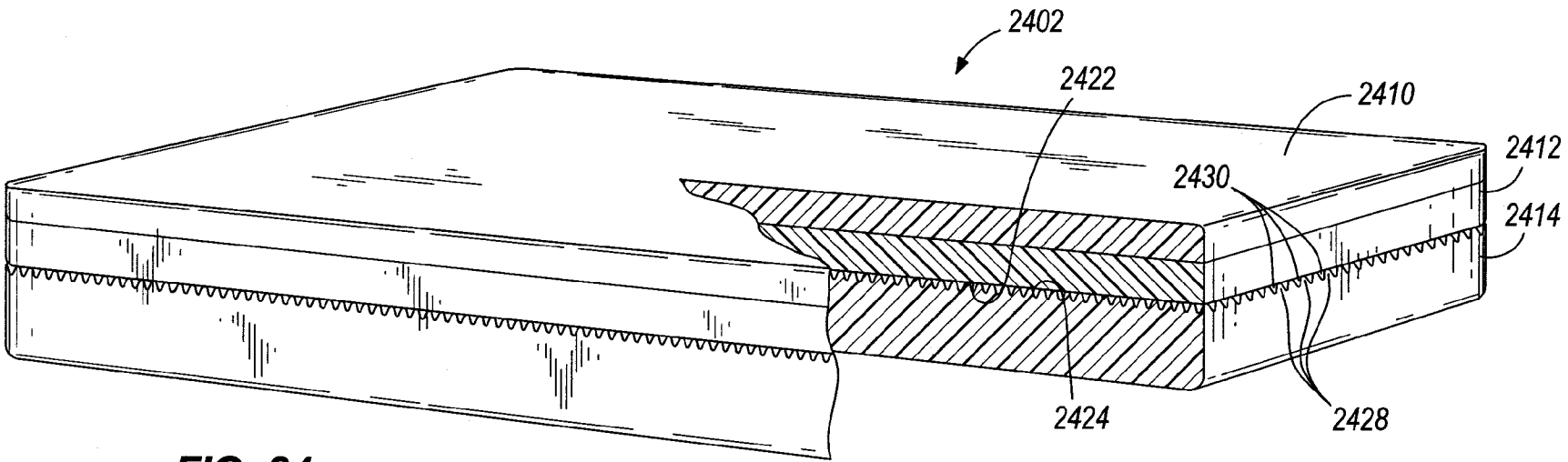

FIG. 24 illustrates another embodiment of a body support according to the present invention. This embodiment employs much of the same structure and has many of the same properties as the embodiments of the body support described above in connection with FIG. 14. Accordingly, the following description focuses primarily upon the structure and features that are different than the embodiments described above in connection with FIG. 14. Reference should be made to the description above in connection with FIG. 14 for additional information regarding the structure and features, and possible alternatives to the structure and features of the body support illustrated in FIG. 24 and described below. Structure and features of the embodiment shown in FIG. 24 that correspond to structure and features of the embodiment of FIG. 14 are designated hereinafter in the 2400 series of reference numbers.

As described in greater detail above with regard to the body support 1402 illustrated in FIG. 14, the body support 2402 illustrated in FIG. 24 comprises a top layer 2410 comprising reticulated visco-elastic foam, a middle layer 2412 comprising reticulated non-visco-elastic foam, and a bottom layer 2414 comprising a cellular structure of relatively resilient flexible polyurethane material. The reticulated visco-elastic foam and the relatively highly resilient flexible cellular foam of the top and bottom layers 2410, 2414, respectively, are described in greater detail above in connection with the embodiment illustrated in FIGS. 12 and 12A. The reticulated non-visco-elastic foam of the middle layer 2412 is described in greater detail above in connection with the embodiment illustrated in FIG. 13.

The top surface 2424 of the bottom layer 2414 has a non-planar shape beneath the substantially planar bottom surface 2422 of the middle layer 2412. The non-planar shape of the top surface 2424 can take any of the forms described above in connection with the non-planar top surface 420 of the bottom layer 412 in the body support 402 illustrated in FIG. 4, and can be defined by a plurality of protrusions 2428 and/or a plurality of apertures (not shown) as also described above. Passages 2430 between the substantially planar bottom surface 2422 of the middle layer 2412 and the non-planar top surface 2424 of the bottom layer 2414 can provide a degree of ventilation and enhanced heat dissipation of the body support 2402 (e.g., moving heat from the middle layer 2412, and in some cases from both the middle and top layers 2412, 2410). In other embodiments, such passages 2430 can be defined between a non-planar bottom surface 2422 of the middle layer 2412 and a substantially planar top surface 2424 of the bottom layer 2414, or between a non-planar bottom surface 2422 of the middle layer 2412 and a non-planar top surface 2424 of the bottom layer 2414, wherein the non-planar surface(s) can be defined in any of the manners described above in connection with the illustrated embodiment of FIG. 4.

Passages 2430 running between the middle and bottom layers 2412, 2414 illustrated in FIG. 24 can provide the body support 2402 with increased capacity to dissipate heat from the middle layer 2412 of reticulated non-visco-elastic foam, which can receive a user's body heat from the top layer 2410 of reticulated visco-elastic foam. The skeletal structure of the cells in the top and middle layers 2410, 2412 can enable heat to be transferred from the top and middle layers 2410, 2412 to and through the passages 2430. Although heat transfer in lateral directions (i.e., toward the edges of the body support 2402) still occurs in the top and middle layers 2410, 2412 of reticulated visco-elastic and reticulated non-visco-elastic foam based at least in part upon the cell structure of such foams, the passages 2430 can enhance this heat transfer.

Figure 25:
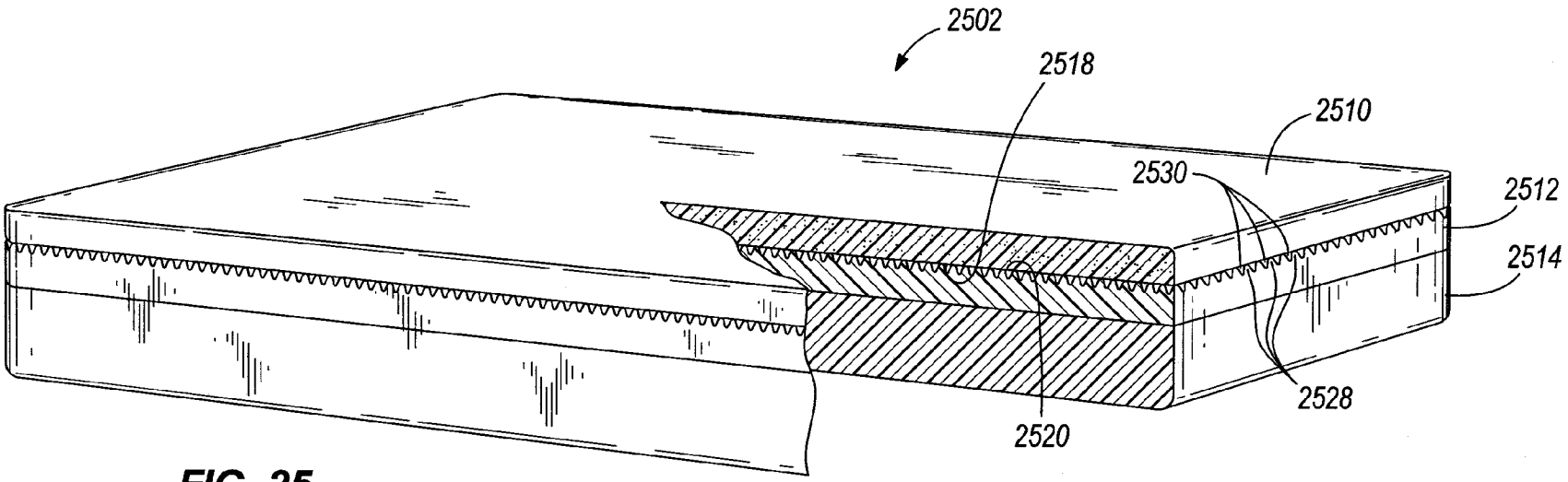

FIG. 25 illustrates another embodiment of a body support according to the present invention. This embodiment employs much of the same structure and has many of the same properties as the embodiments of the body support described above in connection with FIG. 21. Accordingly, the following description focuses primarily upon the structure and features that are different than the embodiments described above in connection with FIG. 21. Reference should be made to the description above in connection with FIG. 21 for additional information regarding the structure and features, and possible alternatives to the structure and features of the body support illustrated in FIG. 25 and described below. Structure and features of the embodiment shown in FIG. 25 that correspond to structure and features of the embodiment of FIG. 21 are designated hereinafter in the 2500 series of reference numbers.

As described in greater detail above with regard to the body support 2102 illustrated in FIG. 21, the body support 2502 illustrated in FIG. 25 comprises a top layer 2510 comprising open or closed celled non-reticulated visco-elastic foam, a middle layer 2512 comprising reticulated visco-elastic foam, and a bottom layer 2514 comprising reticulated non-visco-elastic foam.

The top surface 2520 of the middle layer 2512 has a non-planar shape beneath the substantially planar bottom surface 2518 of the top layer 2510. The non-planar shape of the top surface 2520 of the middle layer 2512 can take any of the forms described above in connection with the non-planar top surface 420 of the bottom layer 412 in the body support 402 illustrated in FIG. 4, and can be defined by a plurality of protrusions 2528 and/or a plurality of apertures (not shown) as also described above. Passages 2530 between the substantially planar bottom surface 2518 of the top layer 2510 and the non-planar top surface 2520 of the middle layer 2512 can provide a degree of ventilation and enhanced heat dissipation of the body support 2502. In some embodiments, the passages 2530 can be defined between a non-planar bottom surface 2518 of the top layer 2510 and a substantially planar top surface 2520 of the middle layer 2512, or between a non-planar bottom surface 2518 of the top layer 2510 and a non-planar top surface 2520 of the middle layer 2512, wherein the non-planar surface(s) can be defined in any of the manners described above in connection with the illustrated embodiment of FIG. 4.

The passages 2530 between the top and middle layers 2510, 2512 described above can be particularly useful in reducing heat in regions of the body support 2502. The passages 2530 can supplement the ventilation and/or heat dissipative capabilities of the middle and bottom layers 2512, 2514 of reticulated visco-elastic foam and reticulated non-visco-elastic foam, and can reduce heat in the top layer 2510 of non-reticulated visco-elastic foam. In addition, the skeletal structure of the cells in the middle and bottom layers 2512, 2514 can enable heat to be transferred from the top layer 2510 to and through the cells of the middle and bottom layers 2512, 2514.

Figure 26:
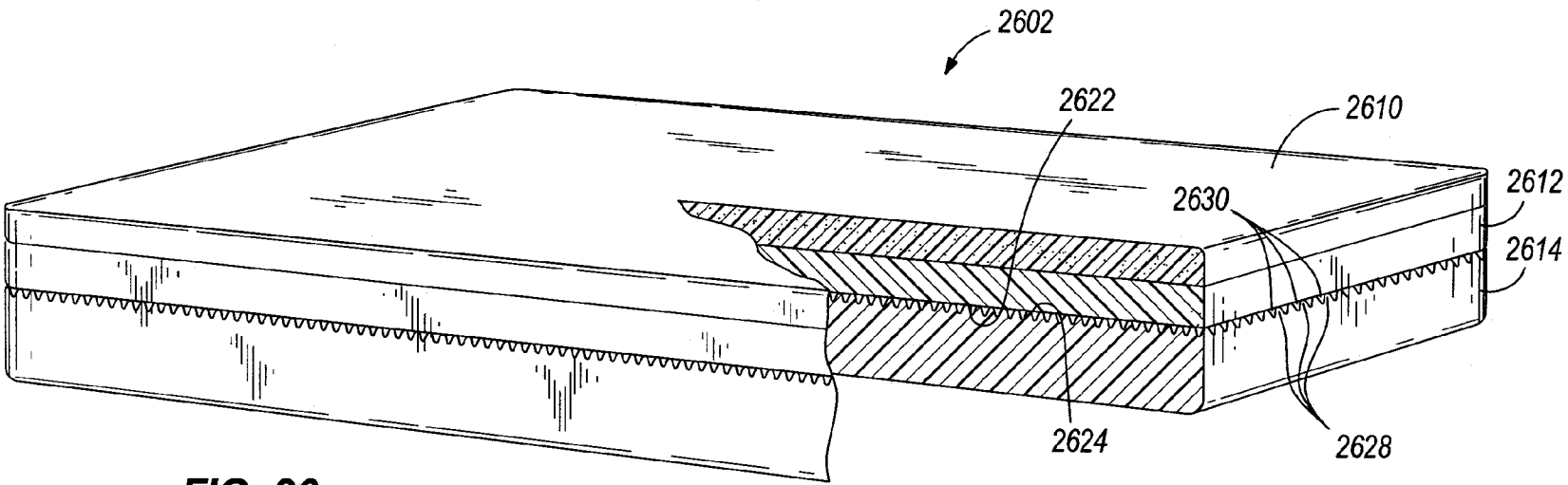

FIG. 26 illustrates another embodiment of a body support according to the present invention. This embodiment employs much of the same structure and has many of the same properties as the embodiments of the body support described above in connection with FIG. 22. Accordingly, the following description focuses primarily upon the structure and features that are different than the embodiments described above in connection with FIG. 22. Reference should be made to the description above in connection with FIG. 22 for additional information regarding the structure and features, and possible alternatives to the structure and features of the body support illustrated in FIG. 26 and described below. Structure and features of the embodiment shown in FIG. 26 that correspond to structure and features of the embodiment of FIG. 22 are designated hereinafter in the 2600 series of reference numbers.

As described in greater detail above with regard to the body support 2202 illustrated in FIG. 22, the body support 2602 illustrated in FIG. 5 comprises a top layer 2610 comprising open or closed celled non-reticulated visco-elastic foam, a middle layer 2612 comprising reticulated visco-elastic foam, and a bottom layer 2614 comprising flexible cellular polyurethane foam having a relatively high resilience. However, the top surface 2624 of the bottom layer 2614 has a non-planar shape beneath the substantially planar bottom surface 2622 of the middle layer 2612. The non-planar shape of the top surface 2624 can take any of the forms described above in connection with the non-planar top surface 420 of the bottom layer 412 in the body support 402 illustrated in FIG. 4, and can be defined by a plurality of protrusions 2628 and/or a plurality of apertures (not shown) as also described above. Passages 2630 can be defined between the substantially planar bottom surface 2622 of the middle layer 2612 and the non-planar top surface 2624 of the bottom layer 2614. In other embodiments, such passages 2630 can be defined between a non-planar bottom surface 2622 of the middle layer 2612 and a substantially planar top surface 2624 of the bottom layer 2614, or between a non-planar bottom surface 2622 of the middle layer 2612 and a non-planar top surface 2624 of the bottom layer 2614, wherein the non-planar surface(s) can be defined in any of the manners described above in connection with the illustrated embodiment of FIG. 4.

Passages 2630 running between the middle and bottom layers 2612, 2614 illustrated in FIG. 26 can provide a degree of ventilation and enhanced heat dissipation of the body support 2602 (e.g., in which heat can move from the middle layer 2612 toward the passages 2630, and in some cases from both the middle and top layers 2612, 2610 toward the passages 2630). The skeletal structure of the cells in the middle layer 2612 can enable heat to be transferred from the top layer 2610 to and through the passages 2630. Although heat transfer in lateral directions (i.e., toward the edges of the body support 2602) still occurs in the middle layer 2612 of reticulated visco-elastic foam based at least in part upon the cell structure of the reticulated visco-elastic foam, the passages 2630 can enhance this heat transfer.

Figure 27:
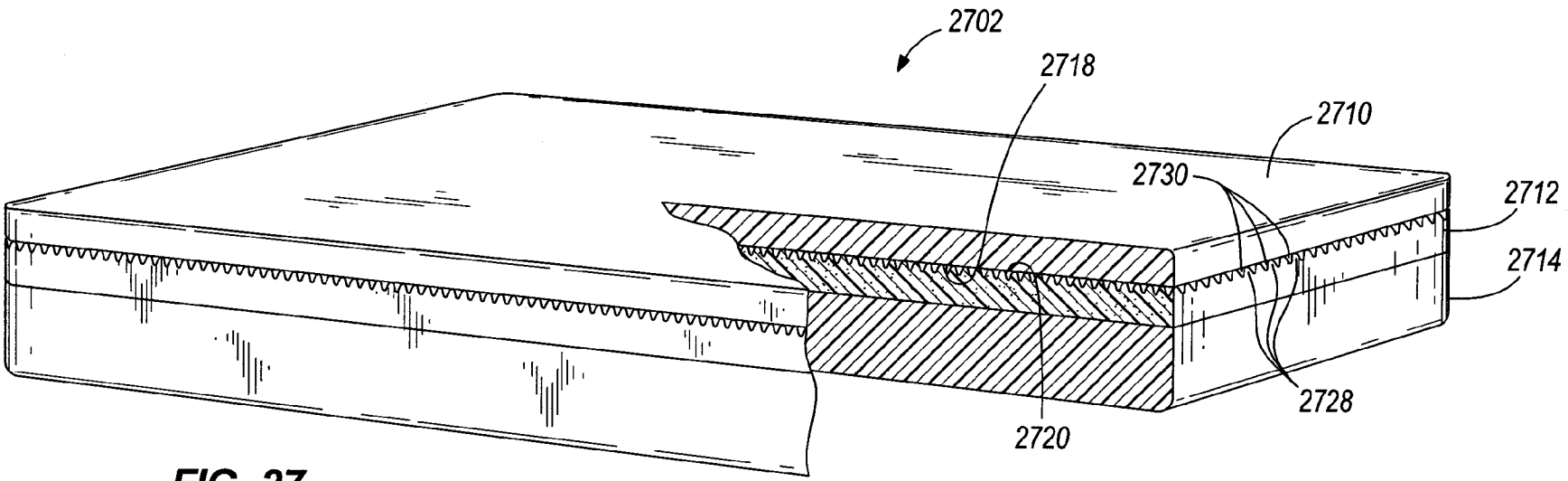

FIG. 27 illustrates another embodiment of a body support according to the present invention. This embodiment employs much of the same structure and has many of the same properties as the embodiments of the body support described above in connection with FIG. 17. Accordingly, the following description focuses primarily upon the structure and features that are different than the embodiments described above in connection with FIG. 17. Reference should be made to the description above in connection with FIG. 17 for additional information regarding the structure and features, and possible alternatives to the structure and features of the body support illustrated in FIG. 27 and described below. Structure and features of the embodiment shown in FIG. 27 that correspond to structure and features of the embodiment of FIG. 17 are designated hereinafter in the 2700 series of reference numbers.

As described in greater detail above with regard to the body support 1702 illustrated in FIG. 17, the body support 2702 illustrated in FIG. 25 comprises a top layer 2710 comprising reticulated visco-elastic foam, a middle layer 2712 comprising open or closed celled non-reticulated visco-elastic foam, and a bottom layer 2714 comprising reticulated non-visco-elastic foam.

The top surface 2720 of the middle layer 2712 has a non-planar shape beneath the substantially planar bottom surface 2718 of the top layer 2710. The non-planar shape of the top surface 2720 can take any of the forms described above in connection with the non-planar top surface 420 of the bottom layer 412 in the body support 402 illustrated in FIG. 4, and can be defined by a plurality of protrusions 2728 and/or a plurality of apertures (not shown) as also described above. Passages 2730 can be defined between the substantially planar bottom surface 2718 of the top layer 2710 and the non-planar top surface 2720 of the middle layer 2712. In some embodiments, the passages 2730 can be defined between a non-planar bottom surface 2718 of the top layer 2710 and a substantially planar top surface 2720 of the middle layer 2712, or between a non-planar bottom surface 2718 of the top layer 2710 and a non-planar top surface 2720 of the middle layer 2712, wherein the non-planar surface(s) can be defined in any of the manners described above in connection with the illustrated embodiment of FIG. 4.

Passages 2730 running between the top and middle layers 2710, 2712 illustrated in FIG. 27 can provide the body support 2702 with a degree of ventilation and/or with an increased capacity to dissipate heat from the middle layer 2712 of non-reticulated visco-elastic foam, which can receive a user's body heat from the top layer 2710 of reticulated visco-elastic foam. In some applications, heat can be transferred through the skeletal structure of cells in the top layer 2710 and then through the passages 2730 between the top and middle layers 2710, 2712.

Figure 28:
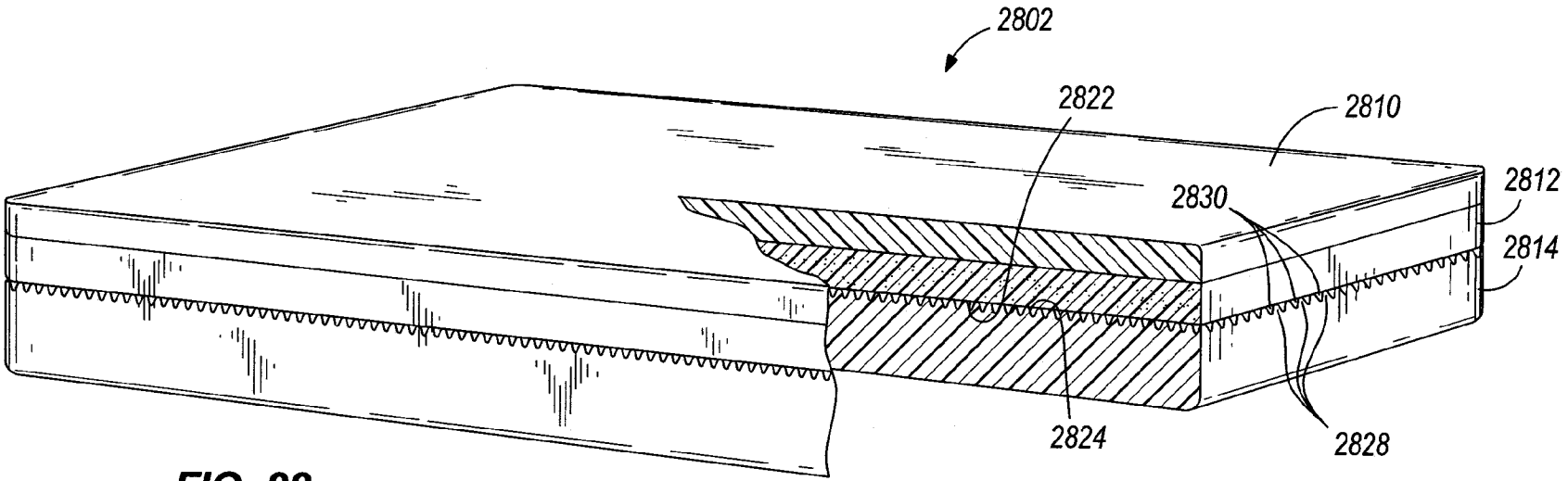

FIG. 28 illustrates another embodiment of a body support according to the present invention. This embodiment employs much of the same structure and has many of the same properties as the embodiments of the body support described above in connection with FIG. 18. Accordingly, the following description focuses primarily upon the structure and features that are different than the embodiments described above in connection with FIG. 18. Reference should be made to the description above in connection with FIG. 18 for additional information regarding the structure and features, and possible alternatives to the structure and features of the body support illustrated in FIG. 28 and described below. Structure and features of the embodiment shown in FIG. 28 that correspond to structure and features of the embodiment of FIG. 18 are designated hereinafter in the 2800 series of reference numbers.

As described in greater detail above with regard to the body support 1802 illustrated in FIG. 18, the body support 2802 illustrated in FIG. 28 comprises a top layer 2810 comprising reticulated visco-elastic foam, a middle layer 2812 comprising open or closed celled non-reticulated visco-elastic foam, and a bottom layer 2814 comprising flexible cellular polyurethane foam having a relatively high resilience.

The top surface 2824 of the bottom layer 2814 has a non-planar shape beneath the substantially planar bottom surface 2822 of the middle layer 2812. The non-planar shape of the top surface 2824 can take any of the forms described above in connection with the non-planar top surface 420 of the bottom layer 412 in the body support 402 illustrated in FIG. 4, and can be defined by a plurality of protrusions 2828 and/or a plurality of apertures (not shown) as also described above. Passages 2830 can be defined between the substantially planar bottom surface 2822 of the middle layer 2812 and the non-planar top surface 2824 of the bottom layer 2814. In other embodiments, such passages 2830 can be defined between a non-planar bottom surface 2822 of the middle layer 2812 and a substantially planar top surface 2824 of the bottom layer 2814, or between a non-planar bottom surface 2822 of the middle layer 2812 and a non-planar top surface 2824 of the bottom layer 2814, wherein the non-planar surface(s) can be defined in any of the manners described above in connection with the illustrated embodiment of FIG. 4.

Passages 2830 running between the middle and bottom layers 2812, 2814 illustrated in FIG. 28 can provide the body support 2802 with a degree of ventilation and/or increased capacity to dissipate heat from the middle layer 2812 of non-reticulated visco-elastic foam, which can receive a user's body heat through the top layer 2810 of reticulated visco-elastic foam. In particular, the passages 2830 running beneath the middle layer 2812 of non-reticulated visco-elastic foam can enable heat to be transferred from the middle layer 2812 through the passages 2830.

Figure 29:
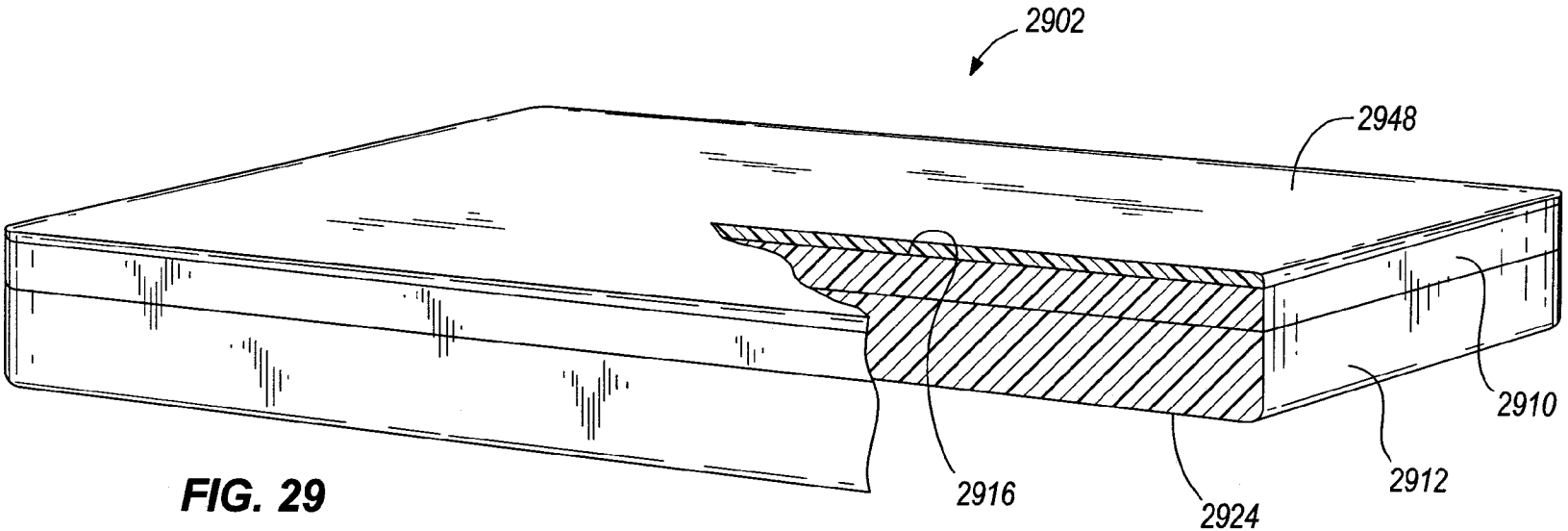

FIG. 29 illustrates another embodiment of a body support according to the present invention. This embodiment employs much of the same structure and has many of the same properties as the embodiments of the body support described above in connection with FIGS. 12 and 12A. Accordingly, the following description focuses primarily upon the structure and features that are different than the embodiments described above in connection with FIGS. 12 and 12A. Reference should be made to the description above in connection with FIGS. 12 and 12A for additional information regarding the structure and features, and possible alternatives to the structure and features of the body support illustrated in FIG. 29 and described below. Structure and features of the embodiment shown in FIG. 29 that correspond to structure and features of the embodiment of FIGS. 12 and 12A are designated hereinafter in the 2900 series of reference numbers.

Like the body support 1202 illustrated in FIGS. 12 and 12A, the body support 2902 illustrated in FIG. 29 has a top layer 2910 comprising reticulated visco-elastic foam, beneath which lies a bottom layer 2912 comprising flexible cellular polyurethane foam having a relatively high resilience. The reticulated visco-elastic foam and the relatively highly resilient flexible cellular foam of the top and bottom layers 2910, 2912, respectively, are described in greater detail above in connection with the embodiment illustrated in FIGS. 12 and 12A.

With continued reference to the body support 2902 illustrated in FIG. 29, the top and bottom layers 2910, 2912 of the body support 2902 can have a cover 2948 comprising reticulated non-visco-elastic foam. The reticulated non-visco-elastic foam of the cover 2948 can have the same properties as described above with reference to the bottom layer 1312 of the body support 1302 illustrated in FIG. 13. Also, the reticulated non-visco-elastic foam of the cover 2948 can cover any portion of the top and bottom layers 2910, 2912 desired. For example, the cover 2948 illustrated in FIG. 29 covers substantially the entire top surface 2916 of the top layer 2910. In other embodiments, the cover 2948 can also or instead cover any portion or all of the sides and ends of the top and/or bottom layers 2910, 2912, and/or can underlie any portion or all of the bottom surface 2924 of the bottom layer 2912. In some embodiments, the cover 2948 substantially entirely surrounds the top and bottom layers 2910, 2912.

The reticulated non-visco-elastic foam cover 2948 can be selected to provide a heightened degree of fire resistance to the body support 2902, and in some countries and/or localities can be utilized to meet fire codes calling for such fire resistance. Although other materials capable of meeting such fire code requirements can be utilized, the use of reticulated non-visco-elastic foam can provide improved ventilation for the surface(s) of the first and/or second layers 2910, 2912 covered by the reticulated non-visco-elastic foam cover 2948. As described above, reticulated non-visco-elastic foam can reduce the amount of heat (e.g., from a user's body heat) in adjacent areas of a body support, based at least in part upon the skeletal cellular structure of the reticulated non-visco-elastic foam. Therefore, the foam cover 2948 can provide enhanced fire resistance while also serving to ventilate the body support 2902 and/or dissipate heat from the adjacent first and/or second layers 2910, 2912 covered by the reticulated non-visco-elastic foam cover 2948. Also, the reticulated non-visco-elastic foam of the cover 2948 can be utilized to provide a layer of material that is less responsive or substantially non-responsive to a user's body temperature (described in greater detail above in connection with the embodiment of FIG. 13), while still providing the ventilation and/or heat dissipation properties also described above.

The reticulated visco-elastic material of the top layer 2910 can provide a relatively comfortable substrate for a user's body, can at least partially conform to the user's body (to distribute force applied by the user's body upon the reticulated visco-elastic material of the top layer 2910), and can be selected for responsiveness to a range of temperatures generated by body heat of a user. In some embodiments, the reticulated non-visco-elastic foam cover 2948 (if employed) has a maximum thickness through which these properties are still exhibited. Although the desirable tactile feel of the reticulated visco-elastic first layer 2910 is blocked in some embodiments by the reticulated non-visco-elastic foam cover 2948, the other desirable properties of the reticulated visco-elastic material of the first layer 2910 can still be experienced through a sufficiently thin reticulated non-visco-elastic foam cover 2948. In some embodiments, the reticulated non-visco-elastic foam cover 2948 has a maximum thickness of about 1 cm. In other embodiments, the reticulated non-visco-elastic foam cover 2948 has a maximum thickness of about 2 cm. In still other embodiments, the reticulated non-visco-elastic foam cover 2948 has a maximum thickness of about 5 cm.

Figure 30:
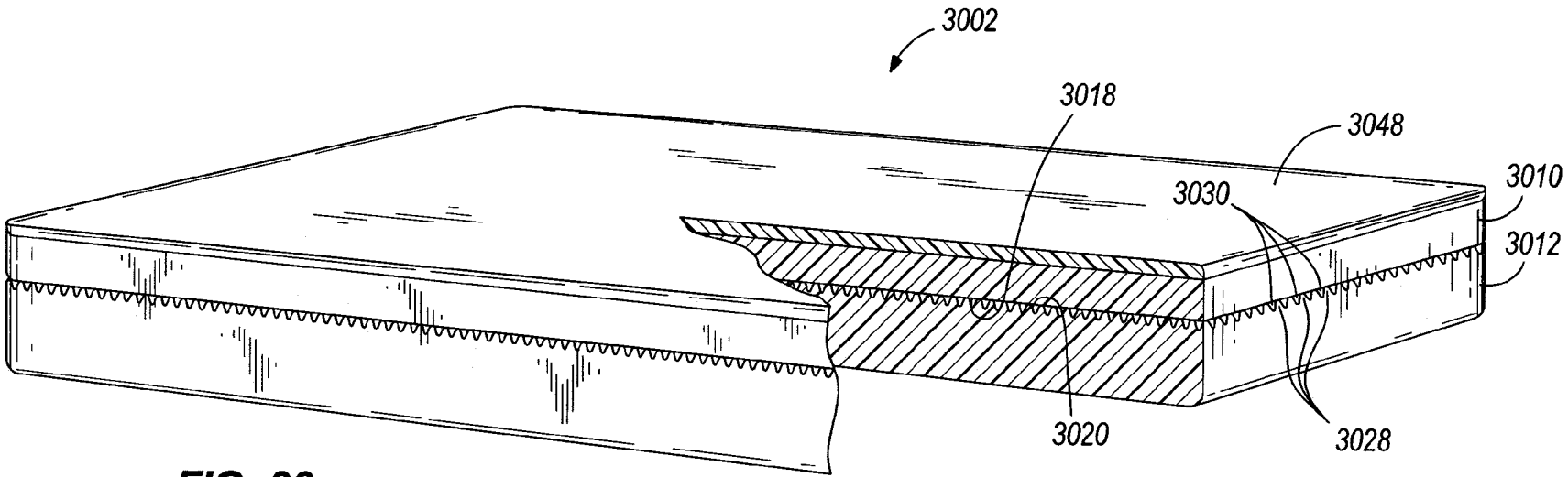

FIG. 30 illustrates another embodiment of a body support according to the present invention. This embodiment employs much of the same structure and has many of the same properties as the embodiments of the body support described above in connection with FIG. 29. Accordingly, the following description focuses primarily upon the structure and features that are different than the embodiments described above in connection with FIG. 29. Reference should be made to the description above in connection with FIG. 29 for additional information regarding the structure and features, and possible alternatives to the structure and features of the body support illustrated in FIG. 30 and described below. Structure and features of the embodiment shown in FIG. 30 that correspond to structure and features of the embodiment of FIG. 29 are designated hereinafter in the 3000 series of reference numbers.

Like the body support 2902 illustrated in FIG. 29, the body support 3002 illustrated in FIG. 30 has a top layer 3010 comprising reticulated visco-elastic foam, a bottom layer 3012 comprising flexible cellular polyurethane foam having a relatively high resilience, and a cover 3048 comprising reticulated non-visco-elastic foam. The reticulated visco-elastic foam and the relatively highly resilient flexible cellular foam of the top and bottom layers 3010, 3012, respectively, are described in greater detail above in connection with the embodiment illustrated in FIGS. 12 and 12A. The reticulated non-visco-elastic foam of the cover 3048 is described in greater detail above in connection with the embodiment illustrated in FIG. 13.

The reticulated non-visco-elastic foam cover 3048 of the body support 3002 illustrated in FIG. 30 can be selected to provide a heightened degree of fire resistance for the body support 3002, and can also function to dissipate heat (e.g., received from a user's body) from the adjacent first and/or second layers 3010, 3012 covered by the reticulated non-visco-elastic foam cover 3048. In this regard, the reticulated non-visco-elastic foam of the cover 3048 can be utilized to provide a layer of material that is less responsive or is substantially non-responsive to a user's body temperature (described in greater detail above in connection with the embodiment of FIG. 13), while still providing the ventilation and/or heat dissipation properties also described above.

The top surface 3020 of the bottom layer 3012 of the body support 3002 has a non-planar shape beneath the substantially planar bottom surface 3018 of the top layer 3010. The non-planar shape of the top surface 3020 can take any of the forms described above in connection with the non-planar top surface 420 of the bottom layer 412 in the body support 402 illustrated in FIG. 4, and can be defined by a plurality of protrusions 3028 and/or a plurality of apertures (not shown) as also described above. Passages 3030 can be defined between the substantially planar bottom surface 3018 of the top layer 3010 and the non-planar top surface 3020 of the bottom layer 3012. In other embodiments, such passages 3030 can be defined between a non-planar bottom surface 3018 of the top layer 3010 and a substantially planar top surface 3020 of the bottom layer 3012, or between a non-planar bottom surface 3018 of the top layer 3010 and a non-planar top surface 3020 of the bottom layer 3012, wherein the non-planar surface(s) can be defined in any of the manners described above in connection with the illustrated embodiment of FIG. 4.

Passages 3030 running between the top and bottom layers 3010, 3012 illustrated in FIG. 30 can supplement the ventilation and/or heat dissipative capabilities of the top layer 3010 of reticulated visco-elastic foam, and can prevent or reduce heat in the bottom layer 3012 of relatively highly resilient flexible cellular foam. In this regard, the skeletal structure of the reticulated visco-elastic foam cells in the top layer 3010 can enable heat to be transferred from the top layer 3010 to and through the passages 3030.

Figure 31:
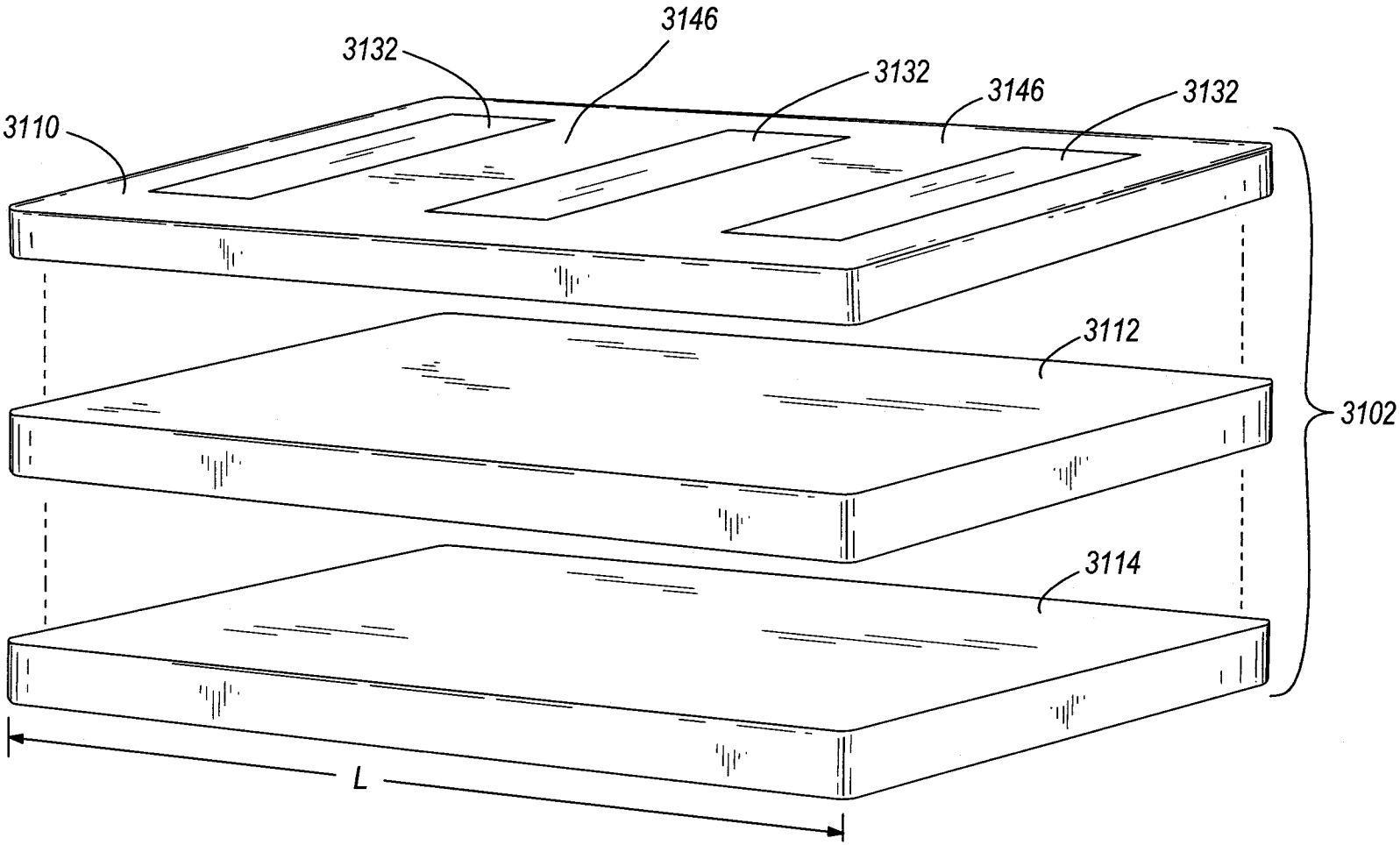
FIGS. 31-34 are exploded perspective views of body supports according to additional embodiments of the present invention.

FIG. 31 illustrates another embodiment of a body support according to the present invention. This embodiment employs much of the same structure and has many of the same properties as the embodiments of the body support described above in connection with FIG. 21. Accordingly, the following description focuses primarily upon the structure and features that are different than the embodiments described above in connection with FIG. 21. Reference should be made to the description above in connection with FIG. 21 for additional information regarding the structure and features, and possible alternatives to the structure and features of the body support illustrated in FIG. 31 and described below. Structure and features of the embodiment shown in FIG. 31 that correspond to structure and features of the embodiment of FIG. 21 are designated hereinafter in the 3100 series of reference numbers.

Like the body support 2102 illustrated in FIG. 21, the body support 3102 illustrated in FIG. 31 comprises a top layer 3110 of open or closed celled non-reticulated visco-elastic foam, a middle layer 3112 comprising reticulated visco-elastic foam, and a bottom layer 3114 comprising reticulated non-visco-elastic foam. However, the top layer 3110 further comprises portions of reticulated visco-elastic foam that can have the same or different properties as the reticulated visco-elastic foam in the middle layer 3112. The non-reticulated visco-elastic foam of the top layer 3110 is described in greater detail above in connection with the embodiment illustrated in FIG. 16. The reticulated visco-elastic foam of the top and middle layers 3110, 3112 is described in greater detail above in connection with the embodiment illustrated in FIGS. 12 and 12A. The reticulated non-visco-elastic foam of the bottom layer 3114 is described in greater detail above in connection with the embodiment illustrated in FIG. 13.

With continued reference to the illustrated embodiment of FIG. 31, the top layer 3110 has three portions 3132 comprising reticulated visco-elastic foam, each of which are surrounded by other portions 3146 of the top layer 3110 comprising the non-reticulated visco-elastic foam. In some embodiments, one or more of the three portions 3132 comprising reticulated visco-elastic foam can be disposed a distance from adjacent edges of the top layer 3110 by at least about 10 cm and by no greater than about 20 cm. In other embodiments, this distance can be at least about 10 cm and no greater than about 15 cm. It should be noted that this distance can be the same or different at different locations about any of the three portions 3132 comprising reticulated visco-elastic foam, and can be larger or smaller than that illustrated in FIG. 31.

Each of the three portions 3132 comprising reticulated visco-elastic foam described above can have any shape desired, such as rectangular (see FIG. 31), trapezoidal, triangular, and other polygonal shapes, round, oval, and other rotund shapes, hourglass, star, irregular, and other shapes. Also, the three portions 3132 comprising reticulated visco-elastic foam can have the same shape (see FIG. 31) or can have different shapes, and can have the same size (see FIG. 31) or can have different sizes.

The three portions 3132 comprising reticulated visco-elastic foam can be located in any positions in the top layer 3110. By way of example only, the three portions 3132 illustrated in FIG. 31 are located proximate areas of the body support 3102 where an adult user's head, buttocks, and lower legs would be located when the user is in a supine position on the body support 3102. In other embodiments, the top layer 3110 can have one or more portions 3132 of reticulated visco-elastic foam located in any other position in the top layer 3110, such as two portions 3132 of reticulated visco-elastic foam located proximate the head and buttocks of a user, a single portion 3132 of reticulated visco-elastic foam located proximate the head and/or shoulders of a user, four portions 3132 of reticulated visco-elastic foam located proximate the head, back, buttocks, and legs of a user, and the like. In some embodiments, the reticulated visco-elastic foam portion(s) 3132 are located proximate areas that correspond to those areas of a user's body on the body support 3102 that experience the highest pressure when the user is lying on the body support 3102 in an orientation substantially aligned with the length L of the body support 3102.

The three portions 3132 comprising reticulated visco-elastic foam in the illustrated embodiment of FIG. 31 are each surrounded by the non-reticulated visco-elastic foam of the top layer 3110. However, in other embodiments, one or more sides of one or more of the portions 3132 are open to a side or end of the top layer 3110, or are otherwise not separated from a side or end of the top layer 3110 by the non-reticulated visco-elastic foam.

With continued reference to the illustrated embodiment of FIG. 31, the non-reticulated visco-elastic foam in the top layer 3110 can provide the desirable softness, body-conforming, and pressure-distributing features described above in connection with the illustrated embodiment of FIG. 21. The portions 3132 of the top layer 3110 comprising reticulated visco-elastic foam can provide a significant degree of ventilation and/or heat dissipation for areas of the top layer 3110 adjacent the user's body that could experience the greatest pressure and heat from the user's body. These capabilities can supplement the ventilation and/or heat dissipation provided by the reticulated visco-elastic and reticulated non-visco-elastic foams of the middle and bottom layers 3112, 3114 described above in connection with the embodiment of FIG. 21. Also, the visco-elastic properties of these portions 3132 can still provide a relatively high degree of softness, body-conforming, and pressure-distribution for the user's body.

The top layer 3110 illustrated in FIG. 31 comprises three portions 3132 comprising reticulated visco-elastic foam surrounded by other portions 3146 comprising non-reticulated visco-elastic foam. In other embodiments, the materials of these portions 3132, 3146 can be reversed, such that one or more portions comprising non-reticulated visco-elastic foam are at least partially surrounded by other portions comprising reticulated visco-elastic foam. In such embodiments, the softness, body-conforming, and pressure-distributing features of the "islands" comprising non-reticulated visco-elastic foam can be located proximate those areas of a user's body that could experience the greatest pressure and heat from the user's body. The surrounding portions comprising reticulated visco-elastic foam can also provide a degree of softness, body-conforming, and pressure-distribution while also functioning to prevent or reduce heat in the top layer 3110 by virtue of the skeletal structure of the reticulated visco-elastic foam.

Figure 32:
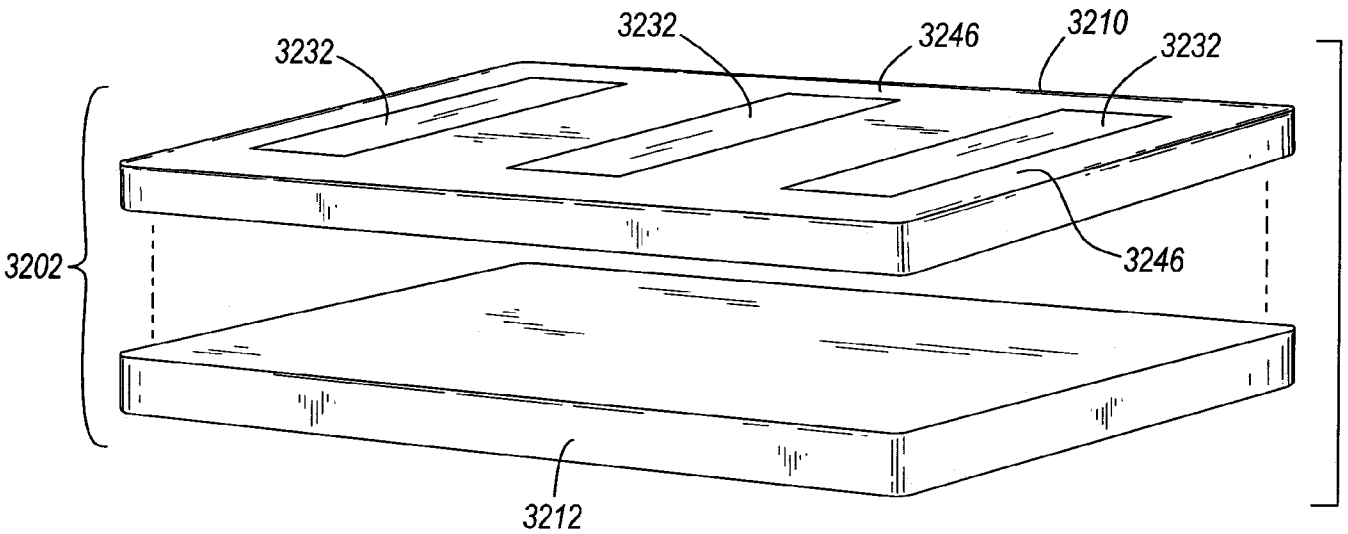

FIG. 32 illustrates another embodiment of a body support according to the present invention. This embodiment employs much of the same structure and has many of the same properties as the embodiments of the body support described above in connection with FIG. 13. Accordingly, the following description focuses primarily upon the structure and features that are different than the embodiments described above in connection with FIG. 13. Reference should be made to the description above in connection with FIG. 13 for additional information regarding the structure and features, and possible alternatives to the structure and features of the body support illustrated in FIG. 32 and described below. Structure and features of the embodiment shown in FIG. 32 that correspond to structure and features of the embodiment of FIG. 13 are designated hereinafter in the 3200 series of reference numbers.

Like the body support 1302 illustrated in FIG. 13, the body support 3202 illustrated in FIG. 32 comprises a top layer 3210 comprising reticulated visco-elastic foam and a bottom layer 3212 comprising reticulated non-visco-elastic foam. However, the top layer 3210 further comprises portions of open or closed celled non-reticulated visco-elastic foam. The reticulated visco-elastic foam of the top layer 3210 is described in greater detail above in connection with the embodiment illustrated in FIGS. 12 and 12A. The non-reticulated visco-elastic foam of the top layer 3210 is described in greater detail above in connection with the embodiment illustrated in FIG. 16. The reticulated non-visco-elastic foam of the bottom layer 3212 is described in greater detail above in connection with the embodiment illustrated in FIG. 13.

With continued reference to the illustrated embodiment of FIG. 32, the top layer 3210 has three portions 3232 comprising non-reticulated visco-elastic foam, each of which is surrounded by other portions 3246 of the top layer 3210 comprising the reticulated visco-elastic foam. The three portions 3232 comprising non-reticulated visco-elastic foam illustrated in FIG. 32 are each substantially rectangular, are spaced from one another along the length of the top layer 3210, and are spaced from the edges of the top layer 3210. However, the three portions 3232 can have any other shape and size as described above in connection with the illustrated embodiment of FIG. 31. Also, the top layer 3210 can have any number of such portions 3232 located in any of the manners described above in connection with the illustrated embodiment of FIG. 31.

With continued reference to the illustrated embodiment of FIG. 32, the non-reticulated visco-elastic foam in the three portions 3232 of the top layer 3110 can provide in such areas the desirable softness, body-conforming, and pressure-distributing features described above in connection with the illustrated embodiment of FIG. 16. The surrounding portions 3246 of the top layer 3210 comprising reticulated visco-elastic foam can provide significant ventilation and/or heat dissipation to the three portions 3232 adjacent the user's body, and can draw heat from internal areas of the top layer 3210 toward the edges of the top layer 3210. Such ventilation and/or heat dissipation can supplement the ventilation and/or heat dissipation provided by the reticulated non-visco-elastic foam of the bottom layer 3212 described above in connection with the embodiment of FIG. 13. Also, the visco-elastic properties of the surrounding portions 3246 can still provide a relatively high degree of softness, body-conforming, and pressure-distribution for the user's body.

Figure 33:
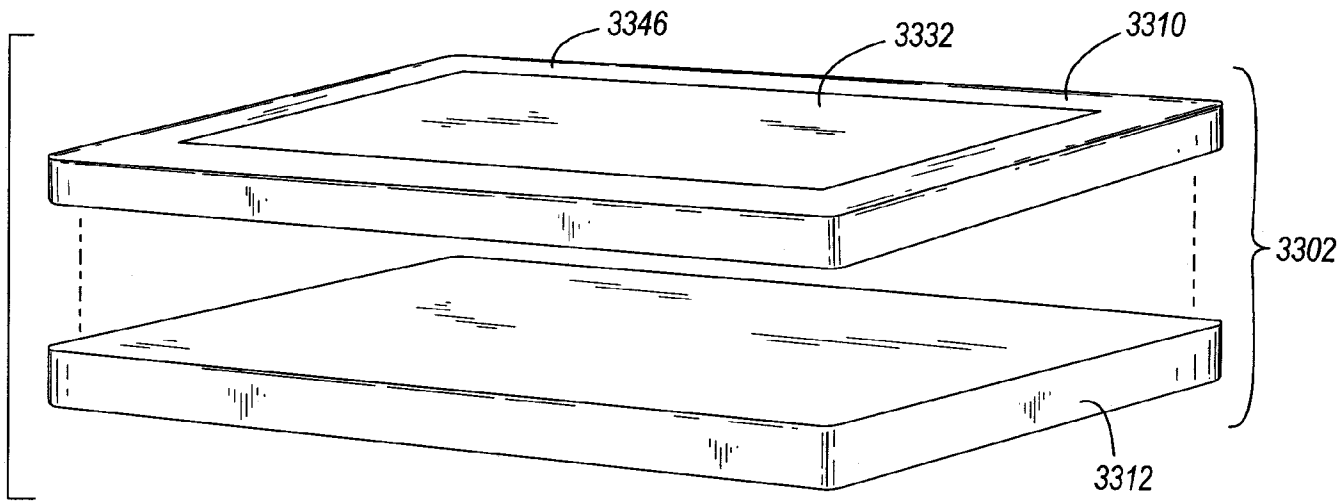

FIG. 33 illustrates another embodiment of a body support according to the present invention. This embodiment employs much of the same structure and has many of the same properties as the embodiments of the body support described above in connection with FIG. 31. Accordingly, the following description focuses primarily upon the structure and features that are different than the embodiments described above in connection with FIG. 31. Reference should be made to the description above in connection with FIG. 31 for additional information regarding the structure and features, and possible alternatives to the structure and features of the body support illustrated in FIG. 33 and described below. Structure and features of the embodiment shown in FIG. 33 that correspond to structure and features of the embodiment of FIG. 31 are designated hereinafter in the 3300 series of reference numbers.

Like the body support 3102 illustrated in FIG. 31, the body support 3302 illustrated in FIG. 33 comprises a top layer 3310 having a combination of open or closed celled non-reticulated visco-elastic foam (portion 3346) and reticulated visco-elastic foam (portion 3332). However, the body support 3302 illustrated in FIG. 33 has a bottom layer 3312 comprising flexible cellular polyurethane foam having a relatively high resilience, rather than the layers of reticulated visco-elastic and reticulated non-visco-elastic foam in the embodiment of FIG. 31. The non-reticulated visco-elastic foam of the top layer 3310 is described in greater detail above in connection with the embodiment illustrated in FIG. 16. The reticulated visco-elastic foam of the top layer 3310 is described in greater detail above in connection with the embodiment illustrated in FIGS. 12 and 12A. The relatively highly resilient flexible cellular foam of the bottom layer 3312 is also described in greater detail above in connection with the embodiment illustrated in FIGS. 12 and 12A.

The top layer 3310 illustrated in FIG. 33 includes a border 3346 comprising the non-reticulated visco-elastic foam, which extends fully around a portion 3332 of the top layer 3310 comprising the reticulated visco-elastic foam. The border 3346 can extend fully around the portion 3332 comprising the reticulated visco-elastic foam as shown in FIG. 33, or can extend partially about the portion 3332 comprising the reticulated visco-elastic foam (e.g., having portions flanking the first portion 3332 as described above with reference to the bottom layer 712 of the embodiment of FIG. 7, or having one or more portions shaped and located in any of the manners described above in connection with the bottom layer 712 in the illustrated embodiment of FIG. 7). In short, any number of portions 3332 comprising the reticulated visco-elastic foam and any number of borders 3346 comprising the non-reticulated visco-elastic foam can have any of the shapes, positions, and arrangements described above in connection with the bottom layer 712 in the illustrated embodiment of FIG. 7.

With continued reference to the illustrated embodiment of FIG. 33, the non-reticulated visco-elastic foam in the top layer 3310 can provide the desirable softness, body-conforming, and pressure-distributing features described above (in connection with the illustrated embodiment of FIG. 19) along the periphery of the top layer 3310, such as in locations where a user enters or exits the body support (e.g., in mattress applications). The portion 3332 of the top layer 3310 comprising reticulated visco-elastic foam can provide ventilation and/or heat dissipation for an interior area of the top layer 3310 upon which a user will most likely rest for a prolonged period of time, and to which a user's body heat would most likely be transferred. The ventilation and heat dissipative properties of the reticulated visco-elastic foam in the top layer 3310 can also reduce heat in the underlying layer of relatively highly resilient flexible cellular foam (which can be used to provide additional support, and a relatively stiff but flexible and resilient substrate beneath the top layer 3310).

As described above, the top layer 3310 illustrated in FIG. 33 includes an interior portion 3332 comprising reticulated visco-elastic foam surrounded by other portions 3346 comprising non-reticulated visco-elastic foam. In other embodiments, the materials of these portions 3332, 3346 can be reversed, such that one or more portions comprising non-reticulated visco-elastic foam are at least partially surrounded by one or more other portions comprising reticulated visco-elastic foam. Such alternative embodiments and their features and characteristics are described in greater detail above in connection with the illustrated embodiment of FIG. 31.

Figure 34:
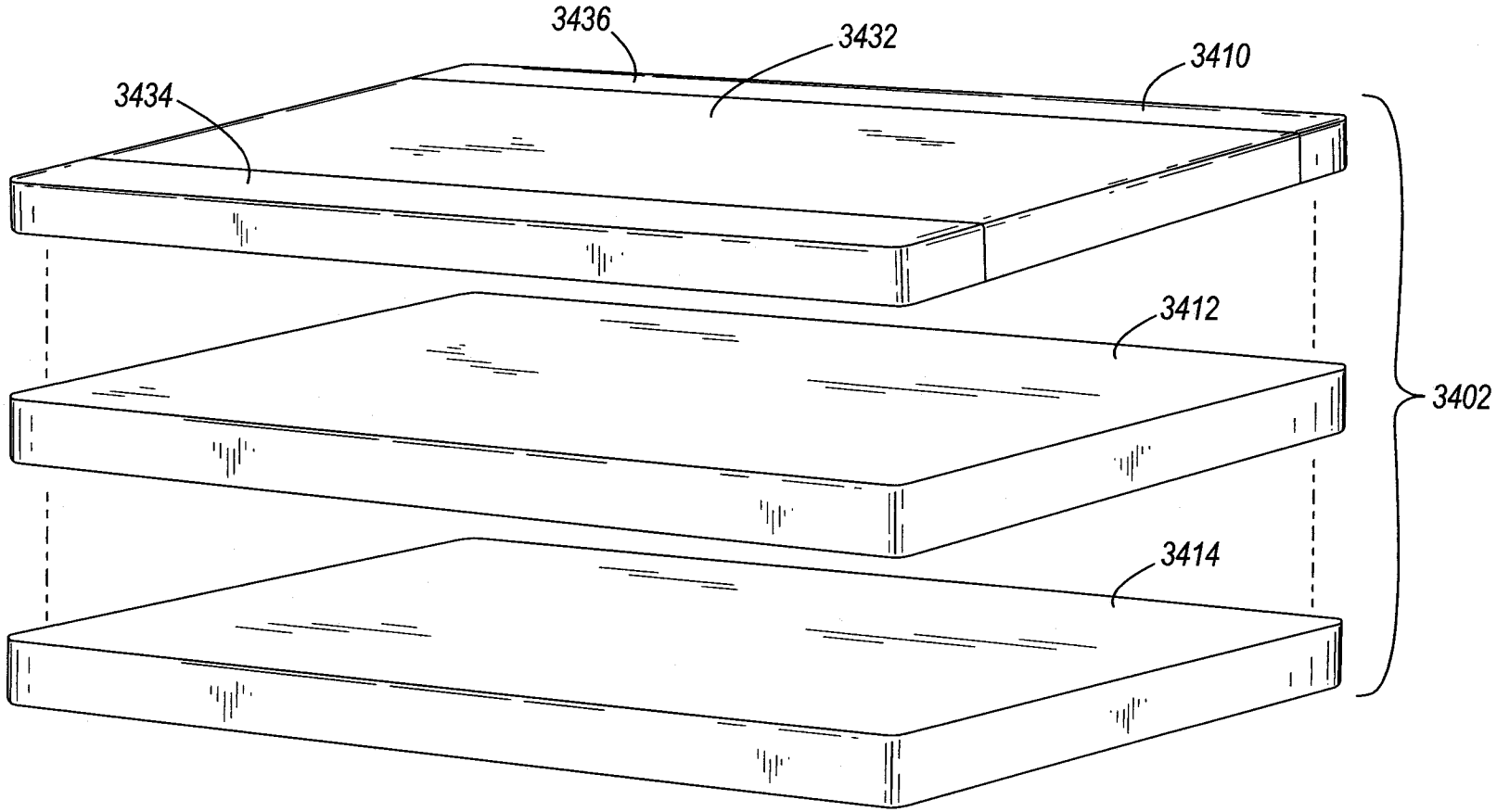

FIG. 34 illustrates another embodiment of a body support according to the present invention. This embodiment employs much of the same structure and has many of the same properties as the embodiments of the body support described above in connection with FIG. 31. Accordingly, the following description focuses primarily upon the structure and features that are different than the embodiments described above in connection with FIG. 31. Reference should be made to the description above in connection with FIG. 31 for additional information regarding the structure and features, and possible alternatives to the structure and features of the body support illustrated in FIG. 34 and described below. Structure and features of the embodiment shown in FIG. 34 that correspond to structure and features of the embodiment of FIG. 31 are designated hereinafter in the 3400 series of reference numbers.

Like the body support 3102 illustrated in FIG. 31, the body support 3402 illustrated in FIG. 34 comprises a top layer 3410 having a combination of open or closed celled non-reticulated visco-elastic foam (portion 3432) and reticulated visco-elastic foam (portions 3434, 3436), and a middle layer 3412 comprising reticulated visco-elastic foam. However, the body support 3402 illustrated in FIG. 34 has a bottom layer 3414 comprising flexible cellular polyurethane foam having a relatively high resilience, rather than a layer of reticulated non-visco-elastic foam (as in the embodiment of FIG. 31). The non-reticulated visco-elastic foam of the top layer 3410 is described in greater detail above in connection with the embodiment illustrated in FIG. 16. The reticulated visco-elastic foam of the top and middle layers 3410, 3412 is described in greater detail above in connection with the embodiment illustrated in FIGS. 12 and 12A. The relatively highly resilient flexible cellular foam of the bottom layer 3414 is also described in greater detail above in connection with the embodiment illustrated in FIGS. 12 and 12A.

The portions 3434, 3436 of reticulated visco-elastic foam illustrated in FIG. 34 define side borders of the top layer 3410, and can have any of the shapes, sizes, and locations described above with reference to the second and third portions 734, 736 of the bottom layer 712 illustrated in FIG. 7. The non-reticulated visco-elastic foam portion 3432 of the top layer 3410 can provide the desirable softness, body-conforming, and pressure-distributing features described above in connection with the illustrated embodiment of FIG. 16. The portions 3434, 3436 of reticulated visco-elastic foam of the top layer 3410 can provide a degree of ventilation and/or heat dissipation for the interior portion 3432 adjacent the user's body, and can draw heat from internal areas of the top layer 3410 toward the sides and ends of the top layer 3410. Such ventilation and/or heat dissipation can supplement the ventilation and/or heat dissipation provided by the reticulated visco-elastic foam of the middle layer 3412. Also, the visco-elastic properties of the portions 3434, 3436 of reticulated visco-elastic foam can still provide a relatively high degree of softness, body-conforming, and pressure-distribution for the user's body at the sides of the top layer 3410 (e.g., in locations where a user may enter or exit the body support 3420, such as in mattress applications).

The ventilation and heat dissipative properties of the reticulated visco-elastic foam in the portions 3434, 3436 of the top layer 3310 and in the middle layer 3412 can also reduce heat in the bottom layer 3414 of relatively highly resilient flexible cellular foam (which can be used to provide additional support, and a relatively stiff but flexible and resilient substrate upon which the top and middle layers 3410, 3412 lie).

As described above, the top layer 3410 illustrated in FIG. 34 includes an interior portion 3432 comprising non-reticulated visco-elastic foam flanked by portions 3434, 3436 comprising reticulated visco-elastic foam. In other embodiments, the materials of these portions 3432 and 3434, 3436 can be reversed. Such alternative embodiments can therefore include a portion of reticulated visco-elastic foam flanked by and providing ventilation and/or heat dissipation to adjacent portions of non-reticulated visco-elastic foam.

One or more of the layers of material in each of the body support embodiments described above can comprise material in slab or block form. For example, each of the illustrated layers of material in FIGS. 1-34 is illustrated as a sheet of foam. In this regard, any or all of such layers in any of the embodiments can each be defined by a single, continuous, and unbroken sheet of material. Alternatively, one or more of such layers can be defined by two or more pieces of material coupled in any suitable manner, such as by adhesive or cohesive bonding material, double-sided tape, stitching, hot-melting, conventional fasteners, by being molded together in one or more manufacturing processes, or in any other suitable manner. Such pieces of material can have any shape and size desired, such as blocks, strips, pads, or balls, pieces having polygonal, curvilinear, irregular, or other shapes, and the like. Also, such pieces of material can be identical to or different from one another in shape and/or size.

In some embodiments, one or more of the layers of material in any of the body support embodiments described above and illustrated in FIGS. 1-34 comprise pieces of material that are not coupled together. For example, any one or more of such layers can include loose pieces of material having any shape and size as described above, wherein the pieces are partially or entirely enclosed and contained within one or more layers of material. In such embodiments, the enclosing layer(s) of material can comprise synthetic and/or natural fabric, cloth, or other sheet material. In some embodiments, the enclosing layer(s) can have one or more seams attached by adhesive or cohesive bonding material, double-sided tape, stitching, hot-melting, conventional fasteners (e.g., zippers, buttons, clasps, laces, hook and loop fastener material, hook and eye sets, tied ribbons, strings, cords, or other similar elements, and the like), by being molded together in one or more manufacturing processes, or in any other suitable manner. One or more of such enclosing layers can also partially or entirely enclose and contain layers comprising pieces of material coupled together as described above.

Figure 35:
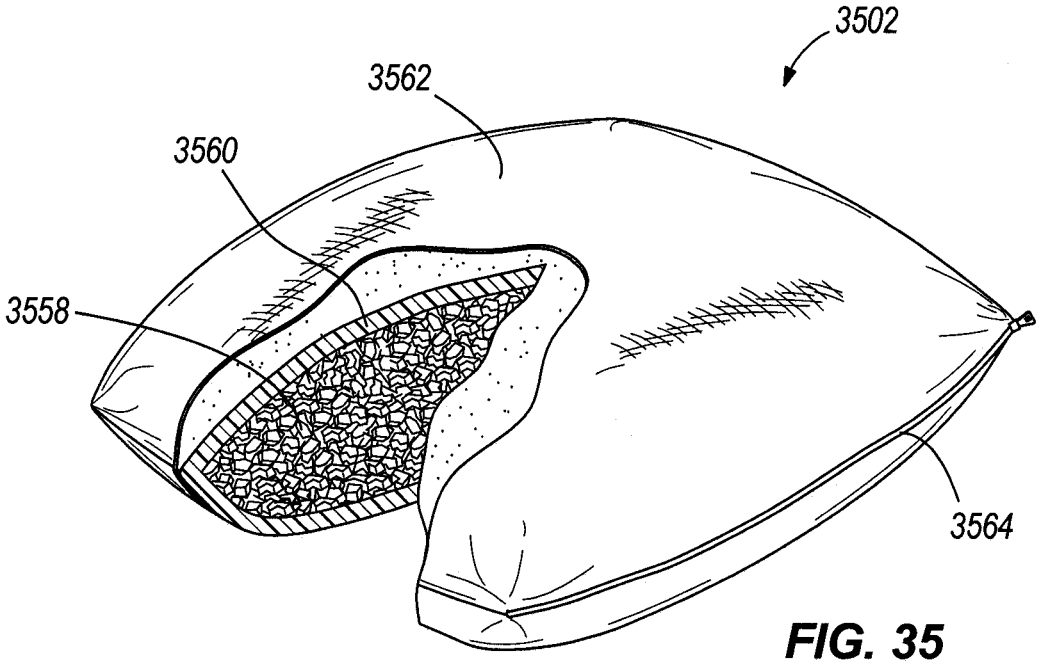
FIG. 35 is a sectioned perspective view of a pillow according to an embodiment of the present invention.

An example of a body support 3502 comprising pieces of material within one or more enclosing layers is illustrated in FIG. 35. The body support 3502 illustrated in FIG. 35 is in the shape of a pillow, although it should be noted that the body support 3502 can take any other shape and have any other size for any other body support application (e.g., mattresses, mattress toppers, overlays, futons, seat cushions, seat backs, neck pillows, leg spacer pillows, eye masks, and any other shape and size suitable for supporting or cushioning any part or all of a human or animal body).

The body support 3502 illustrated in FIG. 35 comprises filler material 3558 surrounded by an enclosing layer of material 3560. The filler material 3558 illustrated in FIG. 35 includes separate pieces of material that are not coupled together, although in other embodiments some or all of the pieces can be coupled to adjacent pieces (such as separate pieces coupled together in one or more manufacturing processes as described above). In some embodiments, the filler material 3558 comprises a plurality of pieces of non-reticulated visco-elastic foam having any of the material properties described above in connection with the material of top layer 110 in the illustrated body support 102 of FIG. 1. The body supports 3502 of these embodiments can therefore provide significant softness and can conform to a user's body, and in some cases can provide a greater degree of body support deformability due to the multiple-piece construction of the body support 3502. Such deformability can be desirable in many applications, such as in pillows and cushions adapted to support portions of a user's body, by way of example only. Also, the temperature sensitivity of body supports 3502 having non-reticulated visco-elastic filler material 3558 can enable the body support to better adapt to a user's body (as described in greater detail above in connection with the non-reticulated visco-elastic material utilized in the embodiment of FIGS. 1-1B), thereby distributing pressure and increasing user comfort.

With continued reference to the illustrated embodiment of FIG. 35, the pieces of non-reticulated visco-elastic foam in the filler material 3558 can be produced by shredding or cutting non-reticulated visco-elastic foam, whether in virgin, recycled, or scrap form. Alternatively, the pieces of non-reticulated visco-elastic foam can be produced by molding the individual pieces or in any other manner.

As described above, the pieces of non-reticulated visco-elastic foam in the filler material 3558 can have any size and shape desired. However, in some embodiments, these pieces have an average largest dimension of no greater than about 4 cm and/or no less than about 0.3 cm. In other embodiments, the pieces have an average largest dimension of no greater than about 2 cm and/or no less than about 0.6 cm. In still other embodiments, the pieces have an average largest dimension of about 1.3 cm.

The filler material 3558 of the body support 3502 illustrated in FIG. 35 can be varied to change the characteristics and/or cost of the body support 3502. For example, substantially all of the filler material 3558 can comprise unconnected pieces of non-reticulated visco-elastic foam as described above, or can comprise a combination of such pieces and pieces of another material (e.g., cotton, synthetic or organic fiber material, feathers, another type of foam material, polystyrene balls, and the like). In this regard, the filler material 3558 of the body support 3502 can comprise no less than about 20% non-reticulated visco-elastic foam pieces in some embodiments. In other embodiments, the filler material 3558 of the body support 3502 comprises no less than about 30% non-reticulated visco-elastic foam pieces. In still other embodiments, the filler material 3558 of the body support 3502 comprises no less than about 50% non-reticulated visco-elastic foam pieces. The density and other characteristics of the other material (if any) in the filler material 3558 can help to define the density and other characteristics of the filler material 3558.

As described above, the filler material 3558 in the illustrated embodiment of FIG. 35 is surrounded by an enclosing layer of material 3560, which can have one or more seams coupled together as described in greater detail above. In some embodiments, the enclosing layer 3560 comprises reticulated non-visco-elastic foam having any of the material properties described above in connection with the material of the bottom layer 112 in the illustrated body support 102 of FIG. 1. The enclosing layer 3560 can have any thickness desired. In some embodiments, the enclosing layer 3560 of reticulated non-visco-elastic foam has a thickness of no less than about 5 mm and/or no greater than about 20 mm. Relatively lightweight body supports in some embodiments can have a thickness of no greater than about 7 mm, while relatively heavy weight body supports in some embodiments can have a thickness of no less than about 13 mm.

With continued reference to the body support 3502 illustrated in FIG. 35, the enclosing layer 3560 of non-visco-elastic foam can provide a significant degree of ventilation and/or heat dissipation for the body support 3502, and can prevent or reduce heat in the filler material 3558 of the body support 3502.

In some embodiments, the enclosing layer 3560 of the body support 3502 is partially or entirely covered with one or more reinforcing fabric layers (not shown), which in some embodiments can act as an anchor for stitches or other fastening elements securing portions of the enclosing layer 3560 together (e.g., at seams of the enclosing layer 3560), thereby reducing the opportunity for stitches or other fastening elements to rip or tear through the enclosing layer 3560. If employed, the reinforcing fabric layer(s) can comprise cotton, polyester, a cotton/polyester blend, wool, or any other fabric material.

A cover 3562 can at least partially surround the enclosing layer 3560 and filler material 3558 of the body support 3502, can be removable from the rest of the body support 3502, and in some embodiments can conform to the shape of the body support 3502. The cover 3562 can comprise any fabric material, such as a cotton, polyester, cotton/polyester blend, wool, and the like. Also, the cover 3562 can have one or more closure devices 3564, such as one or more zippers (see FIG. 35), snaps, buttons, clasps, laces, pieces of hook and loop fastener material, hook and eye sets, overlapping flaps, tied ribbons, strings, cords, or other similar elements, and the like, in order to retain the enclosing layer 3560 and filler material 3558 within the cover 3562.

As described above, the enclosing layer 3560 of the body support 3502 illustrated in FIG. 35 comprises reticulated non-visco-elastic foam, which can provide any of the features also described above. In other embodiments, all or part of the enclosing layer 3560 can comprise reticulated visco-elastic foam having any of the enclosing layer thicknesses described above, and having any of the material properties described above in connection with the material of the top layer 1210 in the illustrated body support 1202 of FIG. 12. An enclosing layer 3560 comprising reticulated visco-elastic material can have an improved ability to conform to a user's body while still providing a significant degree of ventilation and/or heat dissipation for the body support 3502, and can prevent or reduce heat in the filler material 3558 of the body support 3502. In this regard, such an enclosing layer 3560 can be temperature-sensitive to a user's body heat, thereby better enabling the enclosing layer 3560 to perform the body-conforming function described above.

As described above, the illustrated body support 3502 can comprise non-reticulated visco-elastic filler material 3558 at least partially surrounded by one or more enclosing layers 3560 of reticulated visco-elastic or reticulated non-visco-elastic foam as described above. In alternative embodiments, the filler material 3558 can instead or also include a plurality of unconnected reticulated non-visco-elastic foam pieces having any of the size and shape properties described above with reference to the non-reticulated visco-elastic foam filler material 3558 illustrated in FIG. 35. Such reticulated non-visco-elastic foam pieces can be produced in any of the manners described above in connection with the non-reticulated visco-elastic foam filler material 3558 illustrated in FIG. 35, can define any part of the filler material 3558 of the body support 3502 in combination with any of the other filler materials as also described above, or can define all of the filler material 3558 of the body support 3502. Also, such reticulated non-visco-elastic foam pieces can have any of the material properties described above in connection with the material of the bottom layer 112 in the illustrated body support 102 of FIG. 1.

The construction of a body support 3502 with filler material 3558 comprising pieces of reticulated non-visco-elastic foam within an enclosing layer 3560 of reticulated visco-elastic or reticulated non-visco-elastic foam as described above can provide a relatively high degree of ventilation in and through the filler material 3558 as well as the enclosing layer 3560. This construction can also enable heat to be rapidly dissipated from the body support 3502, thereby preventing or reducing heat in areas of the body support 3502. In those applications in which the temperature-sensitive, body-conforming, and pressure distribution properties of visco-elastic foam are desired on or immediately adjacent the exterior of the body support 3502, the enclosing layer 3560 can comprise reticulated visco-elastic foam. Alternatively, if such features are instead desired only in the interior of the body support 3502 (e.g., to provide an exterior that is less subject to change, such as resulting from a user's body heat), the enclosing layer 3560 can comprise reticulated non-visco-elastic foam.

In other embodiments of the present invention, the body support illustrated in FIG. 35 can comprise one or more enclosing layers 3560 of reticulated visco-elastic or reticulated non-visco-elastic foam (as described above) at least partially surrounding filler material comprising a plurality of unconnected reticulated visco-elastic foam pieces. The reticulated visco-elastic foam pieces can have any of the size and shape properties described above with reference to the non-reticulated visco-elastic foam filler material 3558 illustrated in FIG. 35. Such reticulated visco-elastic foam pieces can be produced in any of the manners described above in connection with the non-reticulated visco-elastic foam filler material 3558 illustrated in FIG. 35, can define any part of the filler material 3558 of the body support 3502 in combination with any of the other filler materials as also described above, or can define all of the filler material 3558 of the body support 3502. Also, such reticulated visco-elastic foam pieces can have any of the material properties described above in connection with the material of the top layer 1210 in the illustrated body support 1202 of FIG. 12.

The construction of a body support 3502 with filler material 3558 comprising pieces of reticulated visco-elastic foam within an enclosing layer 3560 of reticulated visco-elastic or reticulated non-visco-elastic foam as described above can provide a relatively high degree of ventilation in and through the filler material 3558 as well as the enclosing layer 3560, while still providing the desirable temperature-sensitivity, body-conforming, and pressure distribution properties of the visco-elastic filler material (and visco-elastic enclosing layer, if used) as described in greater detail above in connection with the body support 1202 of FIGS. 12 and 12A. This construction can also enable heat to be rapidly dissipated from the body support 3502, thereby preventing or reducing heat in areas of the body support 3502. As described above, in those applications in which the temperature-sensitive, body-conforming, and pressure distribution properties of visco-elastic foam are desired on or immediately adjacent the exterior of the body support 3502, the enclosing layer 3560 can comprise reticulated visco-elastic foam. Alternatively, if such features are instead desired only in the interior of the body support 3502 (e.g., to provide an exterior that is less subject to change, such as resulting from a user's body heat), the enclosing layer 3560 can comprise reticulated non-visco-elastic foam.

In still other embodiments of the present invention, the reticulated visco-elastic or reticulated non-visco-elastic enclosing layer 3560 of the body support 3502 illustrated in FIG. 35 and described above can be replaced by a non-reticulated visco-elastic enclosing layer 3560 at least partially enclosing pieces of unconnected reticulated visco-elastic or reticulated non-visco-elastic foam (also described above). The non-reticulated visco-elastic enclosing layer 3560 can have any of the enclosing layer thicknesses described above, and can have any of the material properties described above in connection with the material of the top layer 110 in the illustrated body support 102 of FIG. 1. A non-reticulated visco-elastic enclosing layer 3560 can provide a high degree of softness and user comfort, while also providing the desirable temperature-sensitivity, body-conforming, and pressure distribution properties described above in connection with the material of the top layer 110 in the illustrated body support 102 of FIG. 1. The pieces of reticulated visco-elastic or reticulated non-visco-elastic foam within such an enclosing layer 3560 can help to dissipate heat within the body support 3502, thereby reducing heat in one or more areas of the body support 3502.

Figure 36:
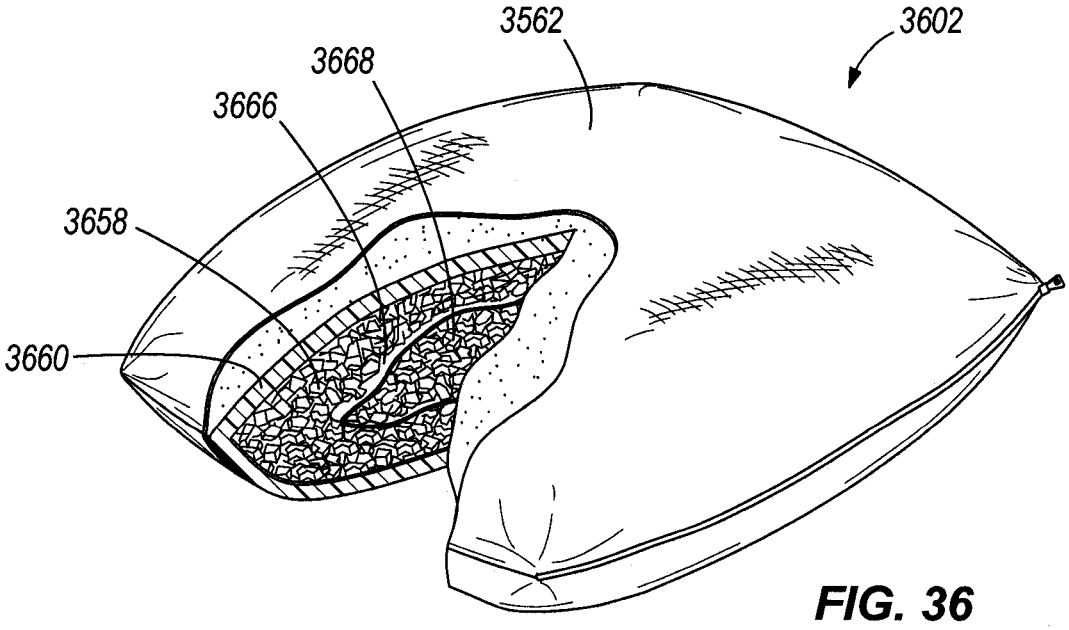
FIG. 36 is a sectioned perspective view of a pillow according to another embodiment of the present invention.

FIG. 36 illustrates another embodiment of a body support according to the present invention. This embodiment employs much of the same structure and has many of the same properties as the embodiments of the body support described above in connection with FIG. 35. Accordingly, the following description focuses primarily upon the structure and features that are different than the embodiments described above in connection with FIG. 35. Reference should be made to the description above in connection with FIG. 35 for additional information regarding the structure and features, and possible alternatives to the structure and features of the body support illustrated in FIG. 36 and described below. Structure and features of the embodiment shown in FIG. 36 that correspond to structure and features of the embodiment of FIG. 35 are designated hereinafter in the 3600 series of reference numbers.

Like the body support embodiments described above in connection with the body support 3502 illustrated in FIG. 35, the body support 3602 illustrated in FIG. 36 comprises filler material 3658 surrounded by an enclosing layer of material 3660. However, the body support 3602 can also include a pocket 3666 of additional filler material 3668 comprising pieces of reticulated visco-elastic material. In the illustrated embodiment of FIG. 36, these pieces of material are unconnected, can be produced in any of the manners described above in connection with the embodiment of FIG. 35, and can have any of the material properties, shapes, and sizes also described above in connection with the embodiment of FIG. 35. In other embodiments, some or all of the pieces of reticulated visco-elastic material are connected to one another.

The pocket 3666 of additional filler material 3668 can be at least partially defined by fabric or other sheet material within which the reticulated visco-elastic pieces are located. In this regard, the pocket 3666 can have any of the forms described above with reference to the enclosing layer of material 3560 of FIG. 35, and can be connected to the enclosing layer of material 3660 in any of the manners described above with reference to the construction of seams in the embodiment of FIG. 35. In other embodiments, the material at least partially defining the pocket 3666 is not connected to any other portion of the body support 3602, although is still contained within the enclosing layer of material 3660.

Using the body support construction illustrated in FIG. 36, the pieces of reticulated visco-elastic filler material 3668 can be kept from mixing with the surrounding filler material 3658 contained within the enclosing layer 3660 of the body support 3602. Such a construction can be desirable in those embodiments in which the surrounding filler material 3658 is different than the filler material 3668 within the pocket 3666, such as when the surrounding filler material 3658 comprises non-reticulated visco-elastic foam pieces or reticulated non-visco elastic foam pieces. In some of these examples, the surrounding filler material 3658 can still provide the desirable softness, body-conforming, and pressure distribution features within the body support 3602, while the reticulated visco-elastic foam pieces within the pocket 3666 provide a region within the body support 3602 capable of providing ventilation between different internal areas of the body support 3602 and/or dissipating heat within the body support 3602. These functions can be performed regardless of whether the enclosing layer 3660 comprises non-reticulated visco-elastic material, reticulated visco-elastic material, or reticulated non-visco-elastic material (all of which can be utilized in the enclosing layer 3660, as described above).

The reticulated visco-elastic filler material 3668 within the pocket 3666 of the body support 3602 illustrated in FIG. 36 can function to provide ventilation and/or to dissipate heat within the body support 3602 (as just described) while still being responsive to a user's body heat, and while still providing the body-conforming and pressure distribution functions by virtue of the visco-elastic nature of the filler material 3668. In other embodiments, the filler material 3668 within the pocket 3666 can instead comprise connected or unconnected reticulated non-visco-elastic foam pieces. Such pieces can be produced in any of the manners described above in connection with the embodiment of FIG. 35, and can have any of the material properties, shapes, and sizes also described above in connection with the embodiment of FIG. 35. By employing non-reticulated visco-elastic foam for the pieces of filler material 3668 within the pocket 3666, the stiffness of the body support 3602 can be less sensitive to a user's body heat while still performing the ventilating and/or heat dissipating function described above.

Figure 37:
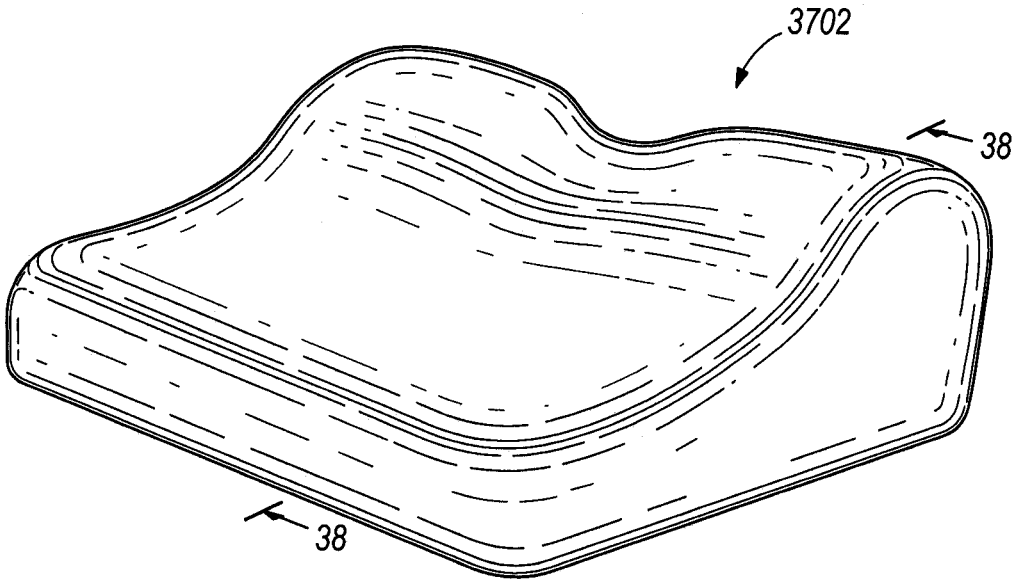
FIG. 37 is a perspective view of a pillow according to another embodiment of the present invention.
Figure 38:
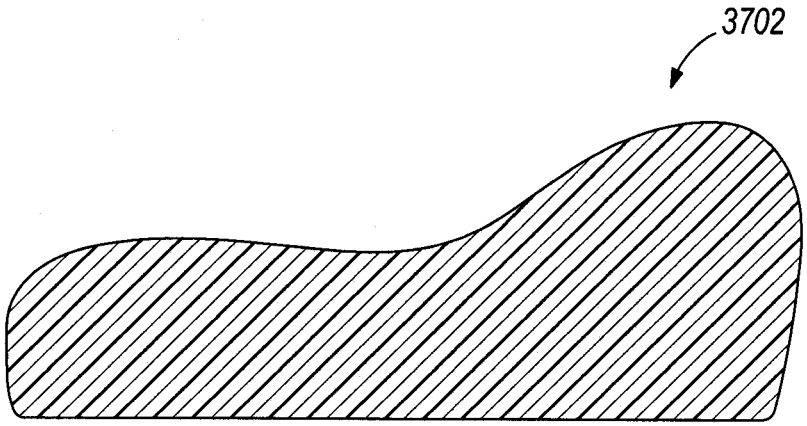
FIG. 38 is a cross-sectional view of the pillow illustrated in FIG. 37, taken along lines 38-38 of FIG. 37.

Another embodiment of a body support according to the present invention is illustrated in FIGS. 37 and 38. The body support 3702 illustrated in FIGS. 37 and 38 is a pillow having a contoured shape. However, the body support 3702 can have any other pillow shape desired. The body support 3702 can comprise a single piece of reticulated visco-elastic foam manufactured by molding or in any other suitable manner. In other embodiments, the body support 3702 can be defined by two or more pieces of reticulated visco-elastic foam connected in any of the manners described above with reference to multi-piece foam layer construction. The reticulated visco-elastic foam of the body support 3702 can have any of the material properties described above in connection with the material of the top layer 1210 in the illustrated body support 1202 of FIG. 12.

The body support 3702 illustrated in FIGS. 37 and 38 can provide support for a user while still conforming to a user's body (e.g., head and neck) based upon the visco-elastic nature of the body support material. Accordingly, the reticulated visco-elastic material of the body support 3702 can distribute pressure from the user's body across the surface of the body support 3702, thereby potentially reducing stress upon the user's neck and/or reducing pressure upon the user's face or other area of the user's head in contact with the body support 3702. In those embodiments in which the reticulated visco-elastic foam is temperature-sensitive as described above, the shape of the body support 3702 can also be adapted to the user based upon the user's body heat. Also, the reticulated visco-elastic material of the body support 3702 can provide an increased amount of ventilation and/or heat dissipation based upon the skeletal cellular structure of the foam, thereby reducing heat in the body support 3702.

Figure 39:
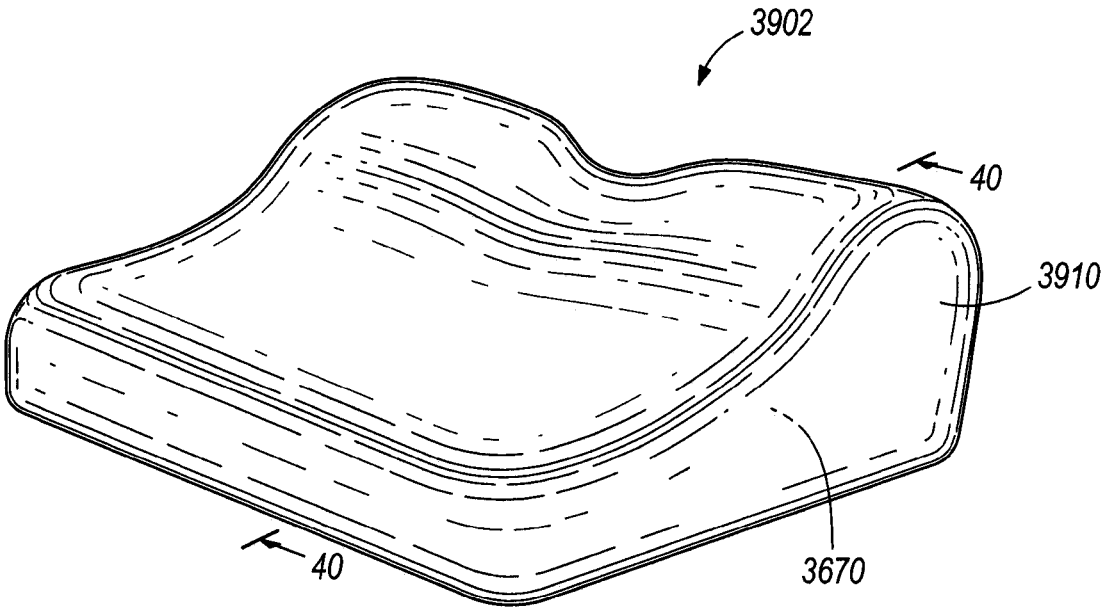
FIG. 39 is a perspective view of a pillow according to another embodiment of the present invention.
Figure 40:
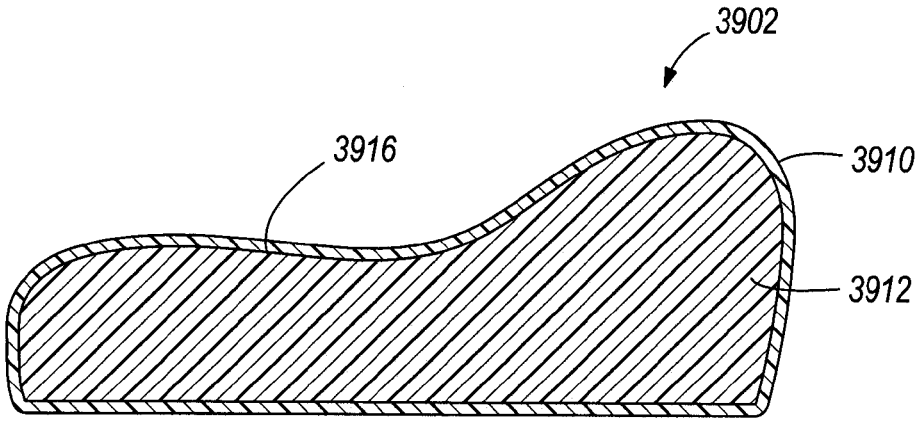
FIG. 40 is a cross-sectional view of the pillow illustrated in FIG. 39, taken along lines 40-40 of FIG. 39.

FIGS. 39 and 40 illustrate another embodiment of a body support according to the present invention. This embodiment employs much of the same structure and has many of the same properties as the embodiments of the body support described above in connection with FIG. 16. Accordingly, the following description focuses primarily upon the structure and features that are different than the embodiments described above in connection with FIG. 16. Reference should be made to the description above in connection with FIG. 16 for additional information regarding the structure and features, and possible alternatives to the structure and features of the body support illustrated in FIGS. 39 and 40 and described below. Structure and features of the embodiment shown in FIGS. 39 and 40 that correspond to structure and features of the embodiment of FIG. 16 are designated hereinafter in the 3900 series of reference numbers.

As described above, the various body supports of the present invention can have any shape and size desired for any body support application, including without limitation body supports used for mattress, mattress topper, overlay, futon, head pillow, seat cushion, seat back, neck pillow, leg spacer pillow, eye mask, and other applications upon which any part or all of a human or animal body is supported or cushioned. The body support 3902 illustrated in FIGS. 39 and 40 is an example of how a body support illustrated herein in the form of a mattress, mattress topper, overlay, or futon (e.g., see FIG. 16) can take the form of a pillow or other body support (e.g., see FIGS. 39 and 40). Like the body support 1602 illustrated in FIG. 16, the body support 3902 illustrated in FIGS. 39 and 40 has a first layer 3910 of reticulated visco-elastic foam and a second layer 3912 of non-reticulated visco-elastic foam. However, the first layer 3910 of reticulated visco-elastic foam illustrated in FIGS. 39 and 40 encloses the second layer 3912 of non-reticulated visco-elastic foam. In other embodiments, the first layer 3910 can cover any portion of the second layer 3912, such as only the top 3916 and sides 3670 of the second layer 3912, only the top 3916 of the second layer 3912, and the like.

The visco-elastic material of the second layer 3912 can provide the same desirable softness and body-conforming features described above in connection with the illustrated embodiment of FIGS. 1-1B. The first layer 3910 of reticulated visco-elastic foam can provide ventilation for the second layer 3912 of non-reticulated visco-elastic foam, and/or can dissipate heat from the second layer 3912 (due at least in part to the skeletal cellular structure of the foam of the first layer 3912), while still providing a relatively soft and comfortable surface of the body support 3902 and a degree of body-conforming and pressure distribution for the user's body by virtue of the visco-elastic nature of the first layer 3910. Also, the reticulated cellular structure of the first layer 3912 can provide improved ventilation at the surface of the body support 3902—a feature that can be desirable for applications in which a user's face, head, or other body portion is in close proximity to or in contact with the first layer 3910.

In other embodiments, the first layer 3910 of the body support 3902 illustrated in FIGS. 39 and 40 comprises reticulated non-visco-elastic foam (rather than reticulated visco-elastic foam). In such embodiments, the reticulated non-visco-elastic foam of the first layer 3910 can provide a degree of support while still retaining the heat-dissipative and/or ventilating properties described above due to the reticulated cellular structure of the first layer 3910. A body support 3902 having such a construction can also have significant softness and body conforming properties, based at least in part upon the non-reticulated visco-elastic foam in the second layer 3912.

In still other embodiments, the materials of the first and second layers 3910, 3912 described above can be reversed, in which case the first layer 3910 can comprise non-reticulated visco-elastic foam, and the second layer 3912 can comprise reticulated visco-elastic foam or reticulated non-visco-elastic foam. In such alternative embodiments, heat can be dissipated from the first layer 3910 by the reticulated visco-elastic or reticulated non-visco-elastic foam of the second layer 3912 (due at least in part to the skeletal cellular structure of the foam of the second layer 3912). In this structure, the softness, body-conforming, and pressure-distributing properties of the non-reticulated visco-elastic foam are retained in the first layer 3910 (proximate the body of a user) while the ventilating and/or heat-dissipative properties of the second layer 3912 can prevent or reduce heat in the first layer 3910. In those applications in which greater support independent of the user's body heat is desired, the second layer 3912 can comprise reticulated non-visco-elastic foam. In those applications in which temperature-sensitivity, greater softness, and increased body-conforming and pressure distribution is desired, the second layer 3912 can comprise reticulated visco-elastic foam.

Figure 41:
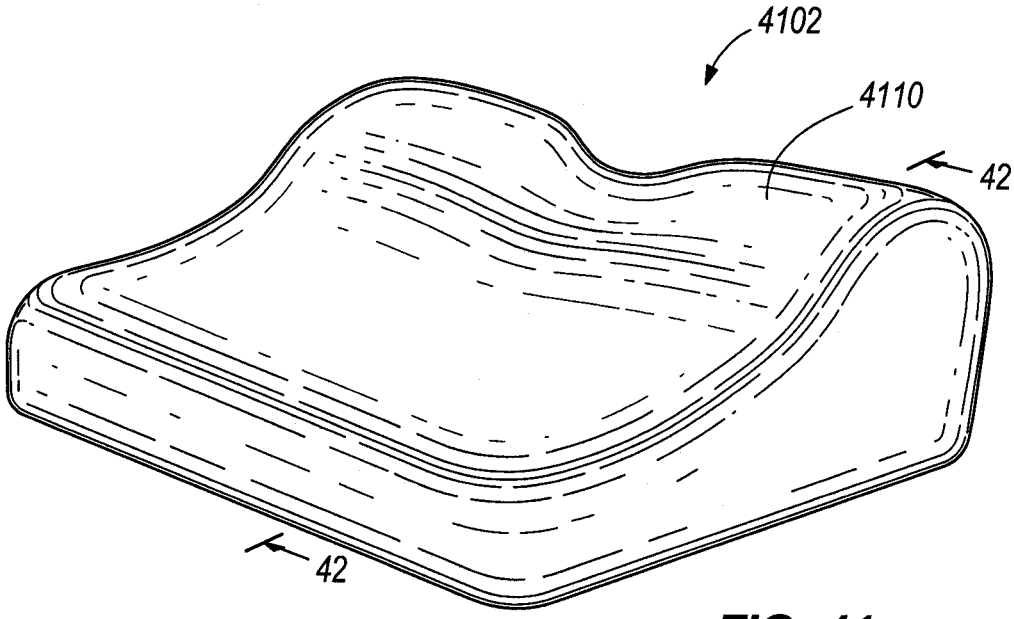
FIG. 41 is a perspective view of a pillow according to another embodiment of the present invention.
Figure 42:
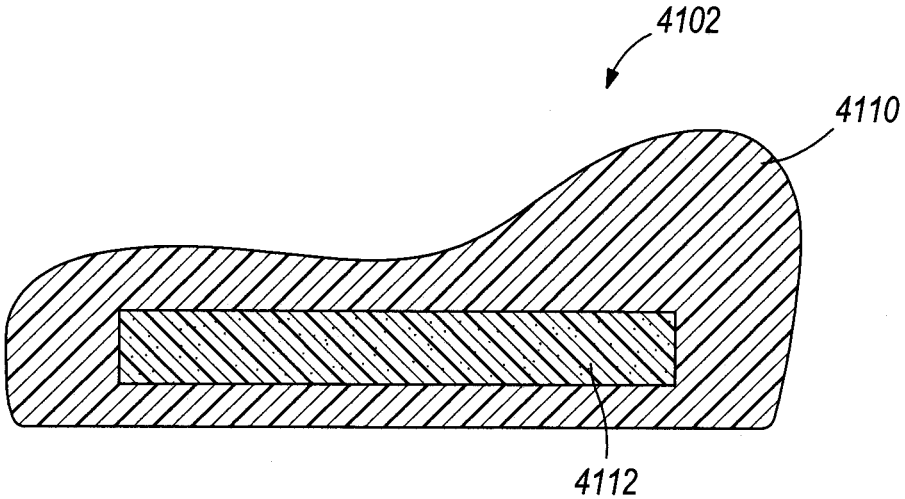
FIG. 42 is a cross-sectional view of the pillow illustrated in FIG. 41, taken along lines 42-42 of FIG. 41.

FIGS. 41 and 42 illustrate another embodiment of a body support according to the present invention. This embodiment employs much of the same structure and has many of the same properties as the embodiments of the body support described above in connection with FIGS. 39 and 40. Accordingly, the following description focuses primarily upon the structure and features that are different than the embodiments described above in connection with FIGS. 39 and 40. Reference should be made to the description above in connection with FIGS. 39 and 40 for additional information regarding the structure and features, and possible alternatives to the structure and features of the body support illustrated in FIGS. 41 and 42 and described below. Structure and features of the embodiment shown in FIGS. 41 and 42 that correspond to structure and features of the embodiment of FIGS. 39 and 40 are designated hereinafter in the 4100 series of reference numbers.

Like the body support 3902 illustrated in FIGS. 39 and 40, the body support 4102 illustrated in FIGS. 41 and 42 has a first layer 4110 of reticulated visco-elastic foam and a second layer 4112 of non-reticulated visco-elastic foam. The second layer 4112 can be partially or fully enclosed within the material of the first layer 4110, and can have any shape and size desired. By way of example only, the second layer 4112 illustrated in FIG. 42 is substantially block-shaped, and is relatively thick and elongated.

The body support 4102 can be manufactured in any manner desired. In some embodiments, the body support 4102 is manufactured by molding the first layer 4110 of reticulated visco-elastic foam over the second layer 4112 of non-reticulated visco-elastic foam. In such embodiments, the second layer 4112 can be an insert within the mold about which the reticulated visco-elastic foam of the first layer 4110 is formed. It will be appreciated that other manners of manufacturing the body support 4102 with an insert comprising non-reticulated visco-elastic foam are possible, and fall within the spirit and scope of the present invention.

In other embodiments, the first layer 4110 in the body support 4102 illustrated in FIGS. 41 and 42 comprises reticulated non-visco-elastic foam (rather than reticulated visco-elastic foam). In such embodiments, the body support 4102 can be manufactured in any of the manners just described.

Further description of the properties of such a body support construction are provided above in connection with the embodiment of FIGS. 39 and 40.

In still other embodiments, the materials of the first and second layers 4110, 4112 described above can be reversed, in which case the first layer 4110 can comprise non-reticulated visco-elastic or reticulated non-visco-elastic foam, and the second layer 4112 can comprise reticulated visco-elastic foam. Further description of the properties of such a body support construction are provided above in connection with the embodiment of FIGS. 39 and 40.

In those embodiments of the present invention disclosed herein having one or more layers of material, any layer can itself be defined by one or more "sub-layers" of the same type of material (e.g., open or closed celled non-reticulated visco-elastic foam, reticulated visco-elastic foam, reticulated non-visco-elastic foam, flexible cellular polyurethane foam having a relatively high resilience). In this regard, any of the layers can be defined by any number of such sub-layers. Also, the sub-layers in each layer can have the same or different thickness, and can have any of the layer shapes, surface profiles, or other features described and illustrated herein.

Figure 43:
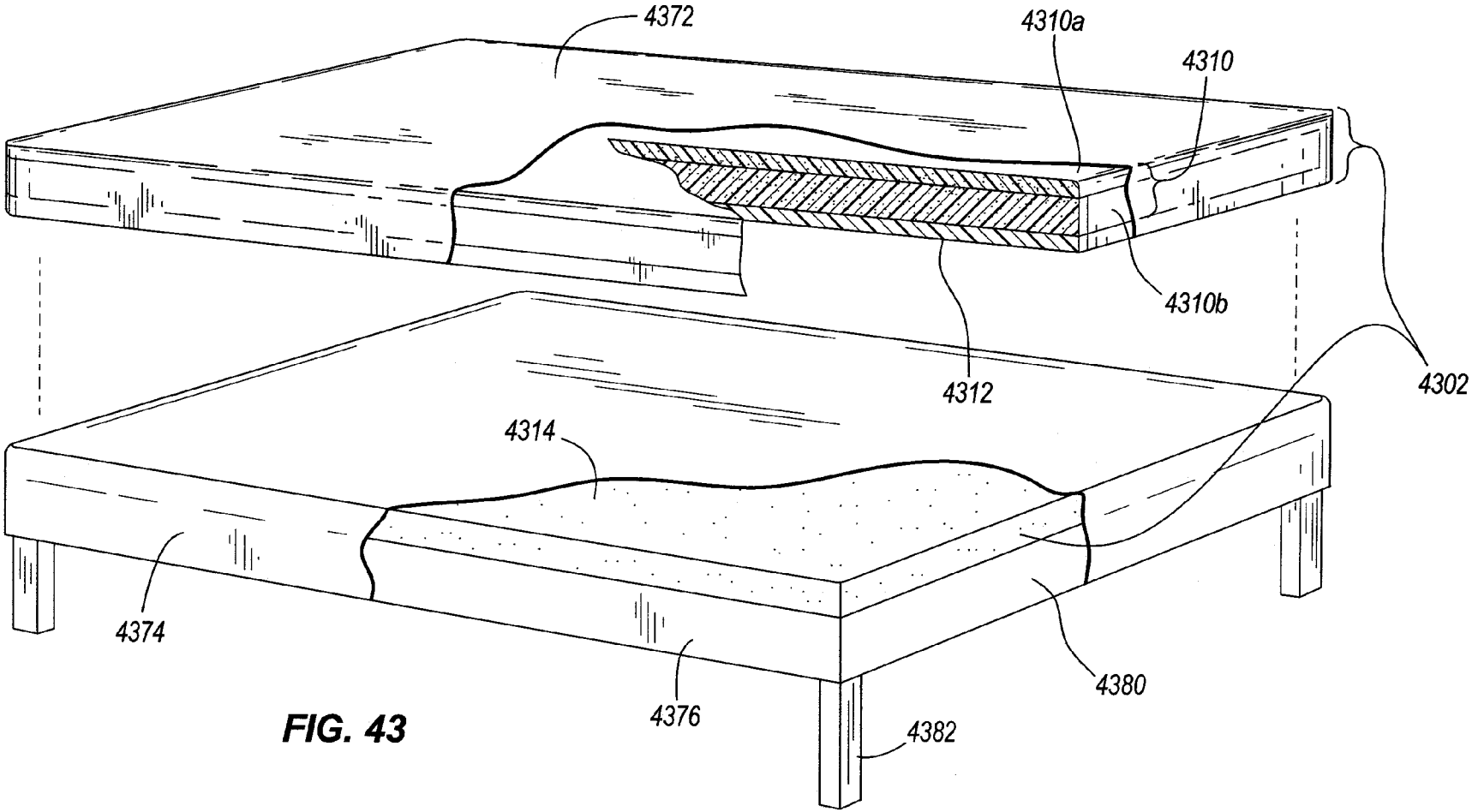
FIG. 43 is an exploded perspective view of a body support and foundation assembly according to an embodiment of the present invention.

By way of example only, the body support 4302 illustrated in FIG. 43 has the same layers arranged in the same order as the body support 2202 illustrated in FIG. 22. However, the top layer 4310 of open or closed celled non-reticulated visco-elastic foam illustrated in FIG. 43 comprises two sub-layers 4310*a*, 4310*b* of open or closed celled non-reticulated visco-elastic foam. Similarly, any of the other layers 4312, 4314 can instead or also comprise two or more sub-layers of material (i.e., two or more sub-layers of reticulated visco-elastic foam in the middle layer 4312, two or more sub-layers of relatively highly resilient flexible cellular foam in the bottom layer 4314, and the like).

In those embodiments having one or more layers defined by two or more sub-layers of the same type of material (as just described), the sub-layers can have the same or substantially the same material properties. However, this need not necessarily be the case. In this regard, the sub-layers can have different densities, hardnesses, temperature responsiveness or insensitivity, and other material properties while still falling within the ranges of such properties disclosed herein. With reference again to the body support 4302 illustrated in FIG. 43 by way of example only, the top sub-layer 4310*a* of non-reticulated visco-elastic foam has a greater density and lower hardness than that of the bottom sub-layer 4310*b* of non-reticulated visco-elastic foam. For example, in some embodiments, the top sub-layer 4310*a* of non-reticulated visco-elastic foam can have a density of about 110 kg/m$^3$, and a hardness of no less than about 40 N and/or no greater than about 50 N, while the bottom sub-layer 4310*b* of non-reticulated visco-elastic foam can have a density of no less than about 85 kg/m$^3$, and a hardness of no less than about 50 N and/or no greater than about 65 N. In this manner, a relatively soft (and, in some cases, relatively expensive) visco-elastic body support material can be utilized in a location where user sensitivity can be most demanding, while the cost of the top layer 4310 can be reduced by utilizing less expensive visco-elastic foam in the bottom sub-layer 4310*b* and/or while the support of the top layer 4310 can be increased by utilizing a firmer bottom sub-layer 4310*b*.

It will be appreciated that a first sub-layer in any layer of any body support disclosed herein can have a higher or lower density, hardness, temperature responsiveness, temperature insensitivity, or other material property than an underlying second sub-layer. In this regard, such differences in material properties can exist in sub-layers of non-reticulated visco-elastic foam and reticulated non-visco-elastic foam; and reticulated visco-elastic foam and relatively highly resilient flexible cellular foam, the properties of which are described above with reference to the embodiments of FIGS. 1-1B and 2-2A, respectively. In many cases, the material properties of the sub-layers can impact the cost of the layer and/or the manner in which the layer (and body support) responds to pressure, deformation, and other environmental conditions.

Any of the body supports disclosed herein can have one or more covers at least partially enclosing one or more of the body support layers. Each cover can fully or partially enclose a single layer of the body support, or two or more layers of the body support, as desired. Also, each cover can cover any or all surfaces of one or more layers, such as the top of a layer, the top and sides of a layer, one or more sides of a layer or adjacent layers, and the like. With reference again to the illustrated embodiment of FIG. 43 by way of example only, the illustrated body support 4302 comprises two covers: a first cover 4372 enclosing the top and middle layers 4310, 4312 of the body support 4302 and a second cover 4374 enclosing the bottom layer 4314 of the body support 4302. Also with reference to the embodiment of FIG. 43, the second cover 4374 can cover portions of the body support foundation 4376 (described in greater detail below).

The covers 4372, 4374 can comprise any sheet material desired, including without limitation any synthetic and/or natural fabric or cloth material, such as cotton, polyester, a cotton/polyester blend, wool, visco-elastic or non-visco-elastic foam sheeting, and the like, and can be made of the same or different materials. In some embodiments, each cover 4372, 4374 can have one or more seams. Depending at least in part upon the type of cover material utilized, the seams can be attached by adhesive or cohesive bonding material, double-sided tape, stitching, hot-melting, conventional fasteners (e.g., zippers, buttons, clasps, laces, hook and loop fastener material, hook and eye sets, tied ribbons, strings, cords, or other similar elements, and the like), by being molded together in one or more manufacturing processes, or in any other suitable manner.

The covers 4372, 4374 can be secured permanently to and/or about the layers 4312, 4314, 4316 which the covers 4372, 4374 at least partially enclose. In some embodiments, the covers 4372, 4374 are removable from such layers 4312, 4314, 4316, such as by being shaped to slip onto and off of the layers, by one or more releasable fasteners (e.g., zippers, buttons, clasps, laces, hook and loop fastener material pieces, hook and eye sets, tied ribbons, strings, cords, or other similar elements), and the like. Any such fasteners can be positioned to releasably secure at least one portion of a cover 4372, 4374 to another portion of the same or different cover 4372, 4374 and/or to an adjacent layer 4312, 4314, 4316. For example, the top cover 4372 illustrated in FIG. 43 can have a zippered slot (not shown) through which the top and middle layers 4310, 4312 of the body support 4302 can be moved to install and remove the top cover 4372.

With continued reference to the illustrated embodiment of FIG. 43, the body support 4302 in some embodiments of the present invention can be supported upon a foundation 4376 in an elevated position with respect to a floor surface. The foundation 4376 can take any form suitable for supporting the weight of the body support 4302 under normal or heavy loading. For example, the foundation 4376 can be constructed of beams, poles, tubes, planks, plates, blocks, and any combination thereof made of steel, iron, aluminum, and other metals, plastic, fiberglass and other synthetic materials, wood, refractory materials, and any combination thereof. For example, the foundation 4376 in the illustrated embodiment of FIG. 43 comprises a wood frame 4380 to which are attached legs 4382 for supporting the frame 4380 over a floor surface. Other foundation constructions and materials are possible, and fall within the spirit and scope of the present invention.

In some embodiments of the present invention, one or more bottom-most layers of any of the body supports disclosed herein can be separate from the other layers of the body support, and can be attached to a body support foundation (such as any of the body support foundation embodiments described above in connection with the embodiment of FIG. 43). In some embodiments, the bottom-most layer(s) can be permanently coupled to the body support foundation, such as by adhesive or cohesive bonding material, stitching (e.g., into a fabric or other sheet material covering of the foundation), double-sided tape, conventional fasteners, and the like. Alternatively, the bottom-most layer(s) can be releasably coupled to the body support foundation, such as by one or more zippers, straps, buttons, clasps, laces, pieces of hook and loop fastener material, hook and eye sets, tied ribbons, strings, cords, or other similar elements on the bottom-most layer(s) and/or on the foundation. In still other embodiments, the bottom-most layer(s) can be coupled to the body support by a cover (described above), such as by coupling the cover of the bottom-most layer(s) to the foundation (e.g., by staples, tacks nails, brads, rivets, and other conventional fasteners) or by permanently or releasably coupling the cover to the foundation in any of the manners described above with reference to connections between the bottom-most layer(s) and the foundation.

For example, the bottom cover 4374 of the embodiment illustrated in FIG. 43 can be permanently secured by nails or staples to the foundation 4376. The bottom cover 4374 can enclose any or all of the bottom layer 4314 of relatively highly resilient flexible cellular foam, and can enclose any part or all of the foundation 4376 (although in some embodiments, the bottom cover 4374 covers substantially none of the foundation 4376).

By utilizing a body support construction in which one or more of the layers of the body support are separate from one or more other layers of the body support (i.e., are shipped separately from, are releasably connected to, and/or are not connected to such other layer(s)), a body support and foundation assembly can be provided that can be easier and/or less expensive to ship, move, and assemble. In some embodiments, it is not practical or economical to manufacture and ship thicker body supports based at least in part upon the weight and size of such supports. An option is to provide the thicker body supports in two or more separate pieces. However, the purchase and shipment of separate body support pieces (in addition to a separate foundation) is not always attractive to manufacturers, distributors, or purchasers. By permanently or releasably coupling one or more layers of the body support to the foundation, a relatively thick body support can still be provided while avoiding the disadvantages of two or more separate body support pieces in addition to a foundation. Also, such a body support and foundation construction can enable the manufacture and shipment of still thicker body supports that would otherwise be too bulky or heavy to move.

It will be appreciated that the above description of the covers 4372, 4374 applies equally to other covers utilized to at least partially enclose any one or more layers in any of the other body support embodiments disclosed herein. It will also be appreciated that the above description of the foundation 4376 applies equally to the support of any of the other body support embodiments disclosed herein.

As described above in connection with several embodiments of the present invention (e.g., embodiments of the present invention illustrated in FIGS. 31-34), it is often desirable (within any of the body supports disclosed herein) to utilize a layer of non-reticulated visco-elastic foam material having one or more portions at least partially surrounded by reticulated foam. By way of example only, the embodiment of FIG. 31 includes a top layer 3110 of non-reticulated visco-elastic foam having portions 3132 of reticulated foam therein. As described above, any number of such portions 3132 having any shape, size, and positions in the layer of visco-elastic foam layer 3110 are possible, and fall within the spirit and scope of the present invention. It should also be noted that in such embodiments, the reticulated foam of the portions 3132 can be visco-elastic or non-visco-elastic reticulated foam.

Figures 44, 44A:
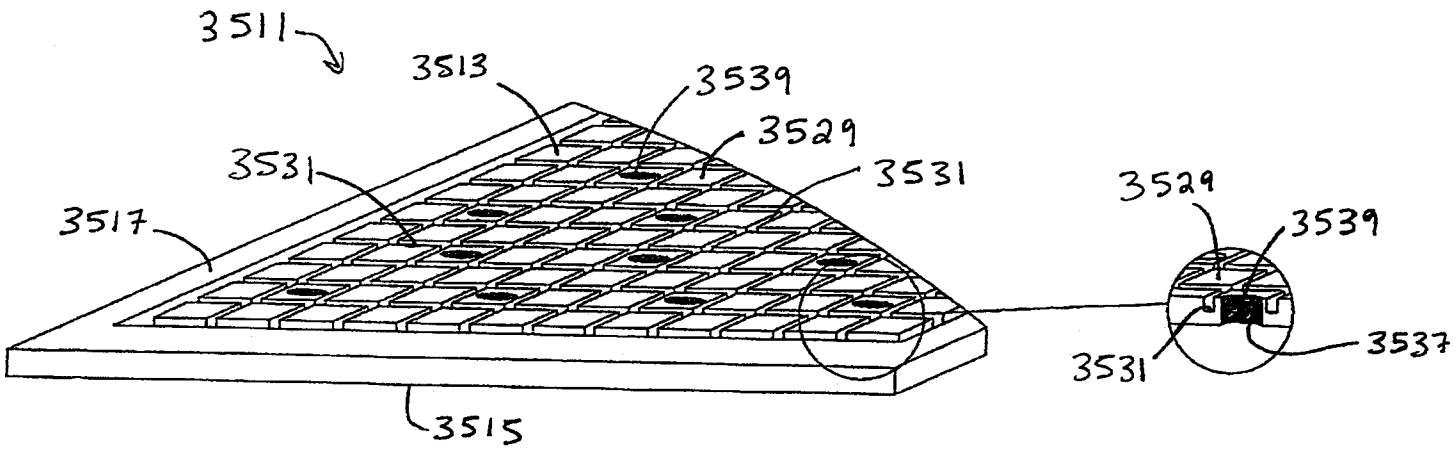
FIG. 44 is a perspective view of a layer of the body support according to an embodiment of the present invention.
FIG. 44A is a detailed view of a portion of the layer of FIG. 44.

Another example of a visco-elastic foam layer that can be utilized in any location (e.g., upper, lower, or any intermediate layer) in any of the body supports described and/or illustrated herein is shown in FIGS. 44 and 44A. The layer 3511 comprises visco-elastic foam having any of density, hardness, and other visco-elastic foam properties described above. In some embodiments, the layer 3511 can be positioned on a top surface, either in addition to or in place of the existing top layer, of any of the embodiments described herein. For example, the visco-elastic foam layer 3511 shown in FIGS. 44 and 44A is adapted for use as an upper-most layer in a body support. However, the layer 3511 can be utilized to replace any of the above-described layers or in addition to any of the above-described embodiments.

In some embodiments, the layer 3511 can include top and bottom surfaces 3513, 3515. In the illustrated embodiment, the top surface 3513 can be at least partially defined by a plurality of protrusions 3529 that can each have a substantially planar top, or that can instead have any other shape desired. For example, the protrusions 3529 can be generally conical in shape, can be frusto-conical, can have rounded tips (e.g., such as the protrusions 428 shown in FIG. 4), and the like. In other embodiments, the protrusions can include ribs, bumps, and other protrusions of any shape and size, including any of the protrusion shapes and sizes described above. In still other embodiments, the layer 3511 is substantially planar, and has no protrusions.

With reference again to the illustrated embodiment of FIGS. 44 and 44A, a plurality of channels 3531 can be positioned between the plurality of protrusions 3529, and can extend substantially across the layer 3511 or across any fraction of the length or width of the body support having the layer 3511. The channels 3531 can at least partially form passageways that permit air movement around the protrusions 3529 to improve heat distribution across the layer 3511. In the illustrated embodiment, the channels 3531 extend along the length and along the width of the layer 3511. In other embodiments, the channels 3531 can extend along either of the length and width of the layer 3511. Also, in other embodiments, some or all of the channels 3531 can extend diagonally across the layer 3511. In still other embodiments, the channels can travel a curved path, a circular path, a serpentine path, or in any other path along the layer 3511.

A substantially planar perimeter 3517 can be provided to increase support along the perimeter of the layer 3511. The substantially planar perimeter 3517 can include the same foam material as the layer 3511, or can comprise a different foam, such as a stiffer foam to provide support along the perimeter (as described above in connection with FIG. 8). In the illustrated embodiment of FIGS. 44 and 44A, the perimeter 3517 at least partially defines the top surface 3513 of the layer 3511. In some embodiments, at least a portion of the channels 3531 can extend across the perimeter 3517 to permit air and fluid ventilation. It can also be beneficial to extend the channels 3531 across the perimeter 3517 for embodiments that include the layer 3511 between one or more foam layers. In such embodiments, the channels 3531 can at least partially define passages, such as passages 430 described in accordance with the embodiment of FIG. 4.

In the illustrated embodiment of FIGS. 44 and 44A, a number of regions within the visco-elastic foam layer 3511 are made of a different foam. This different foam can be reticulated foam as described above, enabling heat and moisture transport through the layer 3511. By utilizing such foam in one or more locations in the visco-elastic foam layer 3511, heat and/or moisture can more readily move through the visco-elastic foam layer 3511 to locations (e.g., other layer(s) of the body support) beneath the layer 3511. The regions of reticulated foam (indicated at 3539) in the layer 3511 can be visco-elastic reticulated foam or non-reticulated visco-elastic foam. The density, hardness, and other visco-elastic and non-visco-elastic foam characteristics of these regions are described above in connection with the other embodiments of the present invention. These regions of reticulated foam can be located anywhere across the length and width of the layer 3511. By way of example only, the regions 3539 of reticulated foam illustrated in FIGS. 44 and 44A are reticulated non-visco-elastic foam, and are each located within protrusions 3529 described above.

In some embodiments, the regions 3539 of reticulated foam are defined within apertures 3537 extending partially or fully through the visco-elastic foam layer 3511. These apertures 3537 can be created in an number of different manners (e.g., cut, molded into the layer 3511 when the layer 3511 is produced, punched out, and the like).

In the illustrated embodiment, the apertures 3537 have a substantially circular cross-section, but any other cross-sectional shapes can be utilized, such as square, rectangle, triangle, elliptical, pentagonal, hexagonal or other regular or irregular shapes. The apertures 3537 and corresponding regions 3539 of reticulated foam can have a substantially cylindrical shape, as illustrated, or can have a conical or trapezoidal shape, such that apertures 3537 are smaller at one of the top surface 3513 and the bottom surface 3515 and larger at the other of the top surface 3513 and the bottom surface 3515.

The apertures 3537 and corresponding regions 3539 of reticulated foam can be located in any portion(s) of the visco-elastic foam layer 3511. In this regard, the apertures 3537 and corresponding foam regions 3539 can be substantially evenly distributed across the layer 3511 or can be concentrated in some areas and sparse in other areas. For example, a user's torso often generates more heat than a user's arms and legs, so it may be desirable to position more foam regions 3539 adjacent the torso and fewer foam regions 3539 adjacent the arms and legs. In other embodiments, it may be desirable to position more foam regions 3539 spaced from the torso, such that the torso can be supported on the layer 3511 and the channels 3531 promote heat and fluid transport away from the torso and through the foam regions 3539 away from the torso. In some embodiments, at least some of the apertures 3537 are unfilled to promote uninhibited flow of fluid and heat through the layer 3511.

A number of the body support embodiments disclosed herein employ one or more layers of material having different types of material in different areas of the same layer (e.g., see the embodiments of FIGS. 7-9 and 31-34). It should be noted that such layers can be utilized in other body supports having different underlying and/or overlying layers while still performing some or all of their functions described above. Such alternate body supports and fall within the spirit and scope of the present invention.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, the reticulated and non-reticulated visco-elastic foam utilized in the various embodiments of the present invention described and illustrated herein can be made from a polyurethane foam. However, it should be noted that any other visco-elastic polymer material exhibiting similar properties (e.g., thermally-responsive properties) can instead be used as desired.

Also, several of the body support embodiments disclosed herein utilize one or more non-planar surface shapes in order to define passages through which air can move and/or to increase the ability of heat to dissipate within the body support. Although the locations of such non-planar surfaces as described above in the various embodiments can provide significant performance advantages for the body supports, such non-planar surface shapes can be utilized between any two adjacent layers in any of the body support embodiments disclosed herein. Further details of such non-planar surface shapes are provided above in connection with the illustrated embodiment of FIG. 4.

It should be noted that the various body supports described and illustrated herein can be utilized alone or in combination with one or more other layers of material. Such additional layers of material can comprise any of the foam materials described herein (or other materials, as desired), can be located beneath and support the disclosed body support, and can be permanently or releasably coupled to the disclosed body support.

As described in greater detail above, some embodiments of the present invention have a relatively thin cover of reticulated non-visco-elastic foam covering one or more surfaces of one or more layers of the body support (e.g., see the embodiments of FIGS. 9, 29, and 30). The reticulated non-visco-elastic foam cover can be selected to provide a heightened degree of fire resistance to the body support, can be utilized in some countries and/or localities to meet fire codes calling for such fire resistance, and can provide improved ventilation and/or heat dissipation for surfaces of one or more adjacent body support layers based at least in part upon the skeletal cellular structure of the reticulated non-visco-elastic foam. Although the reticulated foam covers described above comprise non-visco-elastic foam, it will be appreciated that such reticulated foam covers can instead comprise visco-elastic foam. Also, the reticulated foam covers in the embodiments of FIGS. 9, 29, and 30 are disclosed by way of example, it being understood that reticulated visco-elastic or reticulated non-visco-elastic foam covers can cover any exterior surface of any of the layers in any of the other body support embodiments disclosed herein.

What is claimed is:

1. A mattress, comprising:

a single, continuous uppermost layer of flexible material sized to accommodate a user lying in a prone or supine position and having a top surface and a bottom surface opposite the top surface, the uppermost layer of flexible material comprising a non-reticulated visco-elastic cellular foam; and an underlying layer of flexible material supporting the uppermost layer of flexible material and having top and bottom surfaces on opposite sides of the second layer of flexible material, the underlying layer of flexible material comprising a reticulated non-visco-elastic cellular foam.

2. The mattress claimed in claim 1, wherein the underlying layer of flexible material is adjacent the uppermost layer of flexible material.

3. The mattress claimed in claim 1, wherein the underlying and uppermost layers of flexible material are secured to one another.

4. The mattress claimed in claim 1, wherein the uppermost layer of flexible material has a density no less than about 30 kg/m3 and no greater than about 150 kg/m3.

5. The mattress claimed in claim 1, wherein the uppermost layer of flexible material has a hardness no less than about 30 N and no greater than about 175 N.

6. The mattress claimed in claim 1, wherein the uppermost layer of flexible material has a temperature change responsiveness of no greater than 10% change in hardness within a temperature range of 10-30 degrees Celsius.

7. The mattress claimed in claim 1, wherein the underlying layer of flexible material has a density no less than about 20 kg/m3 and no greater than about 80 kg/m3.

8. The mattress claimed in claim 1, wherein the underlying layer of flexible material has a hardness no less than about 50 N and no greater than about 300 N.

9. The mattress claimed in claim 1, wherein the underlying layer of flexible material is thicker than the uppermost layer of flexible material.

10. A mattress, comprising:

a first layer of flexible material having a top surface and a bottom surface opposite the top surface, the first layer of flexible material comprising a non-reticulated visco-elastic cellular foam; and a second layer of flexible material supporting the first layer of flexible material and having top and bottom surfaces on opposite sides of the second layer of flexible material, the second layer of flexible material being thicker than the first layer of flexible material and comprising a reticulated non-visco-elastic cellular foam, wherein the second layer of flexible material is thicker than the first layer of flexible material.

11. The mattress claimed in claim 10, wherein the first layer of flexible material is adjacent the second layer of flexible material.

12. The mattress claimed in claim 10, wherein the first and second layers of flexible material are secured to one another.

13. The mattress claimed in claim 10, wherein the first layer of flexible material has a density no less than about 30 kg/m3 and no greater than about 150 kg/m3.

14. The mattress claimed in claim 10, wherein the first layer of flexible material has a hardness no less than about 30 N and no greater than about 175 N.

15. The mattress claimed in claim 10, wherein the first layer of flexible material has a temperature change responsiveness of no greater than 10% change in hardness within a temperature range of 10-30 degrees Celsius.

16. The mattress claimed in claim 10, wherein the second layer of flexible material has a density no less than about 20 kg/m3 and no greater than about 80 kg/m3.

17. The mattress claimed in claim 10, wherein the second layer of flexible material has a hardness no less than about 50 N and no greater than about 300 N.

* * * * *